US008151941B2

(12) United States Patent
Moses et al.

(10) Patent No.: US 8,151,941 B2
(45) Date of Patent: Apr. 10, 2012

(54) EVACUATION SYSTEM FOR A BUILDING INCLUDING BUILDING MOUNTED STABILIZING ELEMENT

(75) Inventors: Eyal Moses, Tel Aviv (IL); Tal Gordon, Hod Hasharon (IL); Andrey Bochkariov, Rishon Le'zion (IL)

(73) Assignee: Escape Rescue Systems, Ltd., Tel Mond (IL)

( * ) Notice: Subject to any disclaimer, the term of this patent is extended or adjusted under 35 U.S.C. 154(b) by 896 days.

(21) Appl. No.: 11/911,907

(22) PCT Filed: Apr. 21, 2005

(86) PCT No.: PCT/IL2005/000433
§ 371 (c)(1),
(2), (4) Date: Feb. 20, 2008

(87) PCT Pub. No.: WO2006/111947
PCT Pub. Date: Oct. 26, 2006

(65) Prior Publication Data
US 2008/0190704 A1 Aug. 14, 2008

(51) Int. Cl.
*B66B 9/00* (2006.01)

(52) U.S. Cl. ..... 187/239; 187/401; 187/900; 182/37

(58) Field of Classification Search ..... 187/239–242, 187/277, 391, 393, 401, 900; 182/36–39, 182/48, 49, 62.5, 82, 14
See application file for complete search history.

(56) References Cited

U.S. PATENT DOCUMENTS

| | | | | |
|---|---|---|---|---|
| 3,650,356 | A | | 3/1972 | Brown |
| 3,945,469 | A | | 3/1976 | Dorcich |
| 3,954,185 | A | | 5/1976 | Wentz |
| 4,018,306 | A | | 4/1977 | Lyons |
| 4,037,685 | A | | 7/1977 | Talucci |
| 4,042,066 | A | | 8/1977 | Noone |
| 4,068,738 | A | | 1/1978 | Reed et al. |
| 4,168,748 | A | | 9/1979 | Batte |
| 4,270,628 | A | | 6/1981 | Anderson et al. |
| 4,355,699 | A | * | 10/1982 | Smith, Jr. ..... 182/12 |
| 4,406,351 | A | | 9/1983 | Littlejohn et al. |
| 4,424,884 | A | | 1/1984 | Smith, Jr. |
| 4,469,198 | A | | 9/1984 | Crump |
| 4,531,611 | A | | 7/1985 | Curiel |
| 4,538,704 | A | | 9/1985 | Forrest |
| 4,569,418 | A | | 2/1986 | Novarini et al. |
| 4,640,384 | A | * | 2/1987 | Kucher et al. ..... 182/51 |
| 4,650,036 | A | | 3/1987 | Matsuda et al. |
| 4,664,226 | A | | 5/1987 | Centanne |
| 4,828,072 | A | * | 5/1989 | Ho ..... 182/9 |
| 4,830,141 | A | | 5/1989 | Montaigne |
| 4,865,155 | A | * | 9/1989 | Montaigne et al. ..... 182/14 |
| 4,919,228 | A | | 4/1990 | Stefan |

(Continued)

FOREIGN PATENT DOCUMENTS

| | | |
|---|---|---|
| EP | 0142963 | 5/1985 |

(Continued)

*Primary Examiner* — Anthony Salata
(74) *Attorney, Agent, or Firm* — Fish & Richardson P.C.

(57) ABSTRACT

An evacuation system for a building including at least one vertical transporter including multiple platforms arranged for selectable communication with multiple floors of the building for loading of persons onto the multiple platforms and at least one building mounted stabilizing element cooperating with the transporter for stabilizing the transporter against lateral forces.

12 Claims, 70 Drawing Sheets

U.S. PATENT DOCUMENTS

| | | | | |
|---|---|---|---|---|
| 5,065,839 | A | 11/1991 | Napier et al. | |
| 5,127,491 | A | 7/1992 | Just-Buddy | |
| 5,377,778 | A | 1/1995 | Lan et al. | |
| 5,392,877 | A | 2/1995 | Shahin et al. | |
| 5,497,855 | A | 3/1996 | Moore | |
| 5,498,011 | A | 3/1996 | Kilada et al. | |
| 5,597,987 | A | 1/1997 | Gilliland et al. | |
| 5,620,058 | A | 4/1997 | Forrester | |
| 5,660,249 | A | 8/1997 | Powell et al. | |
| 5,927,432 | A * | 7/1999 | Hershtik | 182/82 |
| 6,318,503 | B1 | 11/2001 | Hernandez | |
| 6,467,575 | B1 * | 10/2002 | Chen | 182/48 |
| 7,191,873 | B2 * | 3/2007 | Korchagin et al. | 187/239 |
| 7,270,217 | B1 * | 9/2007 | Haney | 187/239 |
| 2004/0118635 | A1 * | 6/2004 | Sun et al. | 182/142 |
| 2004/0154869 | A1 | 8/2004 | May | |
| 2004/0256179 | A1 | 12/2004 | Deplazes et al. | |

FOREIGN PATENT DOCUMENTS

| | | |
|---|---|---|
| GB | 1434366 | 5/1976 |
| GB | 2099789 | 12/1982 |

* cited by examiner 102
106
222
136
220
252
252
250
200
106
108

EVACUATION SYSTEM FOR A BUILDING INCLUDING BUILDING MOUNTED STABILIZING ELEMENT

REFERENCE TO CO-PENDING APPLICATIONS

This application is the U.S. national phase of International Application No. PCT/IL2005/000433, filed Apr. 21, 2005, the disclosure of which is incorporated herein by reference in its entirety. The International Application published in English on Oct. 26, 2006 as WO 2006/111947 under PCT Article 21(2).

FIELD OF THE INVENTION

The present invention relates to building evacuation systems and methods, and more particularly to high-rise building evacuation systems and methods.

BACKGROUND OF THE INVENTION

The following U.S. patents are believed to represent the current state of the art:

U.S. Pat. Nos. 3,945,469; 4,018,306; 4,037,685; 4,042,066; 4,406,351; 4,424,884; 4,469,198; 4,531,611; 4,538,704; 4,569,418; 4,650,036; 4,664,226; 4,830,141; 4,865,155; 4,919,228; 5,065,839; 5,127,491; 5,377,778; 5,392,877; 5,497,855; 5,620,058 and 6,318,503.

SUMMARY OF THE INVENTION

The present invention seeks to provide improved building evacuation systems and methods.

There is thus provided in accordance with a preferred embodiment of the present invention an evacuation system for a building including at least one generally vertical transporter arranged for selectable communication with multiple floors of the building and at least one controller for operating the at least one transporter to lower persons from the multiple floors to a level at which egress of persons may safely occur, the at least one generally vertical transporter including a plurality of platforms, and the at least one controller being operative in an ingress mode of operation to position the plurality of platforms simultaneously at different ones of the multiple floors of the building and being operative in a pre-egress mode of operation to vertically mutually reposition the plurality of platforms to lie at least partially alongside each other at an egress location.

There is also provided in accordance with another preferred embodiment of the present invention an evacuation system for a building including at least one generally vertical transporter arranged for selectable communication with multiple floors of the building and at least one controller for operating the at least one transporter to lower persons from the multiple floors to a level at which egress of persons may safely occur, the at least one generally vertical transporter including a plurality of platforms, and the at least one controller being operative in a first selectable ingress mode of operation to position the plurality of platforms simultaneously at different ones of the multiple floors of the building and being operative in a second selectable ingress mode of operation to position the plurality of platforms simultaneously on a single floor of the building.

In accordance with a preferred embodiment of the present invention the at least one controller is also operative in a pre-egress mode of operation to vertically mutually reposition the plurality of platforms to lie at least partially alongside each other at an egress location. Preferably, the at least one controller is also operative in a first selectable lowering mode of operation to lower the plurality of platforms generally alongside each other and in a second selectable lowering mode of operation to lower the plurality of platforms not all generally alongside each other.

In accordance with another preferred embodiment of the present invention the plurality of platforms are constructed and operative to allow persons to move transversely therebetween when the plurality of platforms are positioned generally alongside each other.

Preferably, the at least one transporter includes a plurality of mutually hinged platforms. Alternatively or additionally, the at least one transporter includes a plurality of mutually pivotable platforms. Preferably, the plurality of mutually pivotable platforms are mutually pivotable about a vertical axis. Alternatively, the plurality of mutually pivotable platforms are mutually pivotable about an horizontal axis.

In accordance with a further preferred embodiment of the present invention the at least one transporter includes a plurality of side-by-side situated mutually vertically displaceable platforms.

Preferably, the plurality of platforms are arranged in a mutually collapsed relationship when not in use.

In accordance with another preferred embodiment of the present invention, the at least one transporter includes multiple generally vertical supports. Preferably, the multiple generally vertical supports include cables. Alternatively, the multiple generally vertical supports include rigid support elements.

In accordance with yet another preferred embodiment of the present invention, the plurality of platforms each include a bottom support surface and a peripheral enclosing element. Preferably, the peripheral enclosing element includes at least one of a heat resistant material, a fire resistant material and a smoke impermeable material.

Preferably, the evacuation system also includes at least one building mounted stabilizing element cooperating with the transporter for stabilizing the transporter against lateral forces.

In accordance with still another preferred embodiment of the present invention, the at least one transporter includes a plurality of transporters, and the at least one controller is operative to individually control individual ones of the plurality of transporters wherein multiple one of the platforms of different transporters may be simultaneously positioned in communication with different groups of multiple floors of the building for simultaneous evacuation loading.

Preferably, the controller is operative to simultaneously position the multiple platforms in communication with multiple egress locations for simultaneous evacuation.

In accordance with a further preferred embodiment of the present invention the at least one transporter is also operative for lifting persons from the egress location to the multiple floors of the building.

Preferably, the transporter is building mounted.

In accordance with another preferred embodiment of the present invention, the controller is operative to selectably lower the at least one transporter to an egress level in the absence of electrical power.

Preferably, each of the plurality of platforms includes an enclosure pressurizer and associated air filter operative to inhibit the ingress of smoke and noxious gases thereto. Additionally or alternatively, each of the plurality of platforms includes an egress opening which can only be opened in an egress mode of operation.

In accordance with yet another preferred embodiment of the present invention the multiple platforms are positioned at multiple floors of the building which are not contiguous.

There is further provided in accordance with another preferred embodiment of the present invention an evacuation system for a building including at least one generally vertical transporter arranged for selectable communication with at least one floor of the building and including a platform including a plurality of openings facing an outer surface of the building and being arranged for permitting simultaneous ingress to the platform through multiple emergency exits located on a given floor of the building, and at least one controller for operating the at least one transporter to lower persons to a level at which egress of persons may safely occur.

There is even further provided in accordance with yet another preferred embodiment of the present invention an evacuation system for a building including at least one generally vertical transporter arranged for selectable communication with at least one floor of the building having a building cross section and including a platform having a non-rectangular configuration which conforms to a non-rectilinear portion of the building cross section, and at least one controller for operating the at least one transporter to lower persons to a level at which egress of persons may safely occur.

In accordance with another preferred embodiment of the present invention, the platform includes a bottom support surface and a peripheral enclosing element. Preferably, the evacuation system also includes at least one building mounted stabilizing element cooperating with the at least one transporter for stabilizing the transporter against lateral forces.

In accordance with a further preferred embodiment of the present invention, the at least one transporter includes a plurality of transporters, and the at least one controller is operative to individually control individual ones of the plurality of transporters wherein the platform of each of the individual ones of the plurality of transporters may be simultaneously positioned in communication with different floors of the building for simultaneous evacuation loading. Additionally, the at least one transporter is also operative for lifting persons from an egress level to at least one floor of the building.

Preferably, the transporter is building mounted. Additionally, the controller is operative to selectably lower the at least one transporter to an egress level in the absence of electrical power. Preferably, the platform includes an enclosure pressurizer and associated air filter operative to inhibit the ingress of smoke and noxious gases thereto.

There is yet further provided in accordance with a further preferred embodiment of the present invention an evacuation system for a building including at least one generally vertical transporter arranged for selectable communication with at least one floor of the building having at least one building setback and including at least one platform, at least one building mounted stabilizing element cooperating with the transporter for stabilizing the transporter against lateral forces, the at least one building mounted stabilizing element including at least one non-vertical portion arranged at the building setback, the at least one transporter being operative to lower persons along the at least one building mounted stabilizing element including the at least one non-vertical portion arranged at the building setback to a level at which egress of persons may safely occur.

There is still further provided in accordance with another preferred embodiment of the present invention an evacuation system for a building including at least one generally vertical transporter arranged for selectable communication with at least one floor of the building and including at least one platform including a bottom support surface, a peripheral enclosure and an enclosure pressurizer and associated air filter operative to reduce the ingress of smoke and noxious gases thereto, and at least one controller for operating the at least one transporter to lower persons to a level at which egress of persons may safely occur.

In accordance with a preferred embodiment of the present invention, the at least one platform includes a plurality of platforms, the at least one floor includes multiple floors, and the at least one controller is operative in an ingress mode of operation to position the plurality of platforms simultaneously at different ones of the multiple floors of the building.

Preferably, the at least one transporter includes a plurality of mutually hinged platforms. Additionally, the at least one transporter includes a plurality of mutually pivotable platforms. Preferably, the plurality of mutually pivotable platforms are mutually pivotable about an horizontal axis. Additionally or alternatively, the plurality of platforms are arranged in a mutually collapsed relationship when not in use.

Preferably, the at least one transporter includes multiple generally vertical supports. Additionally, the multiple generally vertical supports include cables. Alternatively, the multiple generally vertical supports include rigid support elements.

In accordance with another preferred embodiment of the present invention, the at least one platform includes a bottom support surface and a peripheral enclosing element. Preferably, the peripheral enclosing element includes at least one of a heat resistant material, a fire resistant material and a smoke impermeable material.

In accordance with a further preferred embodiment of the present invention, the at least one transporter includes a plurality of transporters, and the at least one controller is operative to individually control individual ones of the plurality of transporters wherein multiple ones of the platforms of different transporters may be simultaneously positioned in communication with different groups of multiple floors of the building for simultaneous evacuation loading.

Preferably, the at least one controller is operative to simultaneously position the multiple platforms in communication with multiple egress locations for simultaneous evacuation. Additionally or alternatively, the at least one transporter is also operative for lifting persons from an egress level to the multiple floors of the building. Preferably, the controller is operative to selectably lower the at least one transporter to an egress level in the absence of electrical power.

There is also provided in accordance with still another preferred embodiment of the present invention an evacuation method for emergency evacuation of persons from a building including providing at least one generally vertical transporter, including a plurality of platforms, arranged for selectable communication with multiple floors of the building, and operating the at least one transporter to lower persons from the multiple floors to a level at which egress of persons may safely occur, in an ingress mode of operation to position the plurality of platforms simultaneously at different ones of the multiple floors of the building and in a pre-egress mode of operation to vertically mutually reposition the plurality of platforms to lie at least partially alongside each other at an egress location.

There is further provided in accordance with another preferred embodiment of the present invention an evacuation method for emergency evacuation of persons from a building including providing at least one generally vertical transporter, including a plurality of platforms, arranged for selectable communication with multiple floors of the building, and operating the at least one transporter to lower persons from the multiple floors to a level at which egress of persons may safely occur, in a first selectable ingress mode of operation to position the plurality of platforms simultaneously at different ones of the multiple floors of the building and in a second selectable ingress mode of operation to position the plurality of platforms simultaneously on a single floor of the building.

In accordance with a preferred embodiment of the present invention, the evacuation method also includes, in a pre-egress mode of operation, vertically mutually repositioning the plurality of platforms to lie at least partially alongside each other at an egress location. Additionally or alternatively, the evacuation method also includes, in a first selectable lowering mode of operation, lowering the plurality of platforms generally alongside each other and in a second selectable lowering mode of operation, lowering the plurality of platforms not all generally alongside each other.

Preferably, the evacuation method also includes providing at least one building mounted stabilizing element cooperating with the at least one transporter for stabilizing the at least one transporter against lateral forces.

Preferably, the providing at least one transporter includes providing a plurality of transporters and the method also includes individually controlling individual ones of the plurality of transporters, wherein multiple one of the platforms of different transporters can be simultaneously positioned in communication with different groups of multiple floors of the building for simultaneous evacuation loading.

Preferably, the evacuation method also includes simultaneously positioning the multiple platforms in communication with multiple egress locations for simultaneous evacuation. Additionally or alternatively, the evacuation method also includes utilizing the at least one transporter for lifting persons from the egress location to the multiple floors of the building.

Preferably, the evacuation method also includes pressurizing and filtering air of each of the plurality of platforms to inhibit the ingress of smoke and noxious gases to each of the plurality of platforms.

There is yet further provided in accordance with still another preferred embodiment of the present invention an evacuation method for emergency evacuation of persons from a building including providing at least one generally vertical transporter including a platform including a plurality of openings facing an outer surface of the building for selectable communication with at least one floor of the building permitting simultaneous ingress to the platform through multiple emergency exits located on a given floor of the building and via the plurality of openings, and operating the at least one transporter to lower persons to a level at which egress of persons may safely occur.

There is even further provided in accordance with yet another preferred embodiment of the present invention, an evacuation method for emergency evacuation of persons from a building including, providing at least one generally vertical transporter, including a platform having a non-rectangular configuration which conforms to a non-rectilinear portion of a cross section of the building, and operating the at least one transporter for selectable communication with at least one floor of the building at the non-rectilinear portion of the cross section of the building and for lowering persons to a level at which egress of persons may safely occur.

In accordance with a preferred embodiment of the present invention, the evacuation method also includes providing at least one building mounted stabilizing element cooperating with the transporter for stabilizing the transporter against lateral forces.

Preferably, the providing at least one transporter includes providing a plurality of transporters and the evacuation method also includes individually controlling individual ones of the plurality of transporters to simultaneously position platforms of different transporters to be in communication with different floors of the building for simultaneous evacuation loading.

Preferably, the evacuation method also includes operating the at least one transporter for lifting persons from an egress level to at least one floor of the building.

Preferably, the evacuation method also includes selectably lowering the at least one transporter to an egress level in the absence of electrical power.

In accordance with another preferred embodiment of the present invention, the evacuation method also includes pressurizing and filtering air of the platform to inhibit the ingress of smoke and noxious gases to the platform.

There is still further provided in accordance with another preferred embodiment of the present invention, an evacuation method for emergency evacuation of persons from a building including providing at least one generally vertical transporter including a platform arranged for selectable communication with at least one floor of the building having at least one building setback, providing at least one building mounted stabilizing element for stabilizing the transporter against lateral forces, the at least one building mounted stabilizing element including at least one non-vertical portion arranged at the building setback, and operating the at least one transporter to lower persons along the at least one building mounted stabilizing element, including the at least one non-vertical portion arranged at the at least one building setback, to a level at which egress of persons may safely occur.

There is also provided in accordance with a further preferred embodiment of the present invention, an evacuation method for emergency evacuation of persons from a building including providing at least one generally vertical transporter, including at least one platform including a bottom support surface, a peripheral enclosure and an enclosure pressurizer and associated air filter, arranged for selectable communication with at least one floor of the building, operating the enclosure pressurizer to reduce the ingress of smoke and noxious gases into the at least one platform and operating the at least one transporter to lower persons to a level at which egress of persons may safely occur.

Preferably, the providing at least one transporter includes providing a plurality of transporters, and the method also includes individually controlling individual ones of the plurality of transporters to simultaneously position multiple one of the platforms of different transporters to be in communication with different groups of multiple floors of the building for simultaneous evacuation loading. Additionally or alternatively, the evacuation method also includes simultaneously positioning the multiple platforms in communication with multiple egress locations for simultaneous evacuation.

Preferably, the evacuation method also includes operating the at least one transporter to lift persons from an egress level to the multiple floors of the building.

Preferably, the evacuation method also includes selectably lowering the at least one transporter to an egress level in the absence of electrical power.

BRIEF DESCRIPTION OF THE DRAWINGS

The present invention will be understood and appreciated more fully from the following detailed description, taken in conjunction with the drawings in which:

FIGS. 2A, 2B, 2C, 2D, 2E, 2F, 2G, 2H, 2I, 2J, 2K, 2L, 2M, 2N, 2O, 2P, 2Q, 2R and 2S illustrate sequential stages in the operation of an escape transporter in the system of FIG. 1 and some variations thereof;

FIGS. 6A, 6B, 6C, 6D, 6E, 6F, 6G, 6H, 6I, 6J, 6K, 6L, 6M, 6N, 6O and 6P illustrate sequential stages in the operation of an escape transporter in the system of FIG. 5 and some variations thereof;

FIGS. 8A, 8B, 8C, 8D, 8E, 8F, 8G, 8H, 8I, 8J, 8K, 8L, 8M, 8N, 8O, 8P, and 8Q illustrate sequential stages in the operation of an escape transporter in the system of FIG. 7 and some variations thereof;

FIGS. 10A, 10B, 10C, 10D, 10E, 10F, 10G, 10H, 10I, 10J, and 10K illustrate sequential stages in the operation of an escape transporter in the system of FIG. 9 and some variations thereof.

DETAILED DESCRIPTION OF PREFERRED EMBODIMENTS

Figure 1:
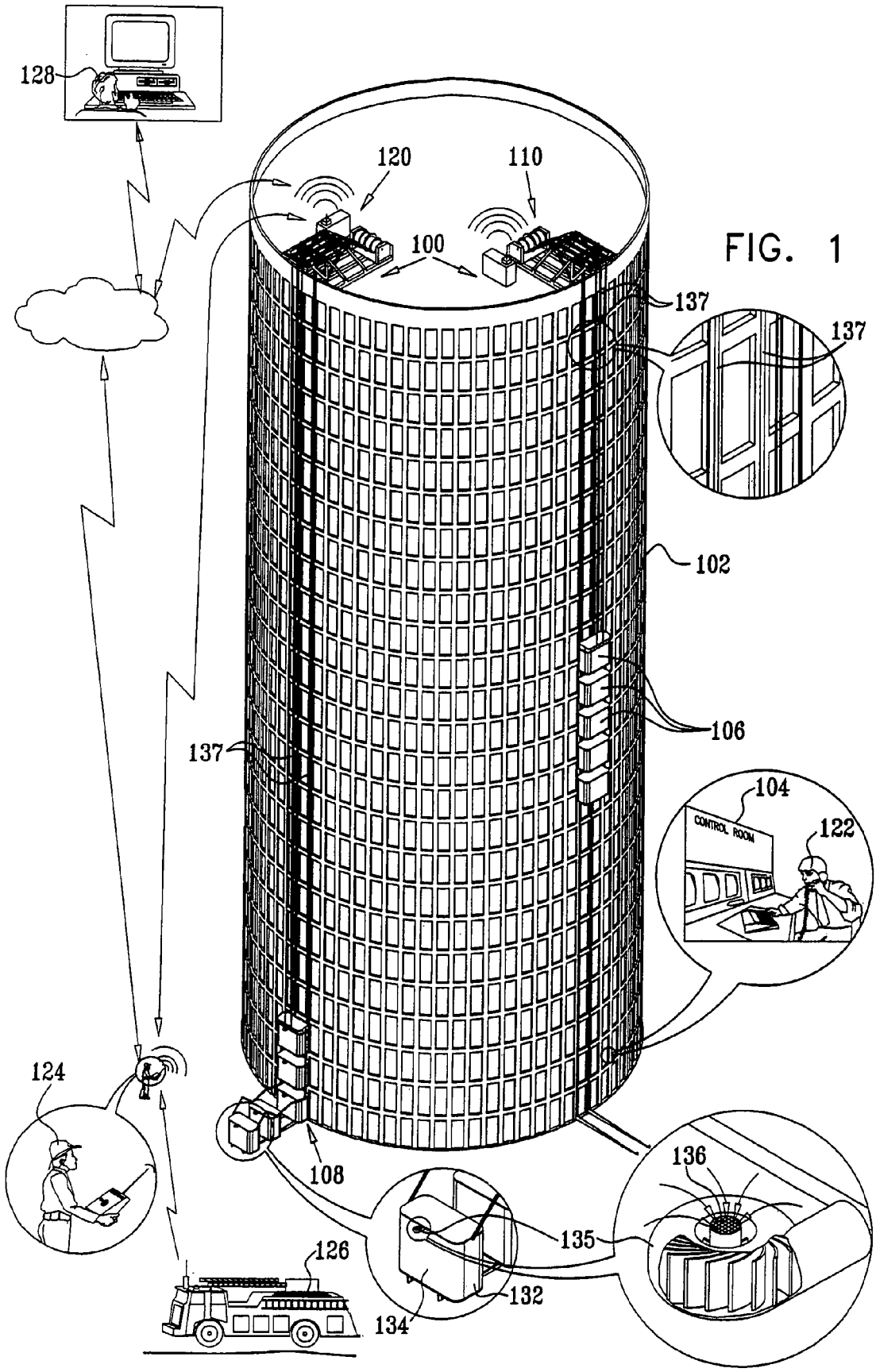
FIG. 1 is a simplified pictorial illustration of a building equipped with an escape system constructed and operative in accordance with a preferred embodiment of the present invention.

Reference is now made to FIG. 1, which is a simplified pictorial illustration of a building equipped with an escape system constructed and operative in accordance with a preferred embodiment of the present invention. As seen in FIG. 1, there is provided an evacuation system for a building preferably comprising a plurality of selectably lowerable, multiple-platform, generally vertical transporters 100, each arranged for selectable communication with multiple floors of a building 102. Control outputs preferably provided by a central controller 104 or alternatively by multiple controllers, each assignable to a given transporter 100, selectably lower multiple platforms 106 of the transporters 100 from multiple floors to at least one egress level 108 at which egress of persons may safely occur.

It is appreciated that a given building, such as building 102, may include one or more transporters 100. In the illustrated embodiment of FIG. 1, multiple transporters 100 are shown in various operative orientations. For example, a transporter designated by reference numeral 110 is shown in a deployment orientation and a transporter 120 is shown in a pre-evacuation egress orientation.

Human control inputs to controller 104 or directly to transporters 100 may be provided, for example, by one or more of an operator 122 at the controller 104, an operator 124 on the ground, an operator in a fire engine 126 and a remote operator 128, communicating via a data network, such as the Internet or an emergency network.

As seen in FIG. 1, each of the transporters 100 preferably comprises a plurality of stackable platforms 106, arranged to be supported on multiple generally vertical supports, the plurality of platforms 106 being arranged in mutually spaced relationship, as illustrated in FIG. 1 for transporter 110, each in communication with a different floor of building 102 for evacuation loading. The plurality of platforms 106 are preferably arranged in a mutually collapsed relationship when not in use, as clearly seen in FIG. 2A.

Figure 2A:
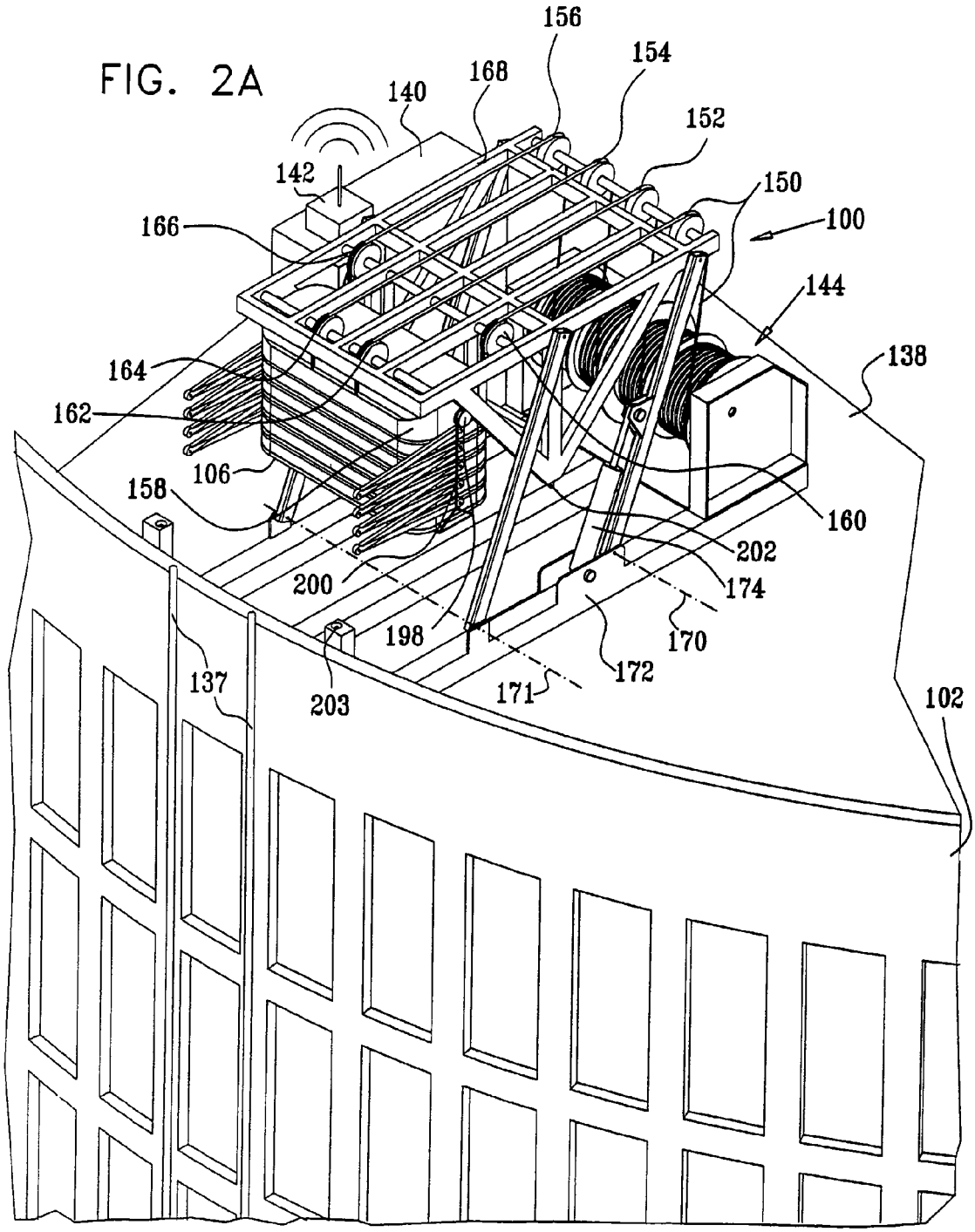
Figure 2B:
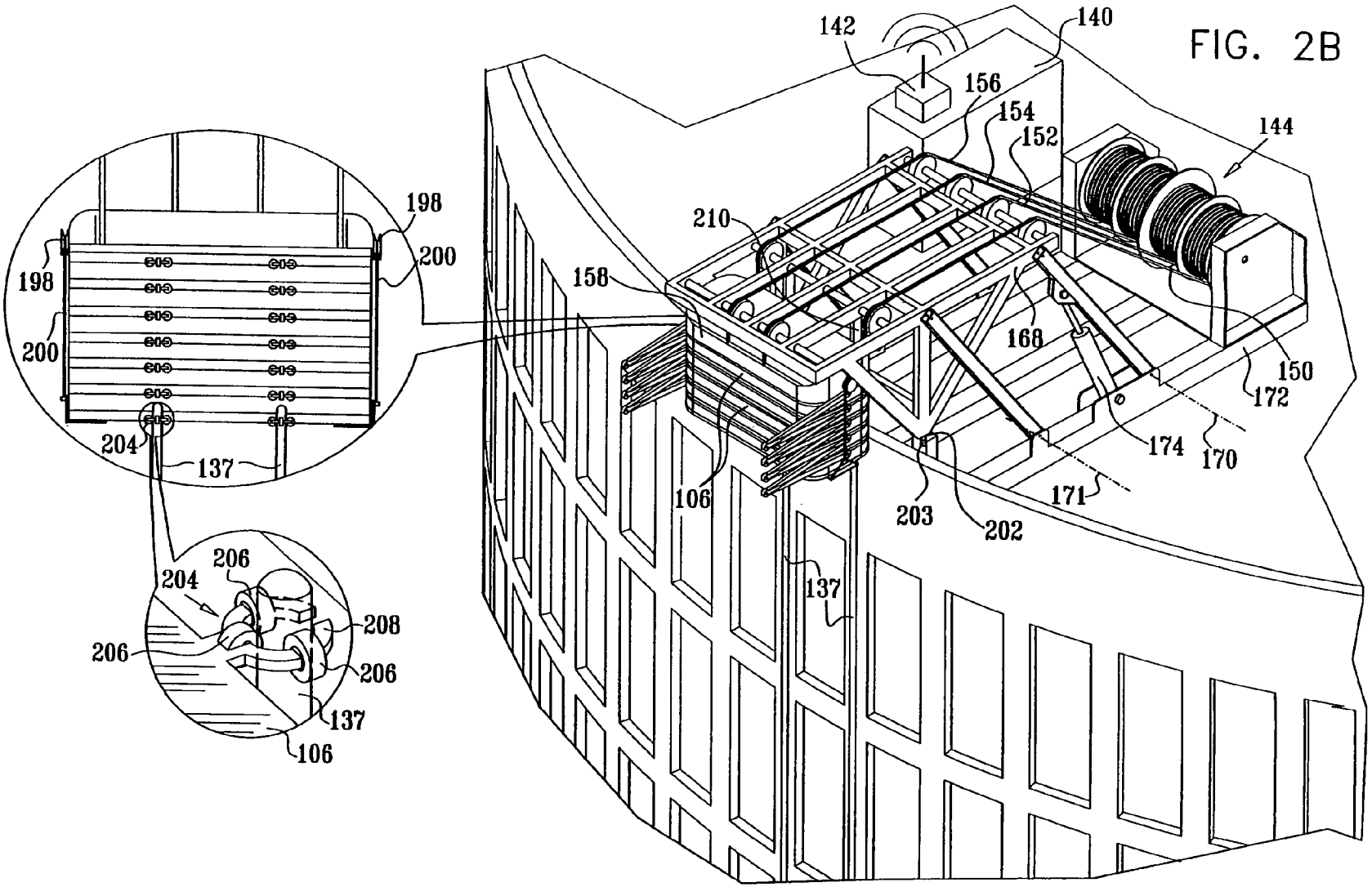
Figure 2C:
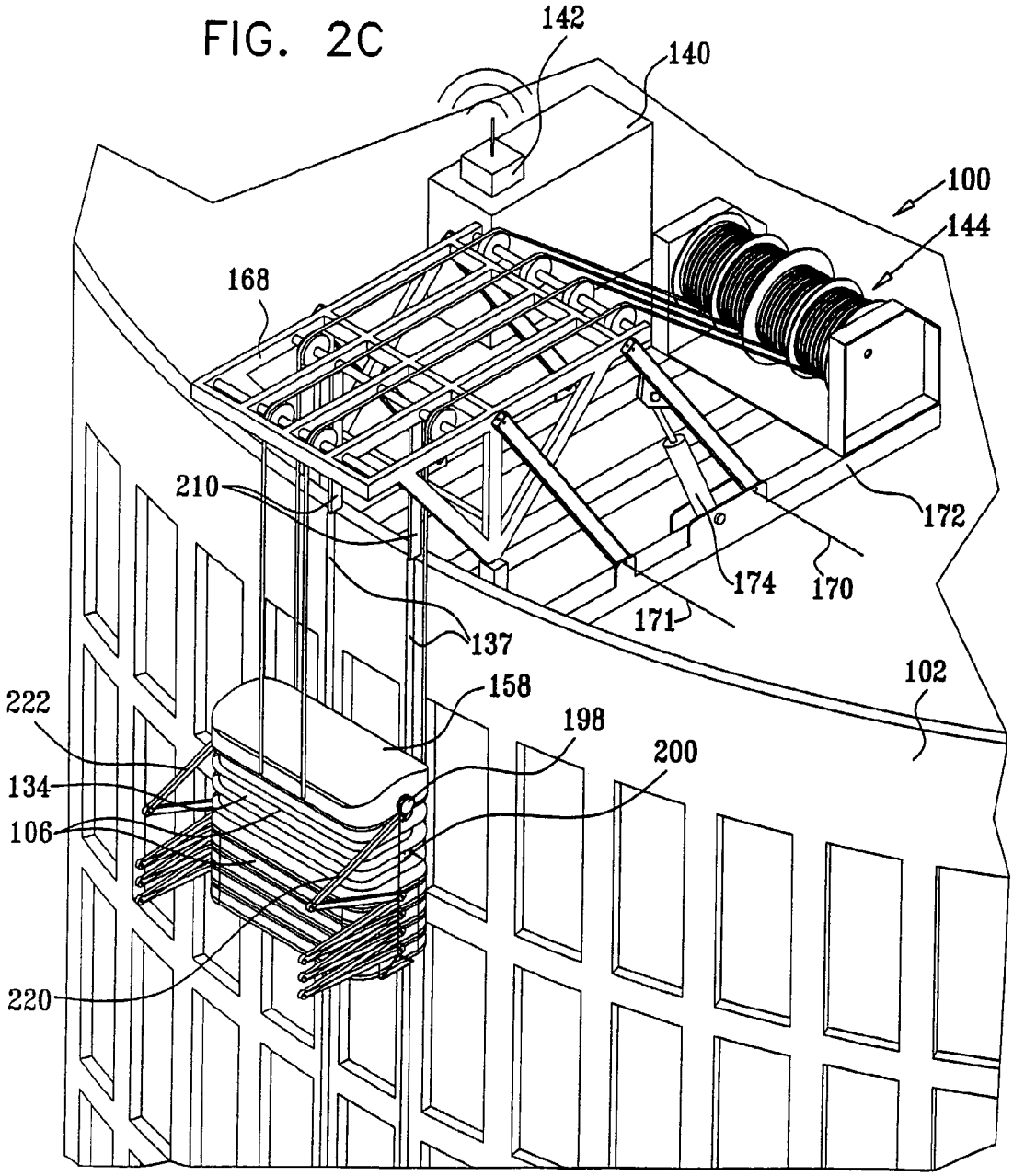
Figure 2D:
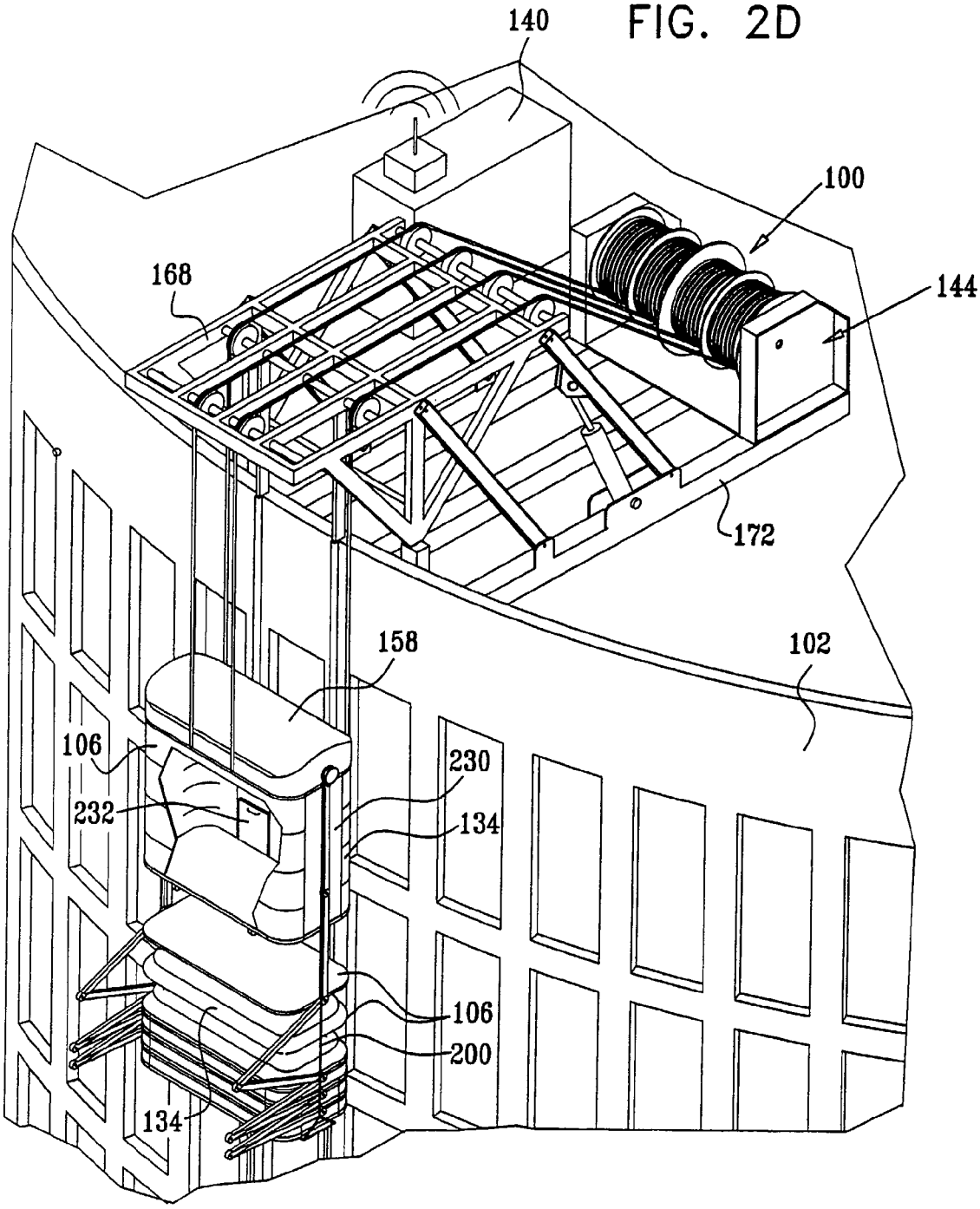
Figure 2E:
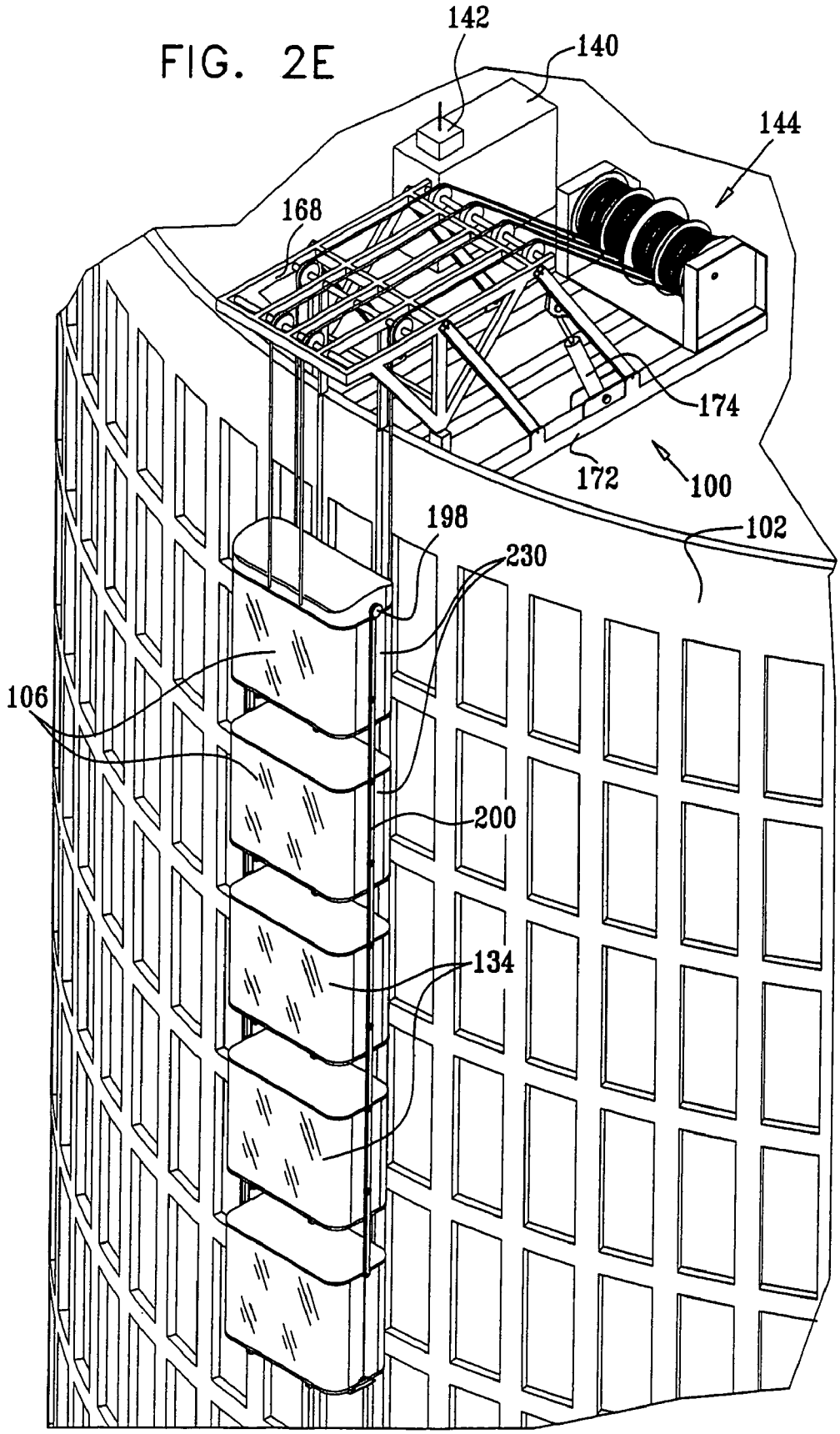
Figure 2F:
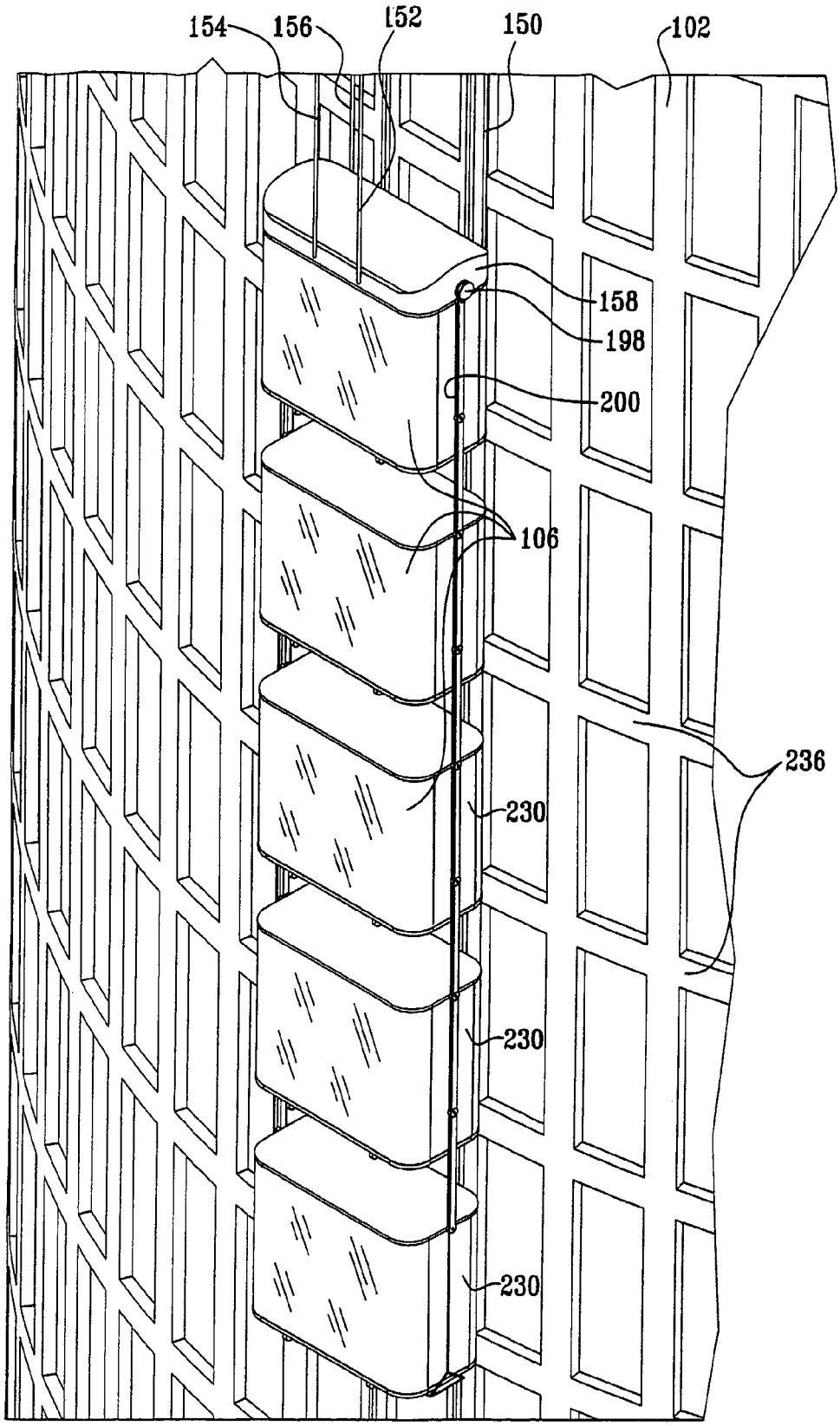
Figure 2G:
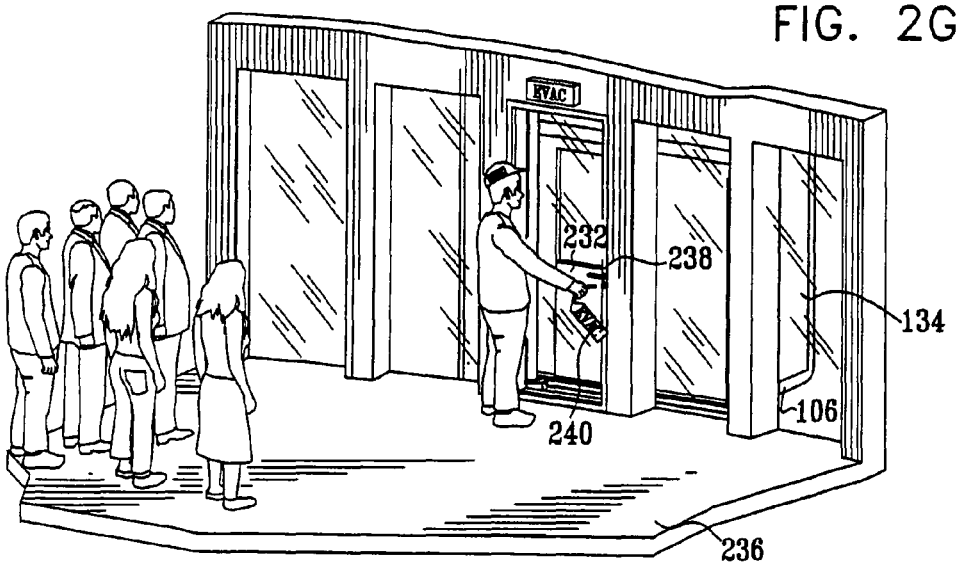
Figure 2H:
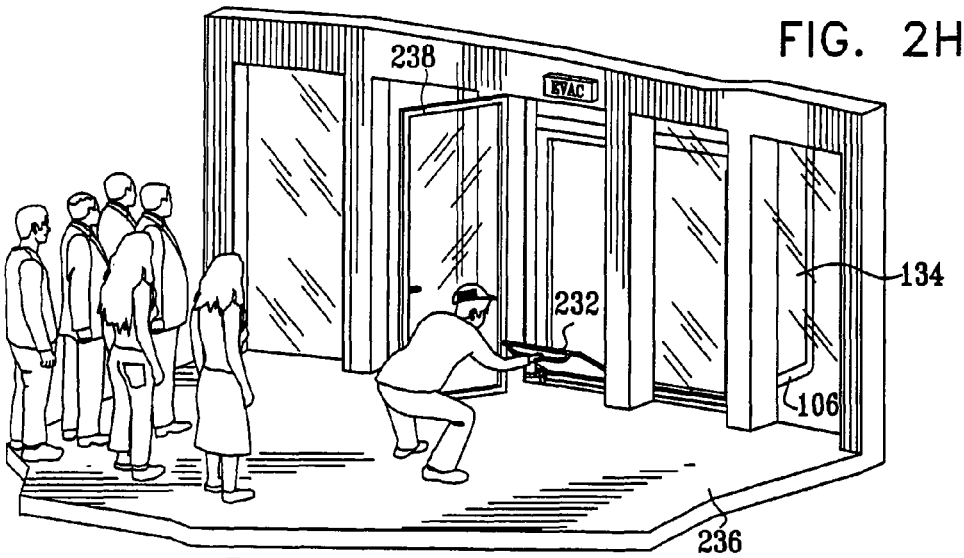
Figure 2I:
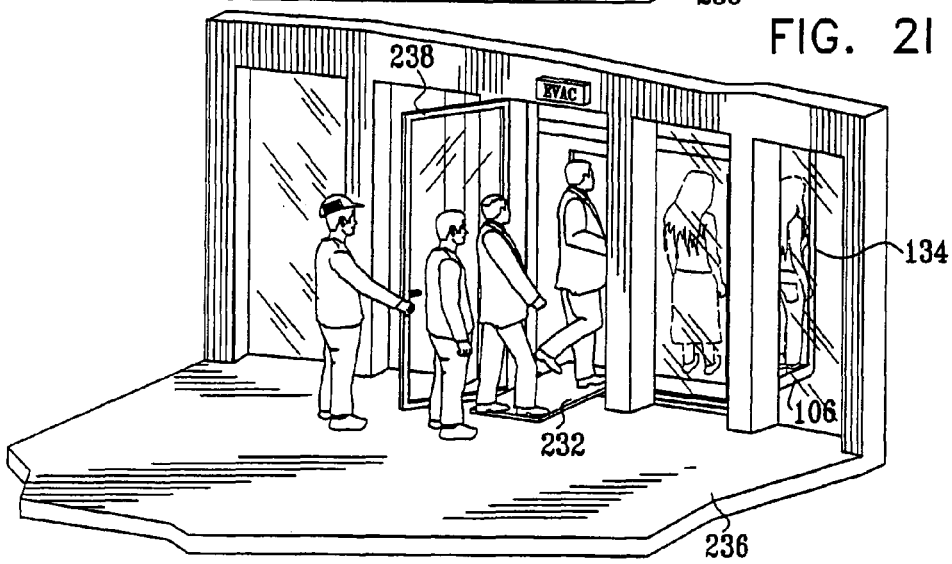
Figure 2J:
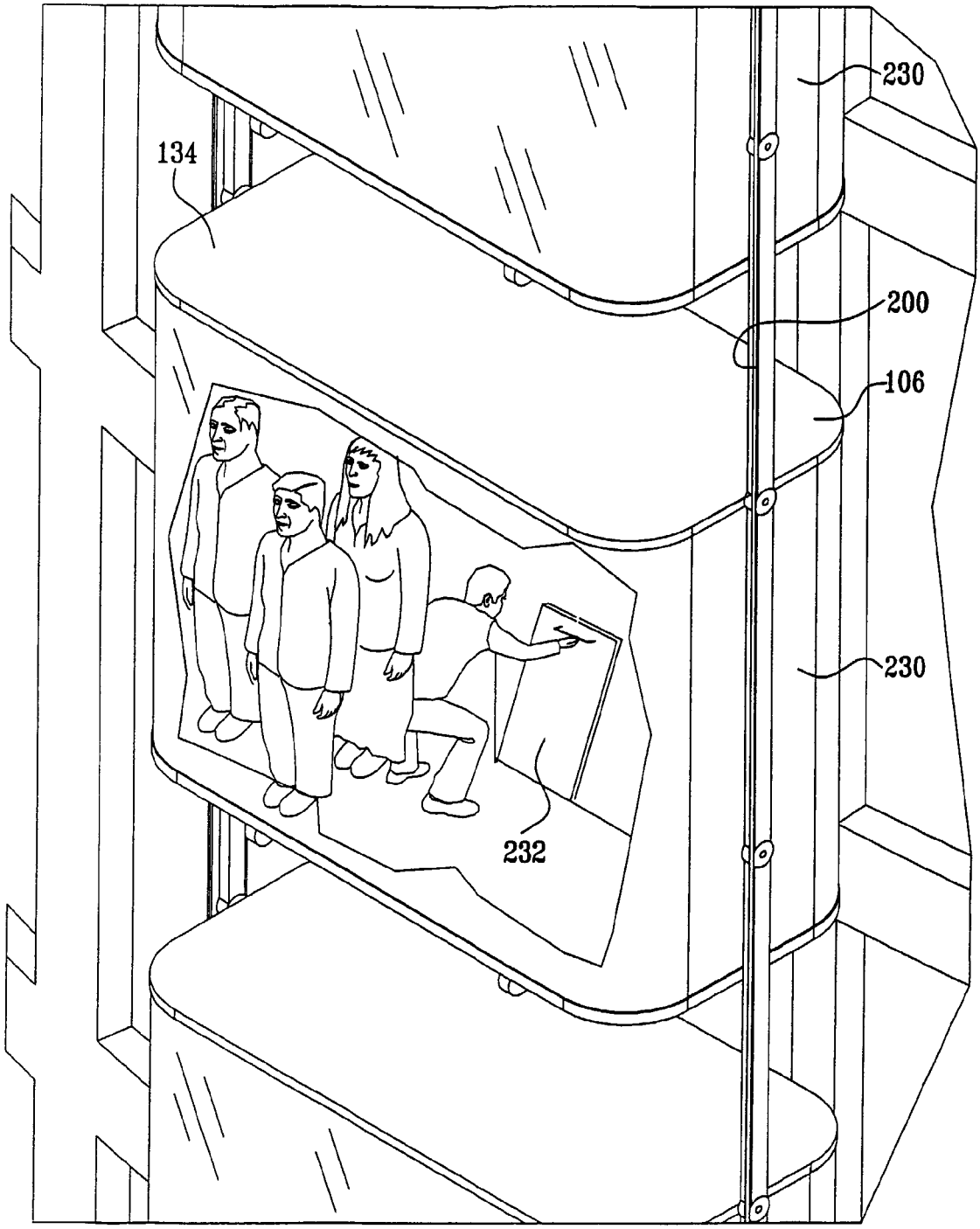
Figure 2K:
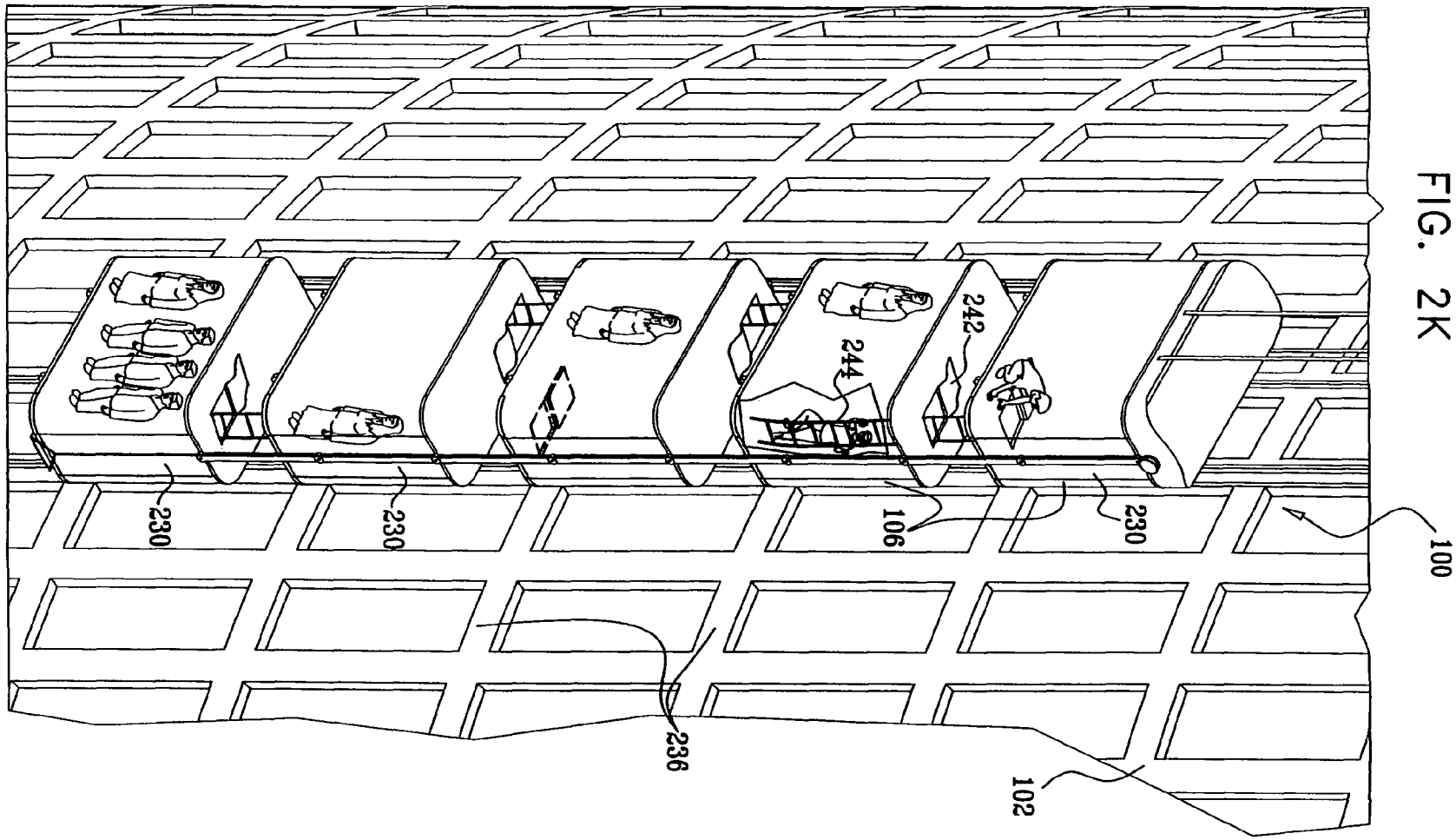
Figure 2L:
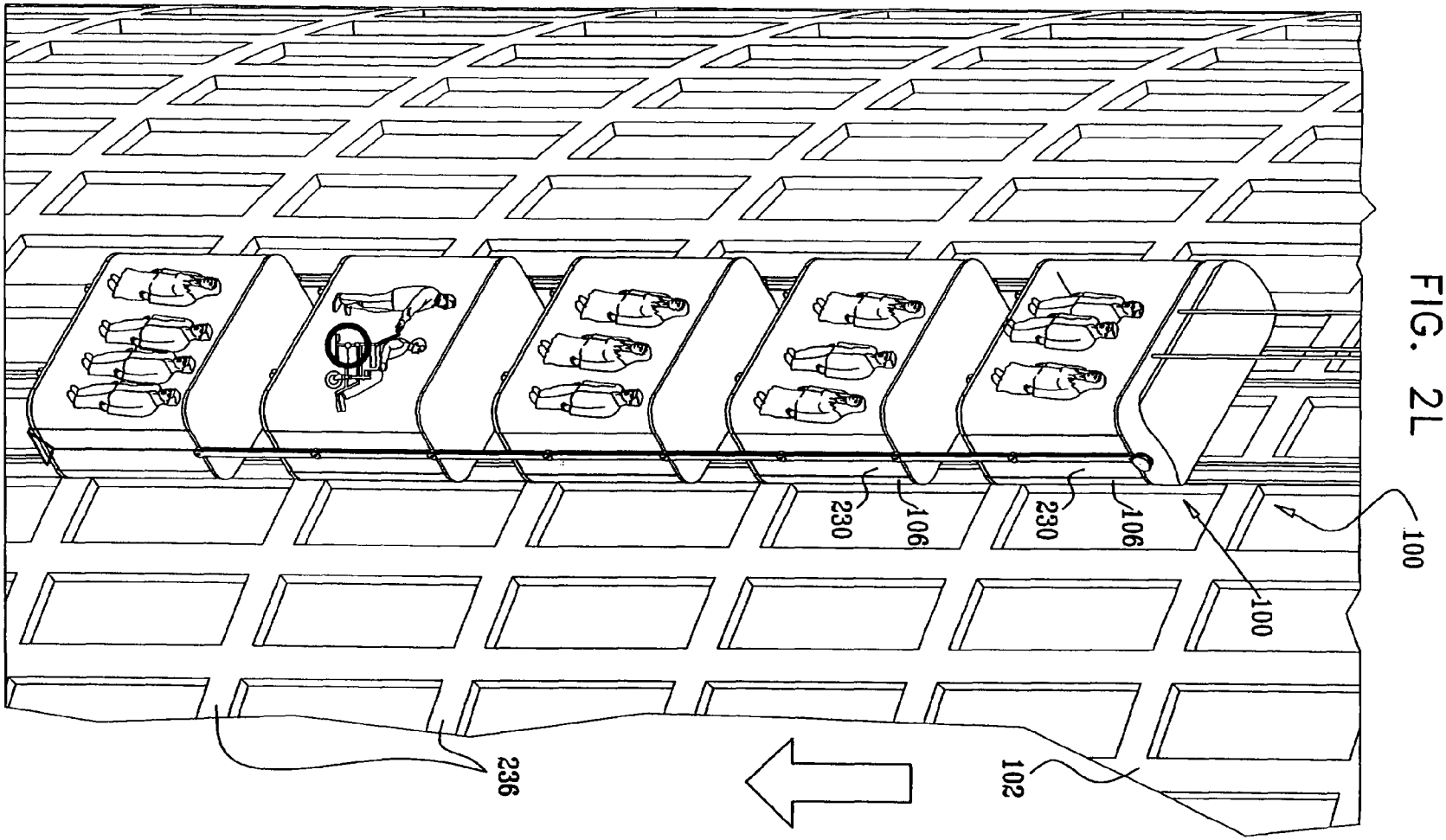
Figure 2M:
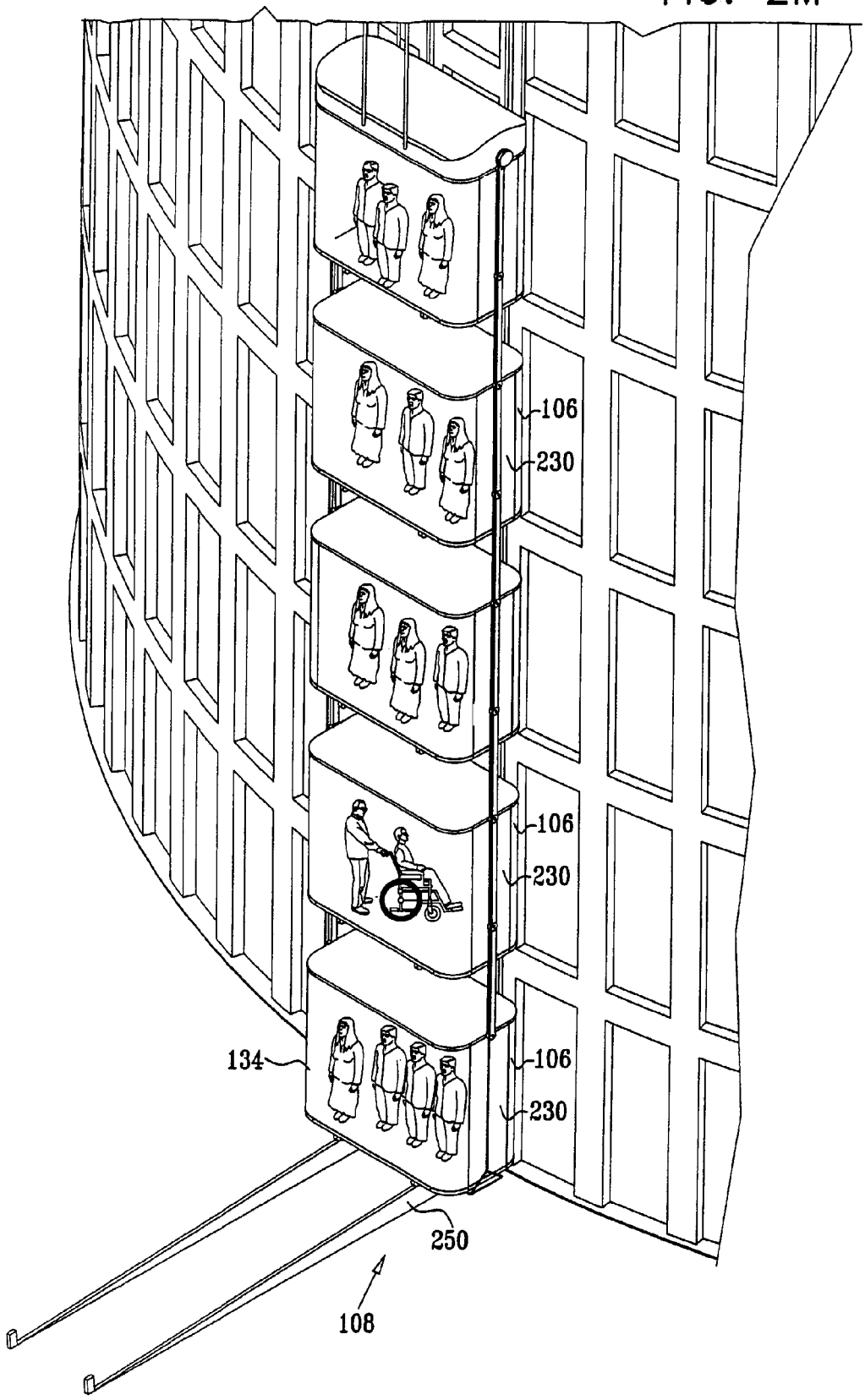
Figure 2N:
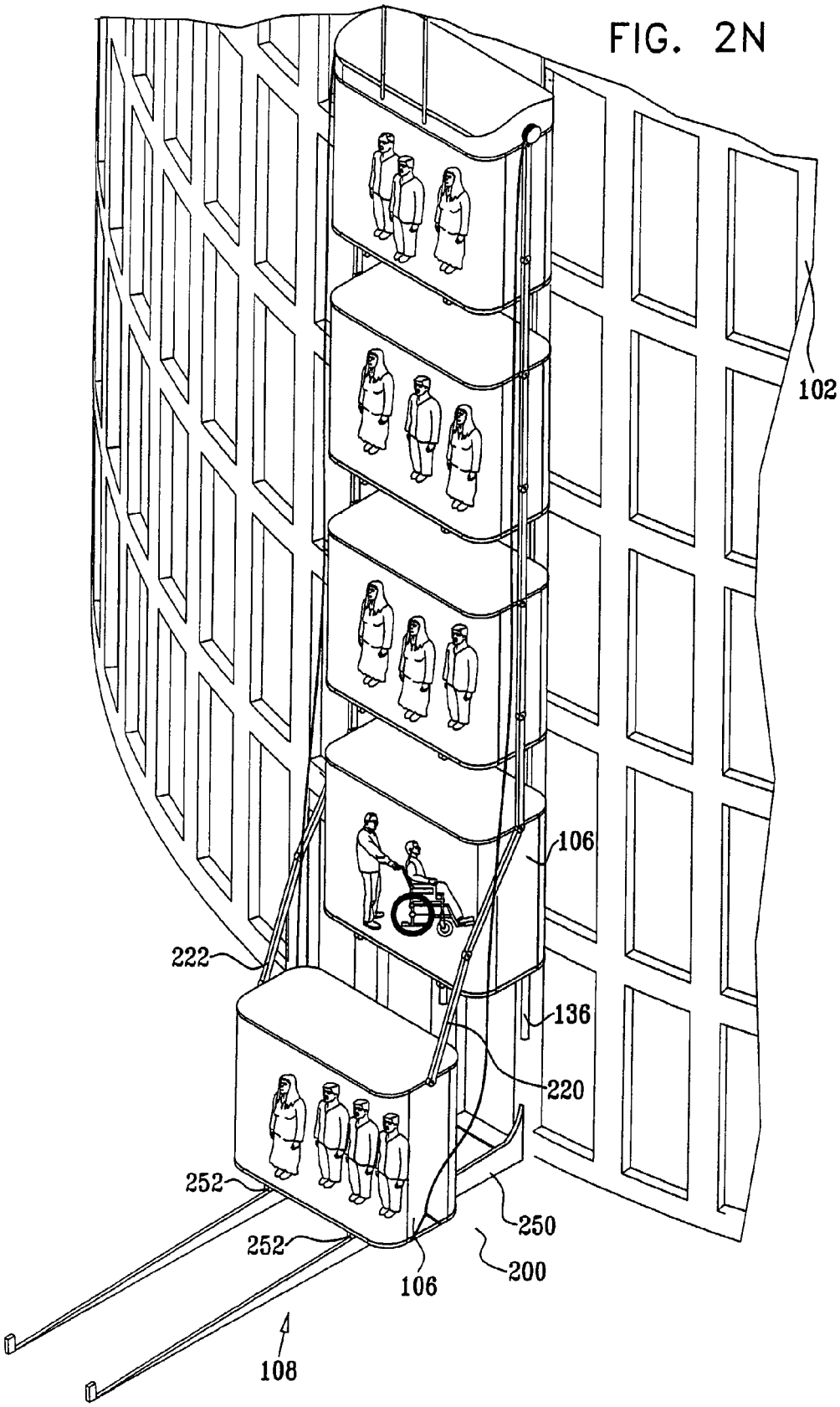
Figure 20:
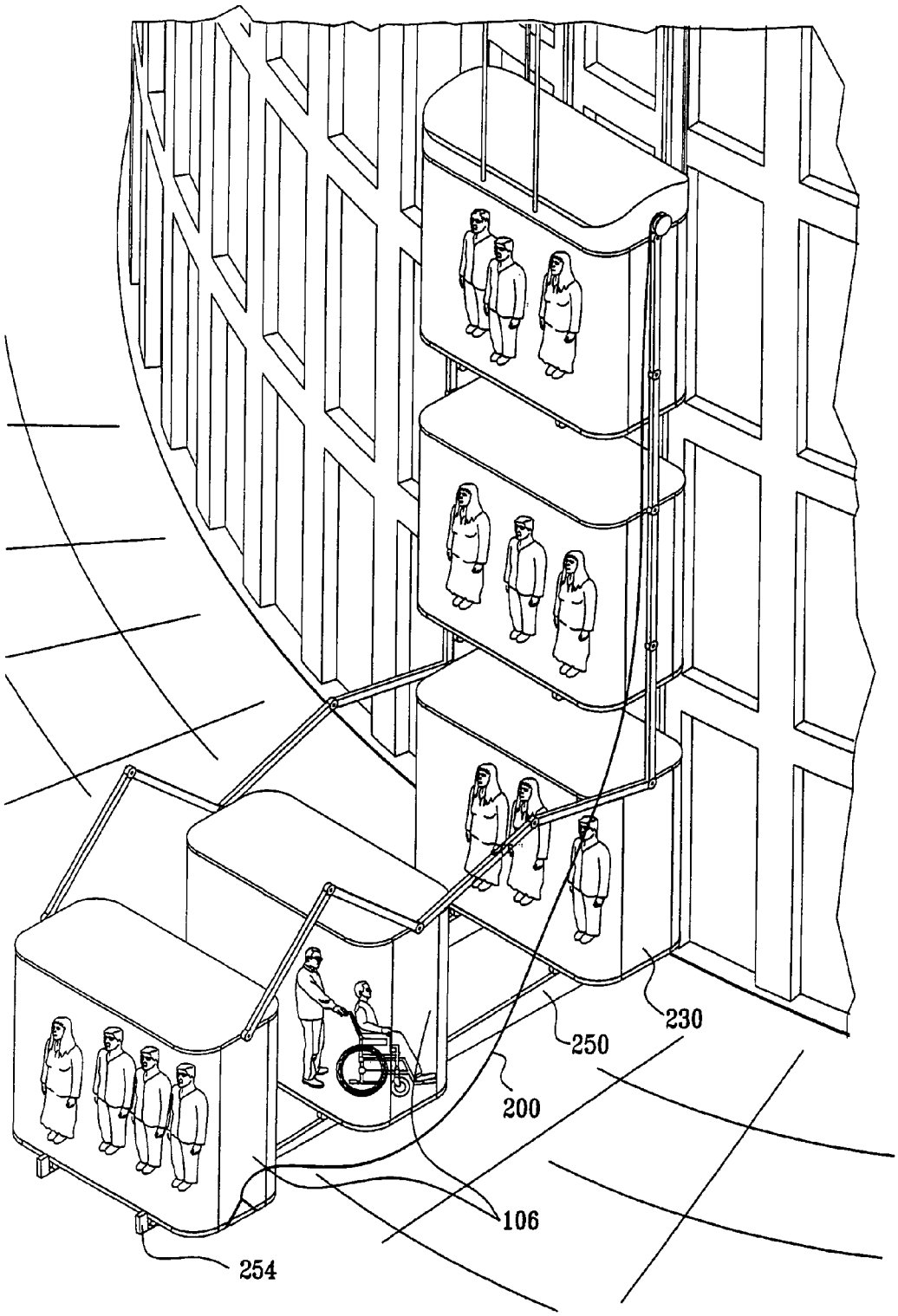
Figure 2P:
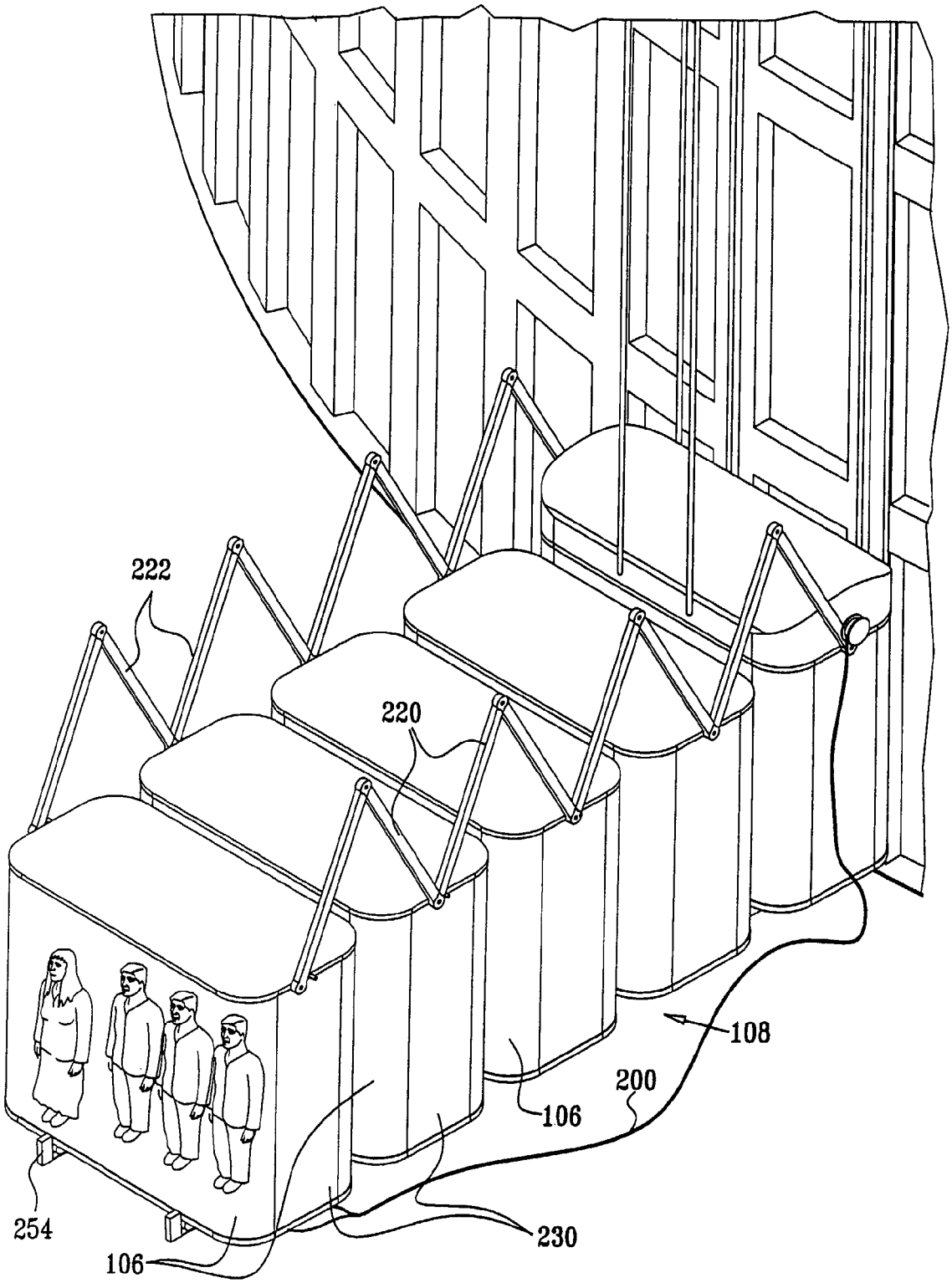

Following egress of evacuated persons from platforms 106, the platforms 106 are arranged in a side by side relationship, as shown clearly in FIG. 2P.

In the illustrated embodiment of FIG. 1, each of the plurality of platforms 106 preferably comprises a bottom support surface 132 and a peripheral enclosing element 134, such as a wall element formed of fabric or rigid sheets or a combination thereof, preferably a heat resistant, fire resistant and/or smoke impermeable material. Preferably, the interior of peripheral enclosing element 134 is pressurized so as to reduce, insofar as possible, the ingress of smoke and noxious gases thereto. Pressurization is preferably provided by an electrically operated fan, such as a centrifugal blower, 135, which is preferably associated with an air filter 136, such as an activated carbon filter.

Enclosing element 134 may constitute a protective railing or restraining band rather than a complete wall. Enclosing element 134 is preferably designed to provide low aerodynamic drag to reduce wind forces on the platform 106. Preferably at least one building mounted stabilizing element cooperates with each transporter for stabilizing the transporter against lateral forces, such as wind forces. In the illustrated embodiment, vertical guides 137, such as rails or cables, are provided at suitable locations along building 102.

In the embodiment of FIG. 1, where a plurality of transporters 100 are provided, the controller 104 is preferably operative to individually control individual transporters 100 such that multiple platforms 106 of different transporters may be simultaneously positioned in communication with different groups of multiple floors of the building for simultaneous evacuation loading. The multiple floors may or may not be contiguous.

The transporters may also be employed for lifting persons, such as firefighters or other rescue personnel, and/or equipment, from the egress level or other building levels to multiple levels of the building.

Reference is now made to FIGS. 2A, 2B, 2C, 2D, 2E, 2F, 2G, 2H, 2I, 2J, 2K, 2L, 2M, 2N, 2O, 2P, 2Q, 2R and 2S, which illustrate typical operation of the evacuation system of FIG. 1. Turning to FIG. 2A, it is seen that a typical transporter 100 includes a fixed installation, preferably mounted onto the roof 138 of building 102. The fixed installation preferably includes a transporter control subsystem 140 having a wired and/or wireless communication interface 142 and being arranged for interactive data communication with controller 104 (FIG. 1) and/or one or more communicators (not shown) employed by one or more operators, such as operators 122, 124 and 128 (FIG. 1).

Transporter control subsystem 140 operates, using mains power, emergency back-up power and/or a generator, a winch/brake assembly 144, which is preferably hydraulic, electric or of any other suitable type, and a stacked platform deployment assembly. Preferably, winch/brake assembly 144 includes a conventional hydraulic fluid pump and reservoir assembly, a conventional hydraulic cooling assembly, a conventional hydraulic gear motor assembly and a conventional hydraulic control valve (not shown), which provide power and braking for conventional hydraulic winches associated therewith as well as an emergency hydraulic braking system. Preferably, winch/brake assembly 144 provides braking while transporters, 100 are descending and provides lifting power when transporters 100 are ascending.

It is appreciated that in the absence of electrical power, winch/brake assembly 144 is operative to lower platforms 106 of transporter 100 to egress level 108 (FIG. 1) using gravitational force.

Preferably four cables 150, 152, 154 and 156 are wound on winch/brake assembly 144 and extend to four mutually spaced locations on a transporter top frame 158. Each of cables 150, 152, 154 and 156 preferably engages a pair of pulleys, here respectively designated by reference numerals 160, 162, 164 and 166, supported onto a pivotably mounted deployment frame 168. Deployment frame 168 is pivotably mounted for rotation about axes 170 and 171 defined by a static support frame 172. Selectable pivotal orientation of deployment frame 168 preferably is provided by a pair of hydraulic pistons 174.

Turning to the platform deployment assembly, mounted onto transporter top frame 158 is a stacked platform selectable release assembly (not shown), which preferably comprises a wireless control communicator (which is similar to wireless control communicator 192 of PCT application PCT/IL2003/00080986 incorporated herein by reference) which, inter alia, governs the operation of a stacked platform selectable release motor/brake assembly (similar to motor/brake assembly 194 PCT application PCT/IL2003/00080986) which operates a rotatable shaft (similar to rotatable shaft 196 of PCT application PCT/IL2003/00080986), onto ends of which are mounted pulleys 198. Preferably cables 200 are wound onto pulleys 198. These cables are coupled to the lowest platform 106 such that deployment of platforms 106 is governed by the motor/brake assembly.

FIG. 2A shows a plurality of stacked platforms 106 held tightly below transporter top frame 158 by cables 200. Each of the stacked platforms 106 preferably includes a pair of building mounted guide riding roller assemblies (not shown in FIG. 2A), which are adapted for vertically slidable operative engagement with building mounted vertical rails or guides, such as vertical guides 137. As will be described hereinbelow in greater detail, each of the stacked platforms 106 includes a selectably positionable evacuation bridge (not shown in FIG. 2A).

Reference is now made to FIG. 2B, which illustrates the mechanism of FIG. 2A following lateral and downwardly vertical displacement of transporter top frame 158 and stacked platforms 106 provided by rotation of deployment frame 168 about axes 170 and 171 produced by maximum retraction of pistons 174 to an orientation, shown in FIG. 2B, wherein locating pins 202 on deployment frame 168 are seated in sockets 203 on static frame 172.

FIG. 2B additionally illustrates initial engagement of building mounted guide riding roller assemblies 204 with vertical guides 137, resulting inter alia from lowering of platforms 106 together with transporter top frame 158 produced by playing out of cables 150, 152, 154 and 156 by winch/brake assembly 144. It is seen that assemblies 204 preferably include at least three rollers 206 mounted on a generally peripheral support 208. Preferably directing rods 210 mounted on deployment frame 168 direct platforms 106 to ensure correct engagement between assemblies 204 and vertical guides 137.

Reference is now made to FIG. 2C, which illustrates the mechanism of FIG. 2B following lowering of platforms 106 relative to transporter top frame 158 produced by unwinding of cables 200 from pulleys 198. It is seen that peripheral enclosing element 134 is beginning to be unfolded in an accordion-like manner.

It is also seen that foldable support elements 220 and 222 interconnect the transporter top frame 158 with the platform 106 lying therebelow and similar support elements interconnect the individual stacked platforms 106 with each other and support their weight and the weight of loads applied thereto. When the platforms 106 are in a stacked orientation as shown in FIGS. 2A & 2B, the foldable support elements 220 and 222 are folded, however, when the platforms 106 are fully deployed at their intended spaced mutual orientations, the support elements are unfolded and tensioned and define the spacing between vertically adjacent platforms 106.

Reference is now made to FIG. 2D, which illustrates a topmost platform 106 of a transporter 100 being fully deployed, and its peripheral enclosing element 134 being fully tensioned, with the remaining platforms 106 and peripheral enclosing elements 134 being in a stacked not-yet fully deployed orientation. It is seen that peripheral enclosing element 134 includes an egress opening 230 and has associated therewith a selectably positionable evacuation bridge, preferably in an upright orientation. It is appreciated that the peripheral enclosing element 134 is maintained in its open orientation by structural locking thereof . . . .

FIG. 2E illustrates transporter 100 when all of the platforms 106 have been fully deployed and peripheral enclosing elements 134 of each platform 106 are fully tensioned. Normally deployment of each platform 106 and tensioning of its peripheral enclosing element takes place sequentially from the top to the bottom of the transporter. It is seen that each peripheral enclosing element 134 includes egress opening 230 and has associated therewith a selectably positionable evacuation bridge. It is appreciated that the peripheral enclosing element 134 of each platform 106 is maintained in its open orientation by structural locking thereof.

FIG. 2F shows the fully deployed platforms 100 being lowered, preferably by action of winch/brake assembly 144 (FIG. 2E) into a desired vertical position relative to building 102, such that each of platforms 106 is properly aligned with a separate building floor, here designated by reference numeral 236. It is appreciated that at this stage cable 200 is no longer used.

Reference is now made to FIG. 2G, which illustrates a platform 106 deployed in proper vertical alignment with a building floor 236, such that evacuation bridge 232 is positioned opposite an emergency evacuation door 238. An authorized individual, such as an evacuation team leader, typically employs an evacuation emergency key 240 to open emergency evacuation door 238. FIG. 2H shows the evacuation team leader positioning evacuation bridge 232, while FIG. 2I shows evacuation of persons from building floor 236 onto platform 106 within peripheral enclosing element 134. It is appreciated that evacuation of multiple building floors onto multiple platforms 106 of one or more transporters 100 may take place simultaneously.

Reference is now made to FIG. 2J, which shows the evacuation team leader folding up the evacuation bridge 232. It is appreciated that the evacuation team leader may then secure the evacuation bridge to the peripheral enclosing element 134 to serve as a security gate. FIG. 2K illustrates an optional structure wherein passageways, typically including trap doors 242 and ladders 244, enable people to move between platforms 106 in a transporter 100.

FIG. 2L illustrates lowering of a loaded transporter from its loading position toward an egress location.

Reference is now made to FIG. 2M, which illustrates the lowest platform 106 being lowered to the egress level 108 into engagement with a transversely extending, inclined and thus gravitationally operative displacement track 250. FIG. 2N illustrates the next lowest platform 106 being lowered to the egress level 108 as the lowest platform slides along displacement track 250 out of engagement with and away from vertical guides 137, on rollers 252, as foldable support elements 220 and 222 pivot to accommodate the transverse displacement. It is appreciated that alternatively, displacement track may not be inclined, and motion of the lowest platform 106 along displacement track 250 may then be achieved by mounting a motor on platform 106, by having an operator use a pulley to pull the platform along the track, by force applied by the descent of the above platform 106 and the support elements 220 and 222 thereof, or in any other suitable way.

FIG. 2O shows the sequential lowering and concomitant transverse displacement of the platforms 106, with the lowest platform 106 coming to rest at the end of inclined track 250, at a location defined by stoppers 254. FIG. 2P shows all of the platforms 106 at the egress level 108, preferably prior to egress of persons therefrom. Preferably, all of the platforms reach the egress level 108 within a time duration of less than two minute between the operative orientations shown in FIGS. 2M-2P. It is appreciated that cables 200 may optionally be removed from pulleys 198 by a system operator when all the platforms 106 are at complete rest.

Figure 2Q:
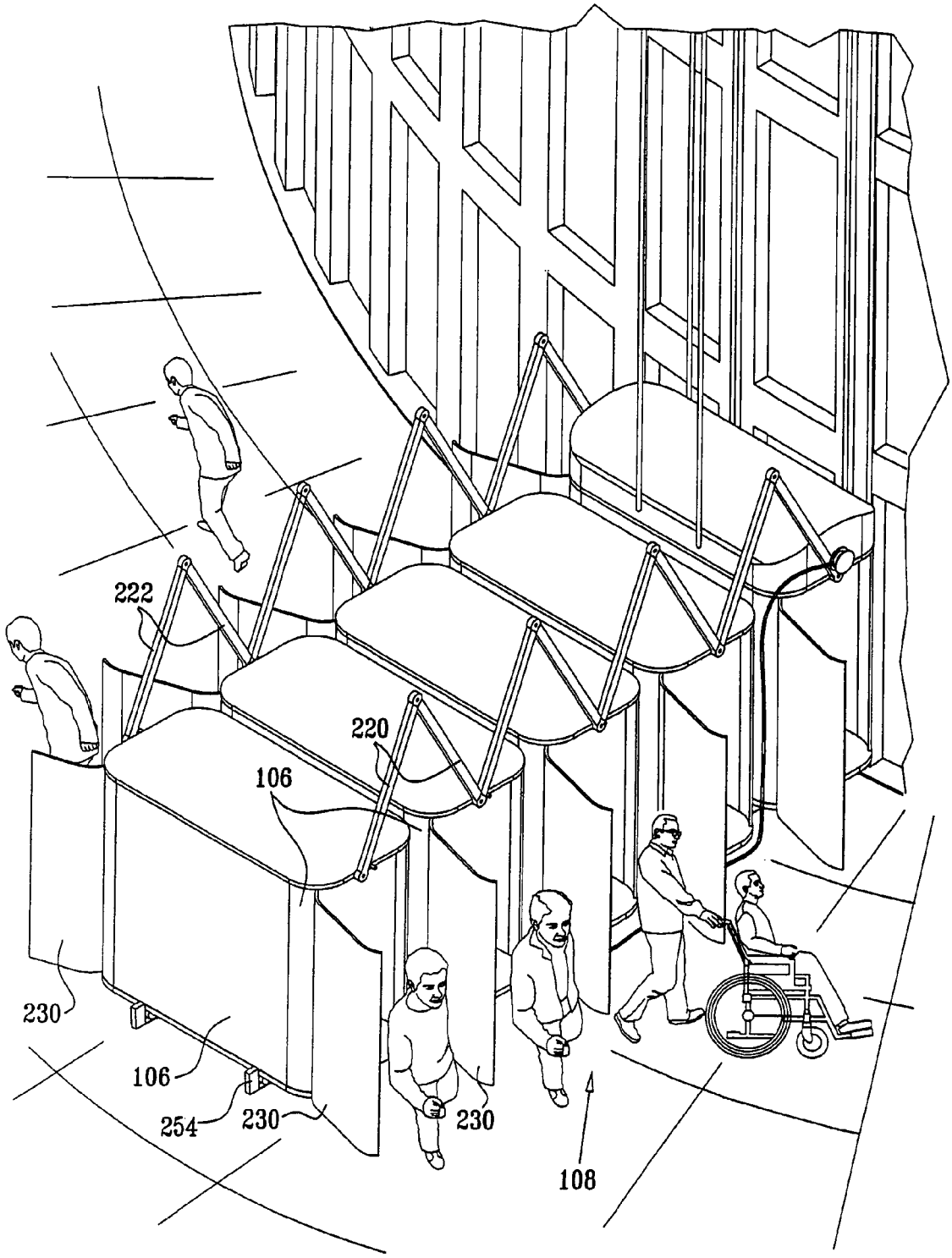

Preferably thereafter egress of persons from all of the platforms 106 via egress openings 230 takes place generally simultaneously, as shown in FIG. 2Q. It is noted that during lowering of the platforms 106, the support elements 220 and 222 effectively block the opening of egress openings 230 and thus prevent inadvertent opening thereof.

Figure 2R:
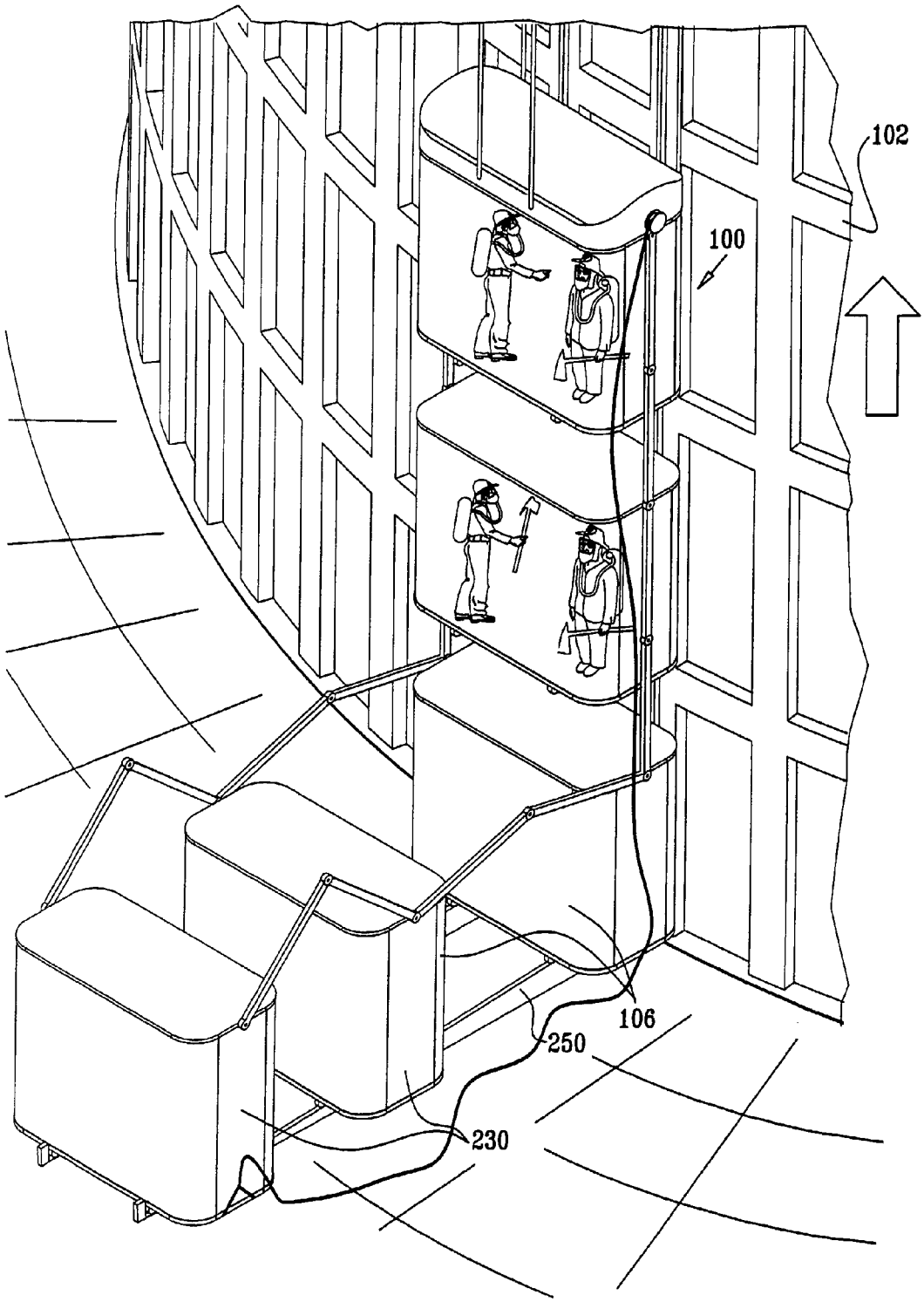
Figure 2S:
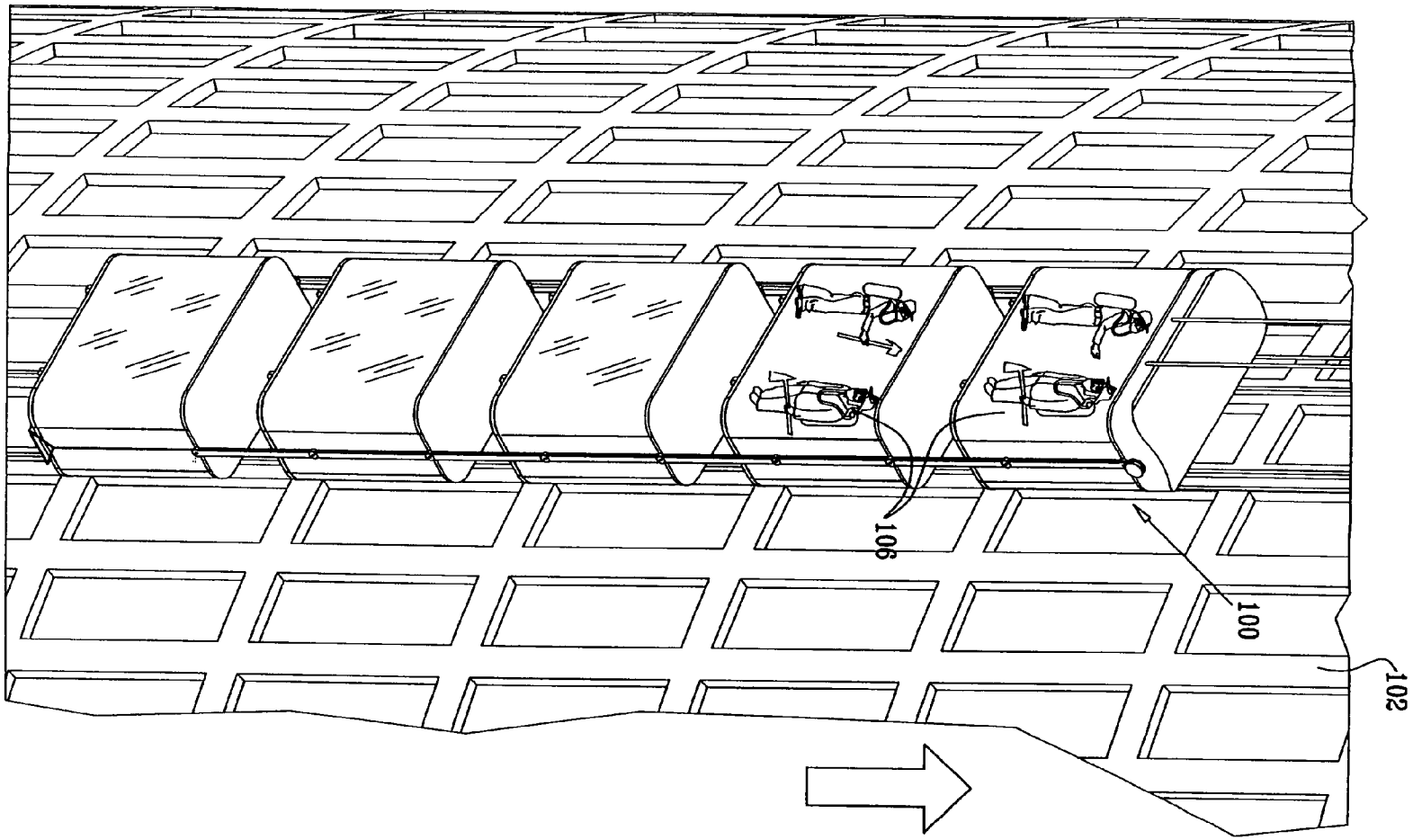

It is appreciated that the transporter 100 may be employed for raising rescue personnel or firefighters to selected floors of building 102, as shown in FIGS. 2R and 2S.

Reference is now made to FIGS. 3A-3E, which illustrate an alternative mode of operation of the structure of FIGS. 1-2S. Here the transporter, designated by reference numeral 300, is operative to initially lower the platforms to an egress level in a folded orientation and thereafter to deploy the platforms, under the control of rescue personnel.

Figure 3A:
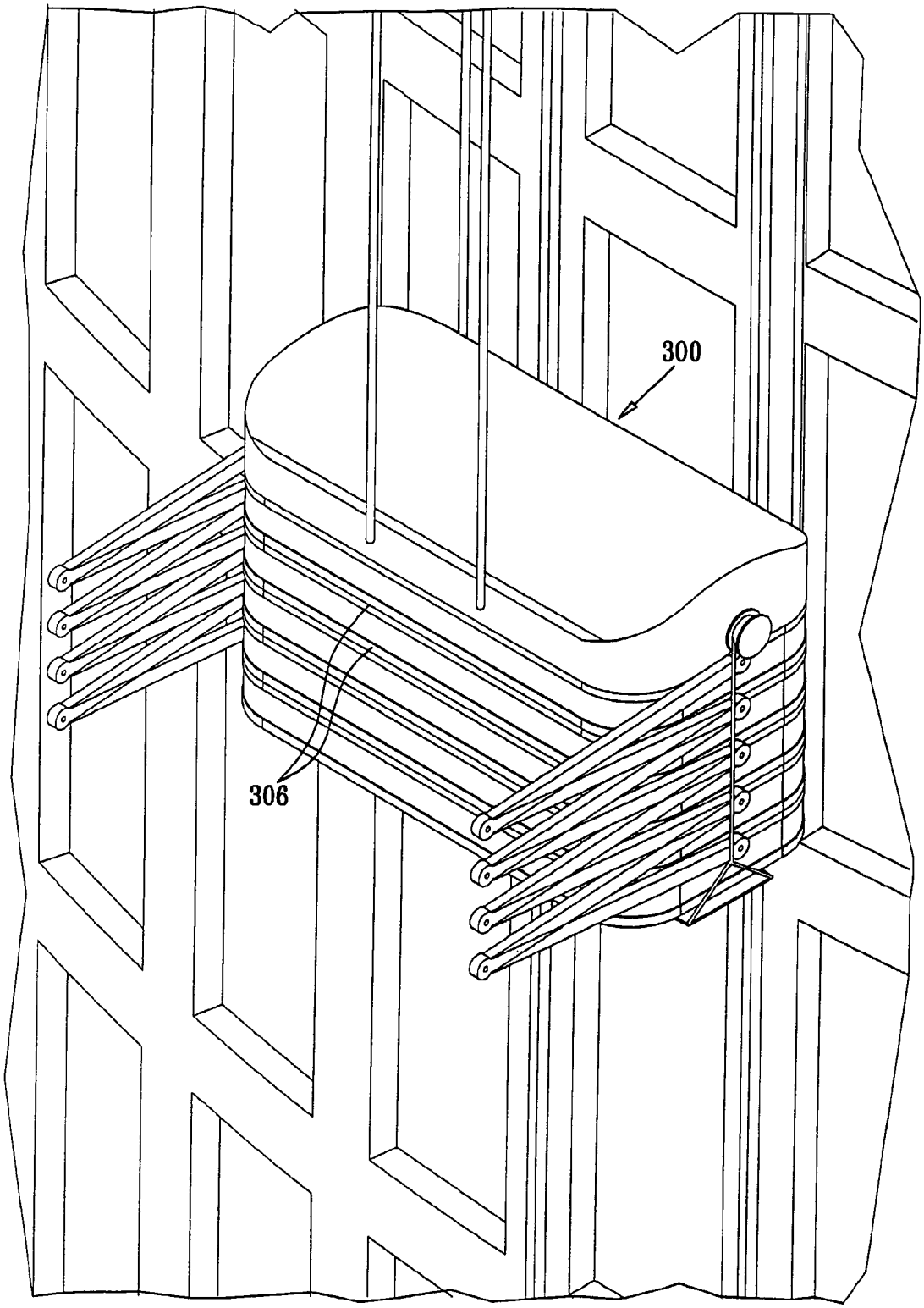
FIGS. 3A, 3B, 3C, 3D and 3E illustrate five stages in the operation of an escape transporter in a variation of the system of FIGS. 1-2S.
Figure 3B:
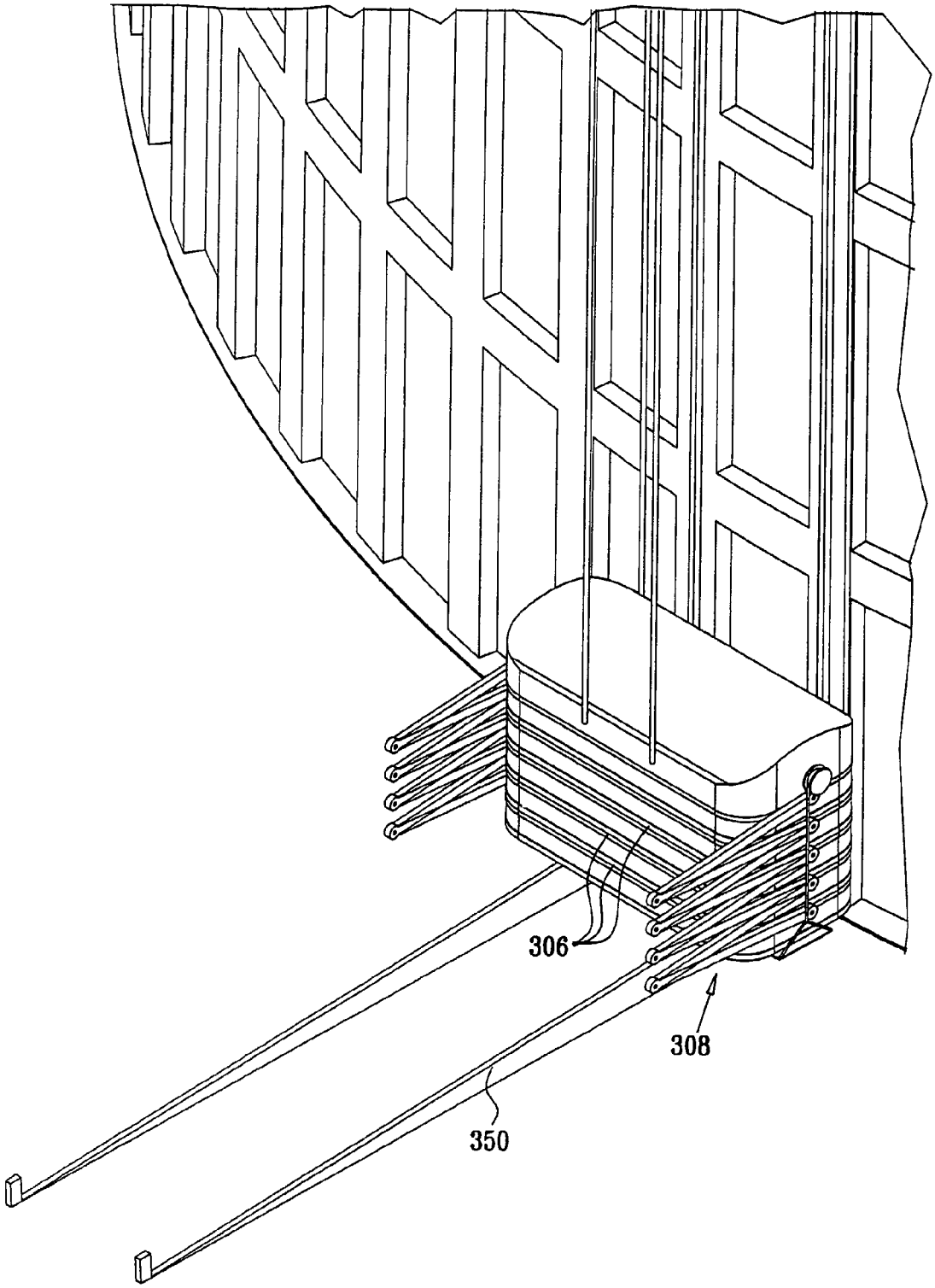

FIG. 3A shows the initial lowering of platforms 306 in a folded orientation from a storage location and orientation similar to that shown in FIG. 2A. FIG. 3B shows the platforms 306 in engagement with an inclined track 350 at an egress level 308. Typically, inadvertent motion of platforms 306 along track 350 is stopped by mechanical stoppers or in any other suitable way.

Figure 3C:
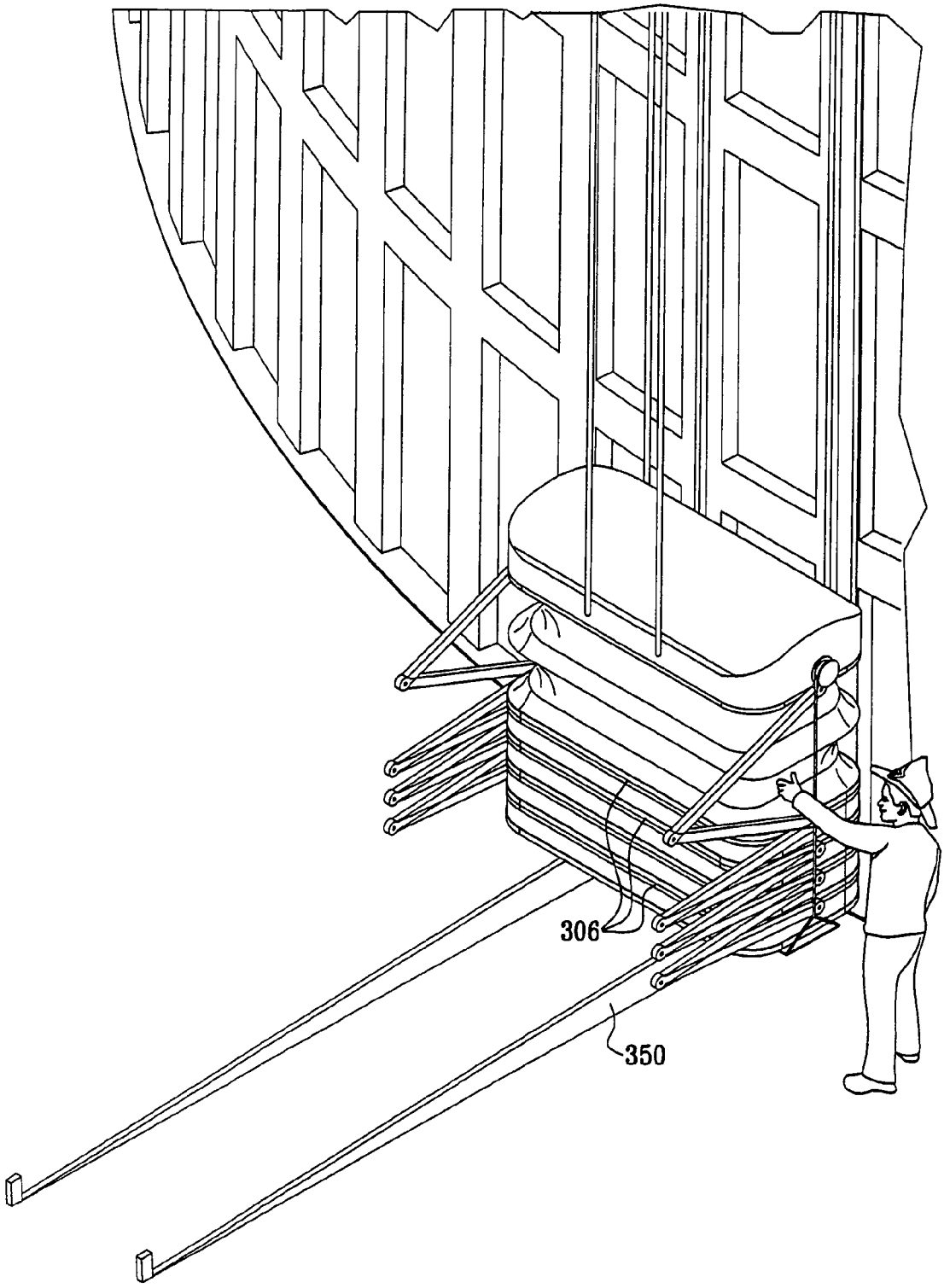
Figure 3D:
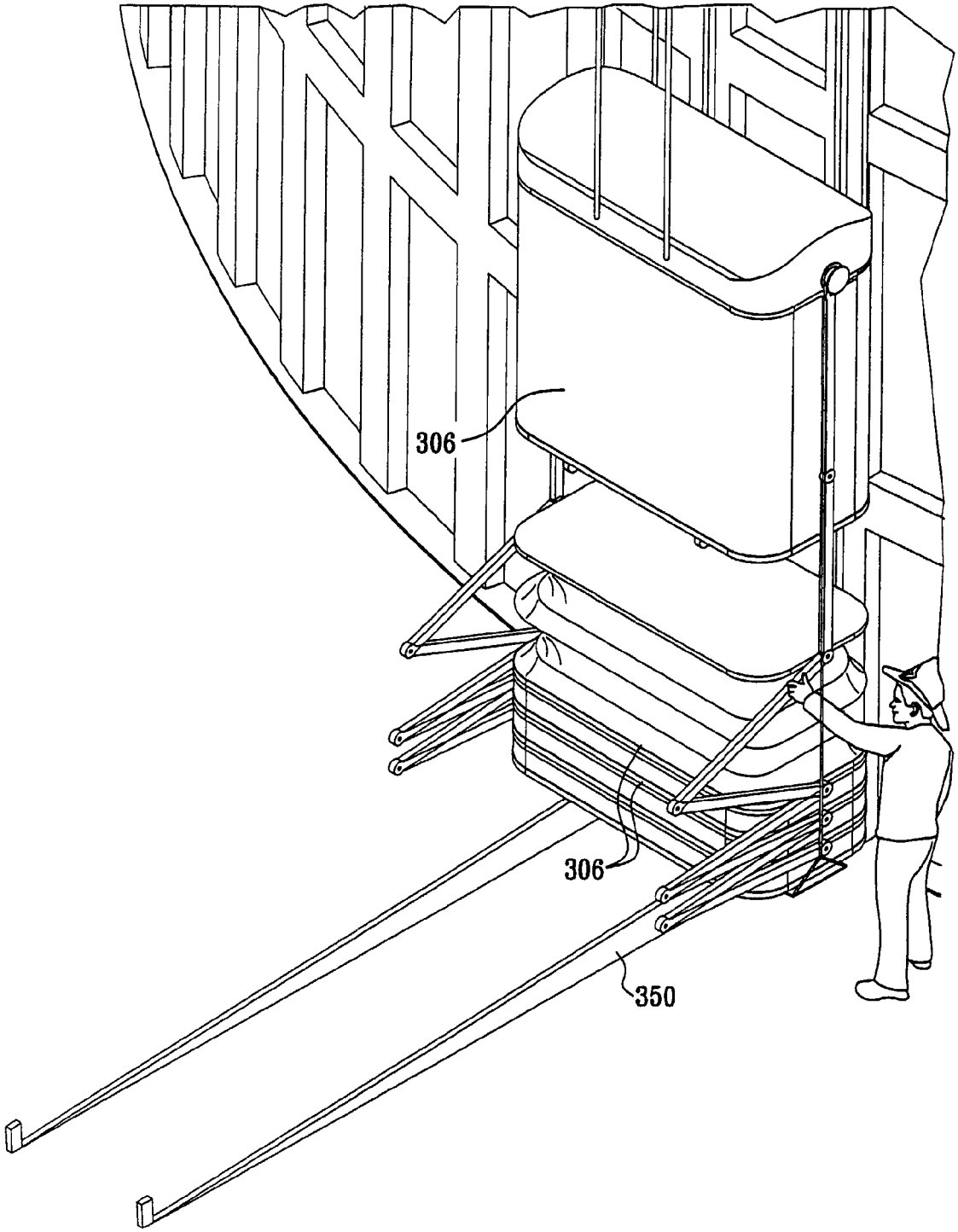

FIG. 3C shows deployment of the platforms 306 under control of rescue personnel by sequentially raising and unfolding the platforms. It is appreciated that at this stage the rescue personnel may remove the cable connecting the platforms 306. FIG. 3D shows a topmost platform 306 in a fully unfolded orientation and a next-to-topmost platform in a partially unfolded orientation. It is appreciated that the peripheral enclosing element 334 is maintained in its open orientation by structural locking thereof.

Figure 3E:
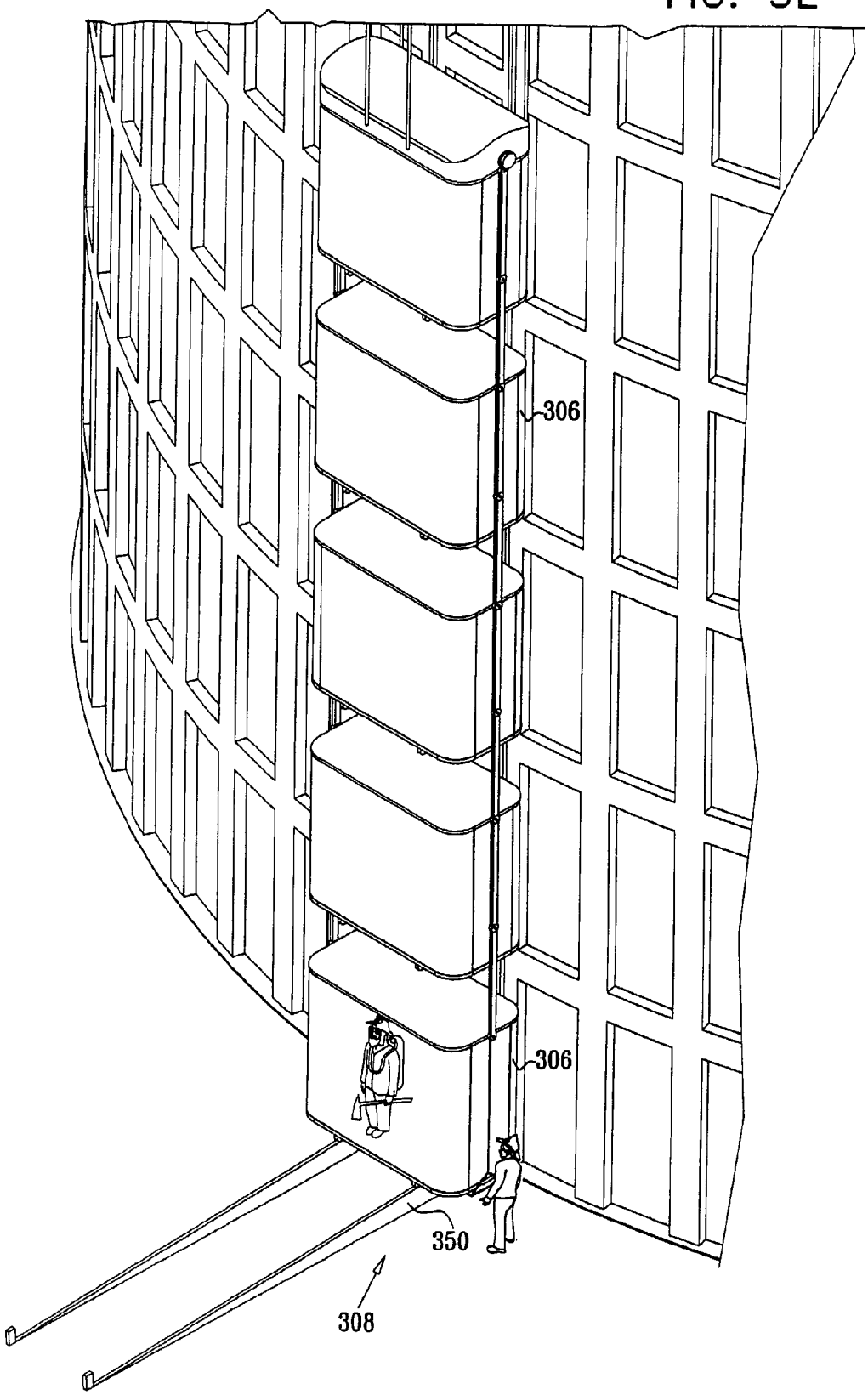

FIG. 3E shows the platforms 306 in a fully deployed orientation. It is appreciated that the peripheral enclosing element 334 of each platform 306 is maintained in its open orientation by structural locking thereof. At this stage, rescue personnel may enter the lowest platform and may climb to higher platforms or alternatively, the platforms 306 may be lowered and transversely displaced along track 350, as shown in FIGS. 2N-2P, to allow rescue personnel to enter the platforms, and the platforms 306 may then be raised, carrying the rescue personnel, as shown in FIGS. 2R and 2S.

Reference is now made to FIGS. 4A-4H, which illustrate a variation of the structure of the system of FIGS. 1-2S. Here a building includes a setback, and a transporter is operative to lower platforms to an egress level.

Figure 4A:
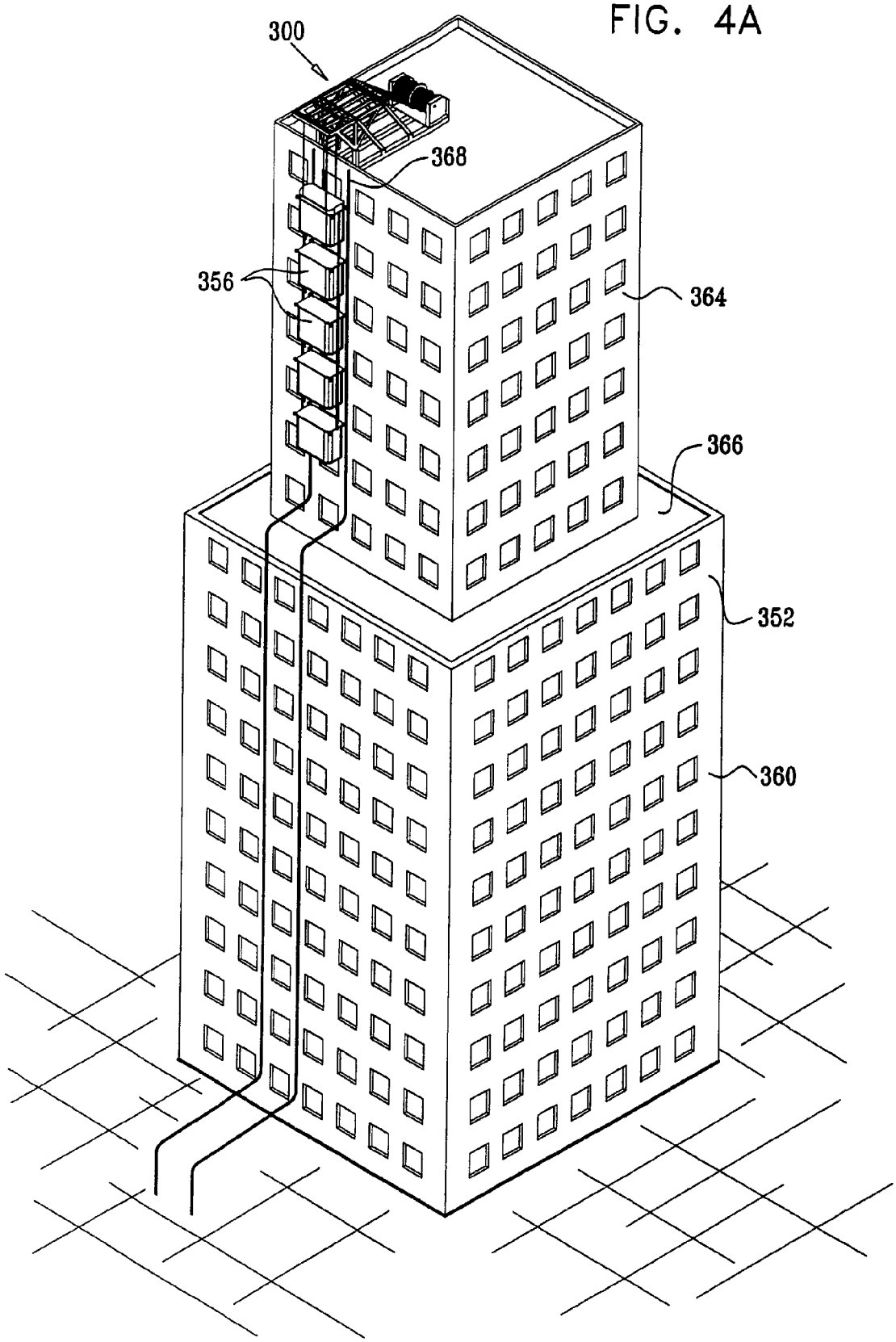
FIGS. 4A, 4B, 4C, 4D, 4E, 4F, 4G and 4H illustrate various stages in the operation of an escape transporter in another variation of the system of FIGS. 1-2S.

FIG. 4A illustrates a building 352, which is equipped with an escape system generally similar to the escape system of FIGS. 1-2S. The building 352 typically includes a lower portion 360 and an upper portion 364 which is set back with respect thereto by a portion 366. It is appreciated that building 352 may include one or more transporters 300.

As seen in FIG. 4A, supporting element structures 368 such as guiding rails or cables, are provided on building 352. Guiding rails 368 are generally vertical along a wall of upper portion 364, and extend outwardly above setback portion 366 thereby bridging the setback. The guiding rails are generally vertical along lower portion 360. Close to the ground, guiding rails 368 once again extend outwardly from building 352, to enable lowering of a plurality of platforms 356 to the egress level.

Figure 4B:
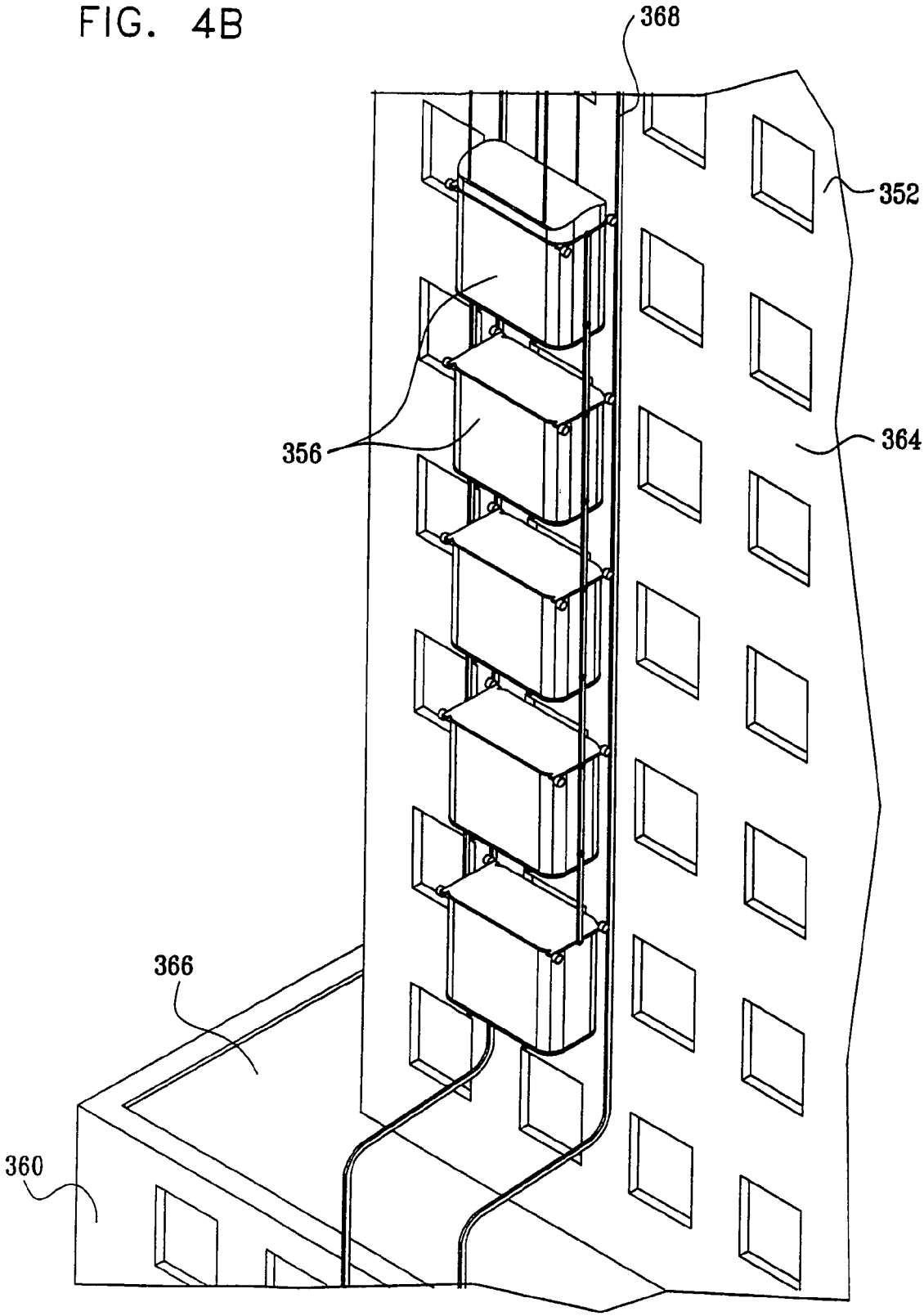
Figure 4C:
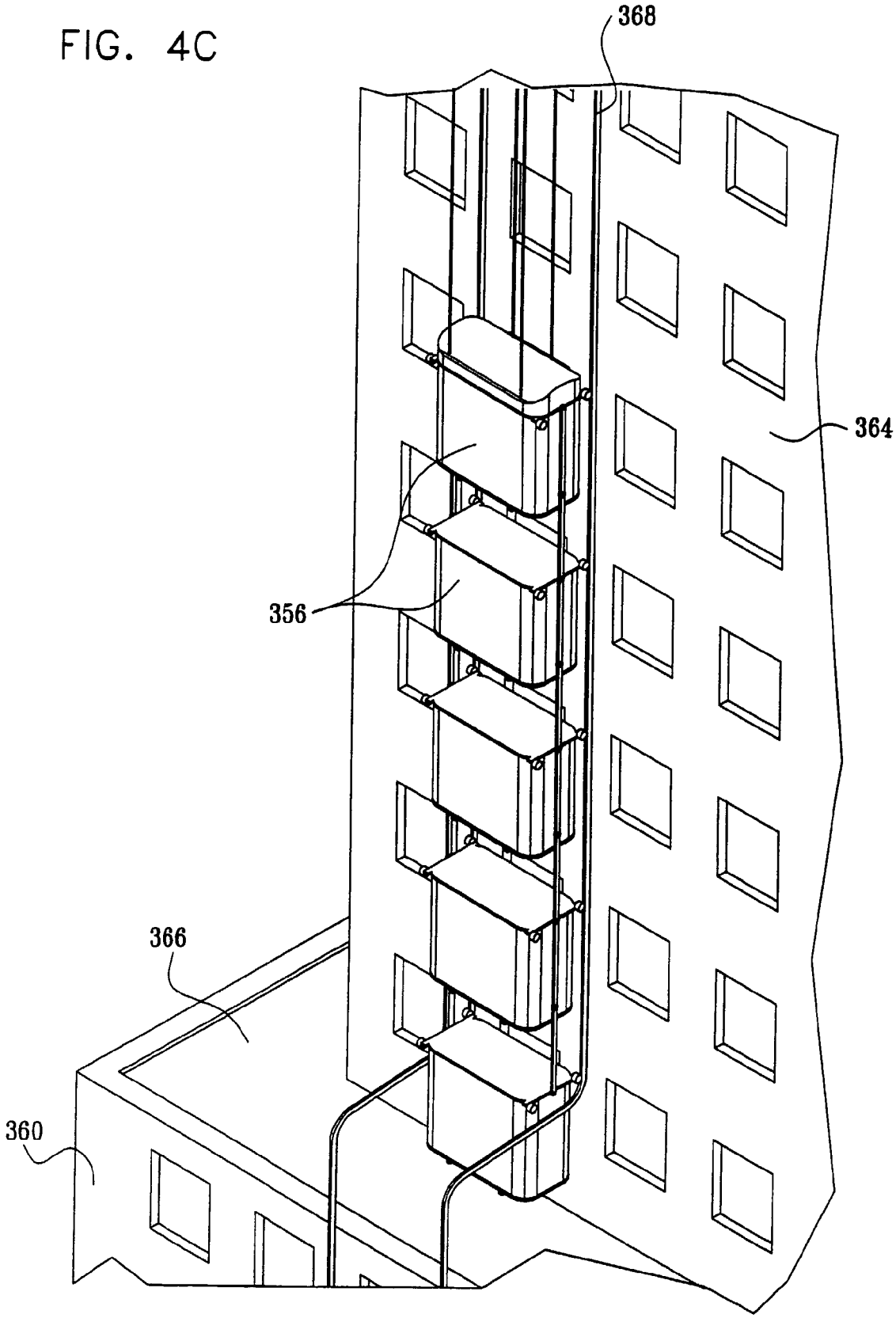

FIG. 4B shows lowering of platforms 356 along upper portion 364 of building 352, using a top generally vertical portion of guiding rails 368 for support. As seen in FIG. 4B, the bottommost platform 356 is lowered to a position in which it is positioned just above setback 362. FIG. 4C shows the lowest-most platform 356 in engagement a horizontal portion of guiding rails 368 which extends outwardly from upper portion 364 of building 352, while still being adjacent upper portion 364 of building 352.

Figure 4D:
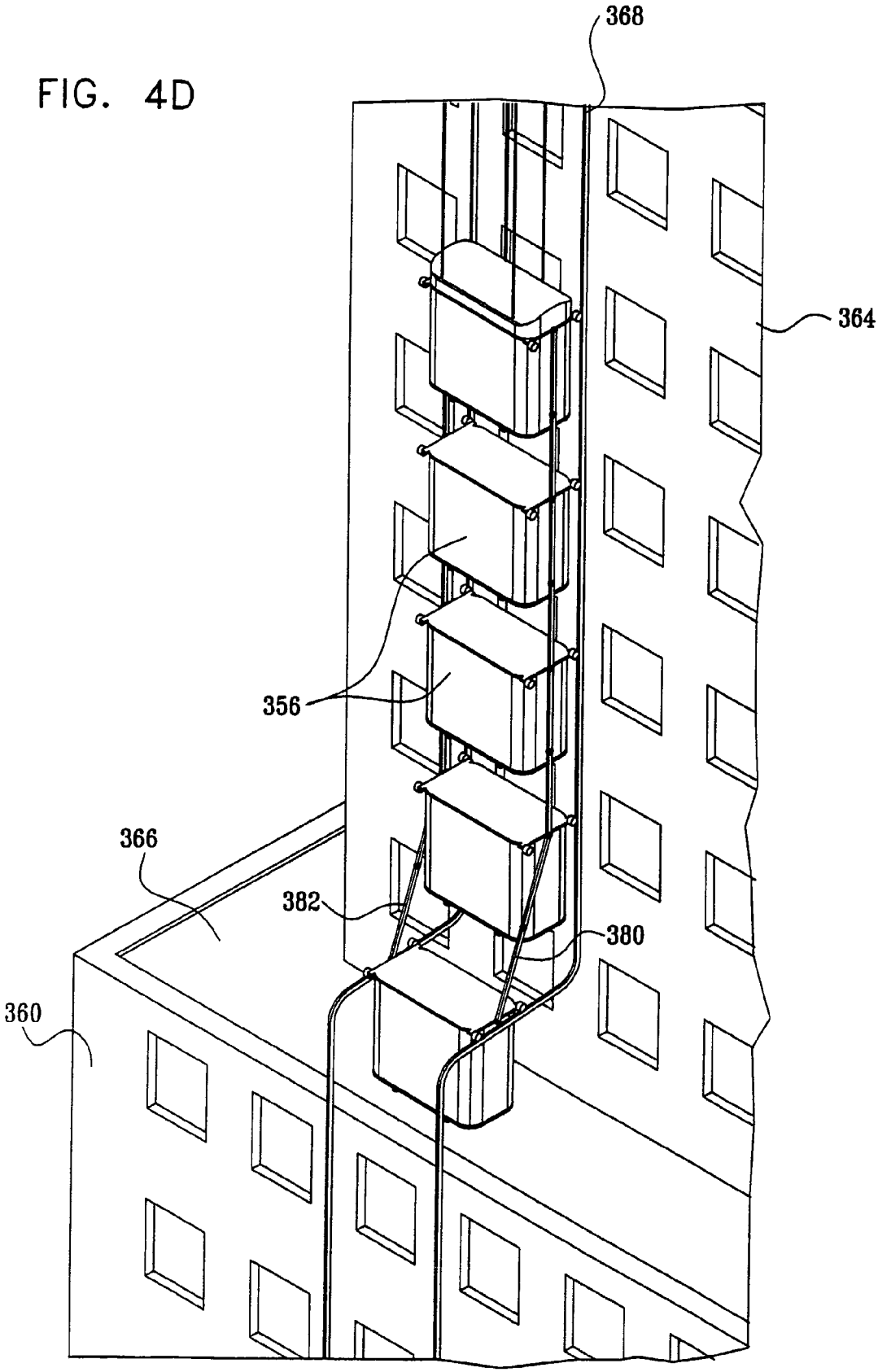

FIG. 4D shows the bottommost platform 356 depending from guiding rails 368, such that foldable support elements 380 and 382 connecting it to the next-to-bottommost platform 356 are pivoted to allow the outward displacement of bottommost platform 356. It is appreciated that at this stage there is a change of the direction of motion of bottommost platform 356 from generally vertical motion to generally horizontal motion.

Figure 4E:
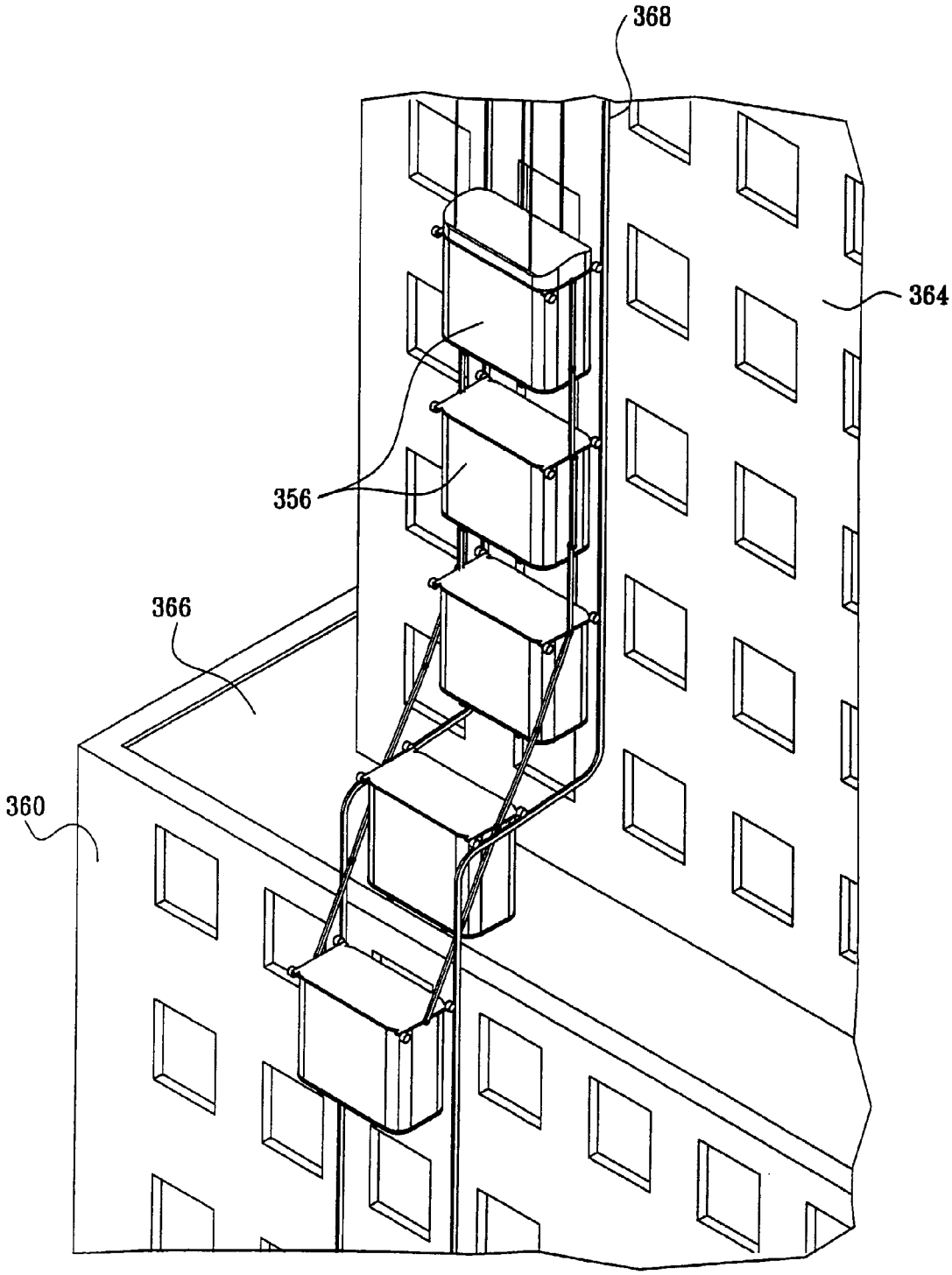

FIG. 4E shows the bottommost platform 356 after it passed the setback portion 366 such that it is now supported by the bottom generally vertical portion of guiding rails 368. As seen in FIG. 4E, the next-to-bottommost platform 356 is dependent from guiding rails 368, and is in deployed generally horizontally along the guiding rails.

Figure 4F:
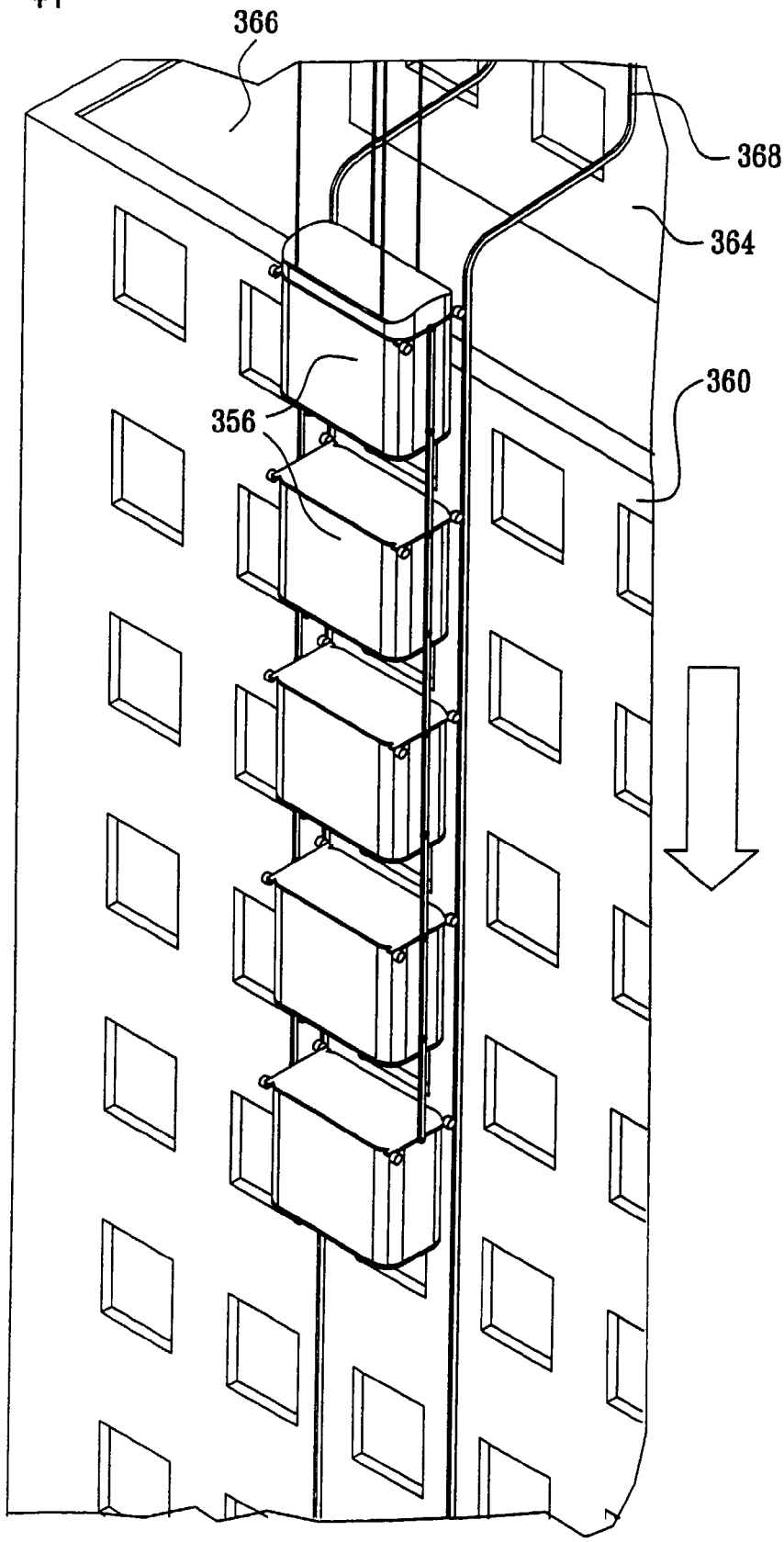

FIG. 4F shows lowering of platforms 356 along bottom portion 360 of building 352, using the bottom generally vertical portion of guiding rails 368 for support. As seen in FIG. 4F, the topmost platform 356 is now in a position in which it is just below the setback portion 366.

Figure 4G:
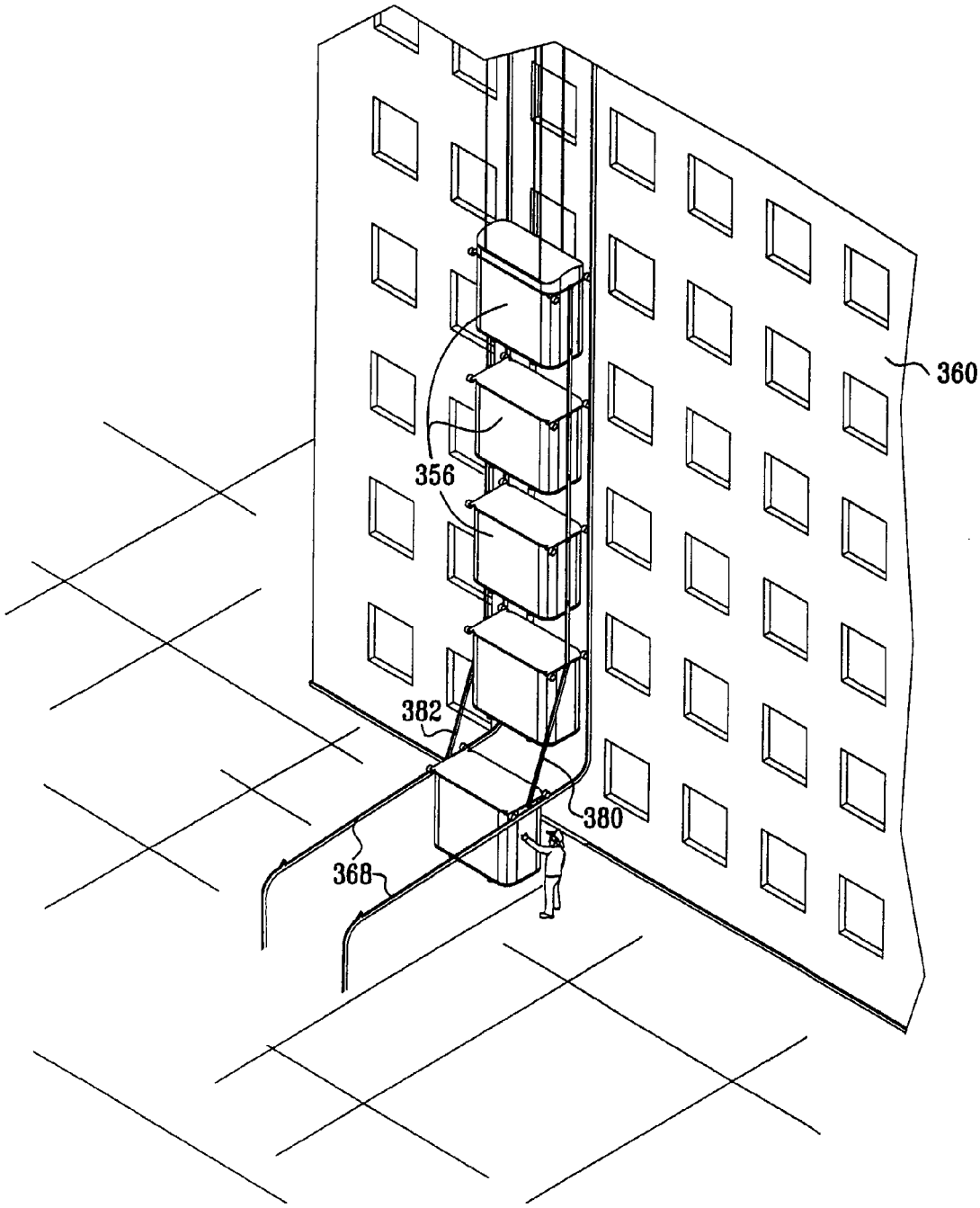

FIG. 4G illustrates the bottommost platform 356 depending from the bottom portion of guiding rails 368, such that a bottom support surface thereof is adjacent the egress level. At this position, foldable support elements 380 and 382 connecting are pivoted to allow the outward displacement of bottommost platform 356.

Figure 4H:
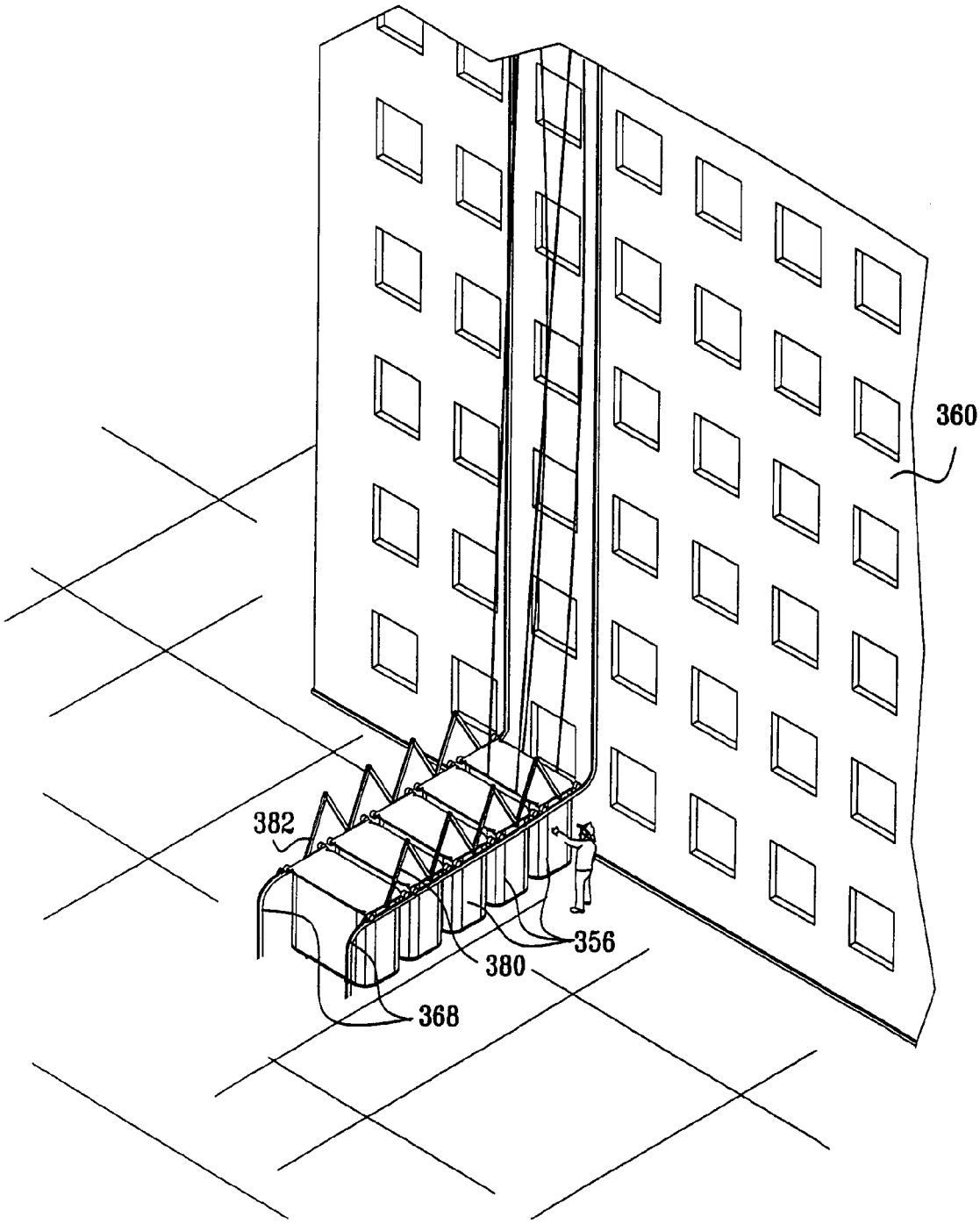

Reference is now made to FIG. 4H, which illustrates all the platforms 356 depending from the bottom portion of guiding rails 368, in a pre-egress orientation. In this orientation, foldable support elements 380 and 382 pivot to accommodate the transverse displacement.

Figure 5:
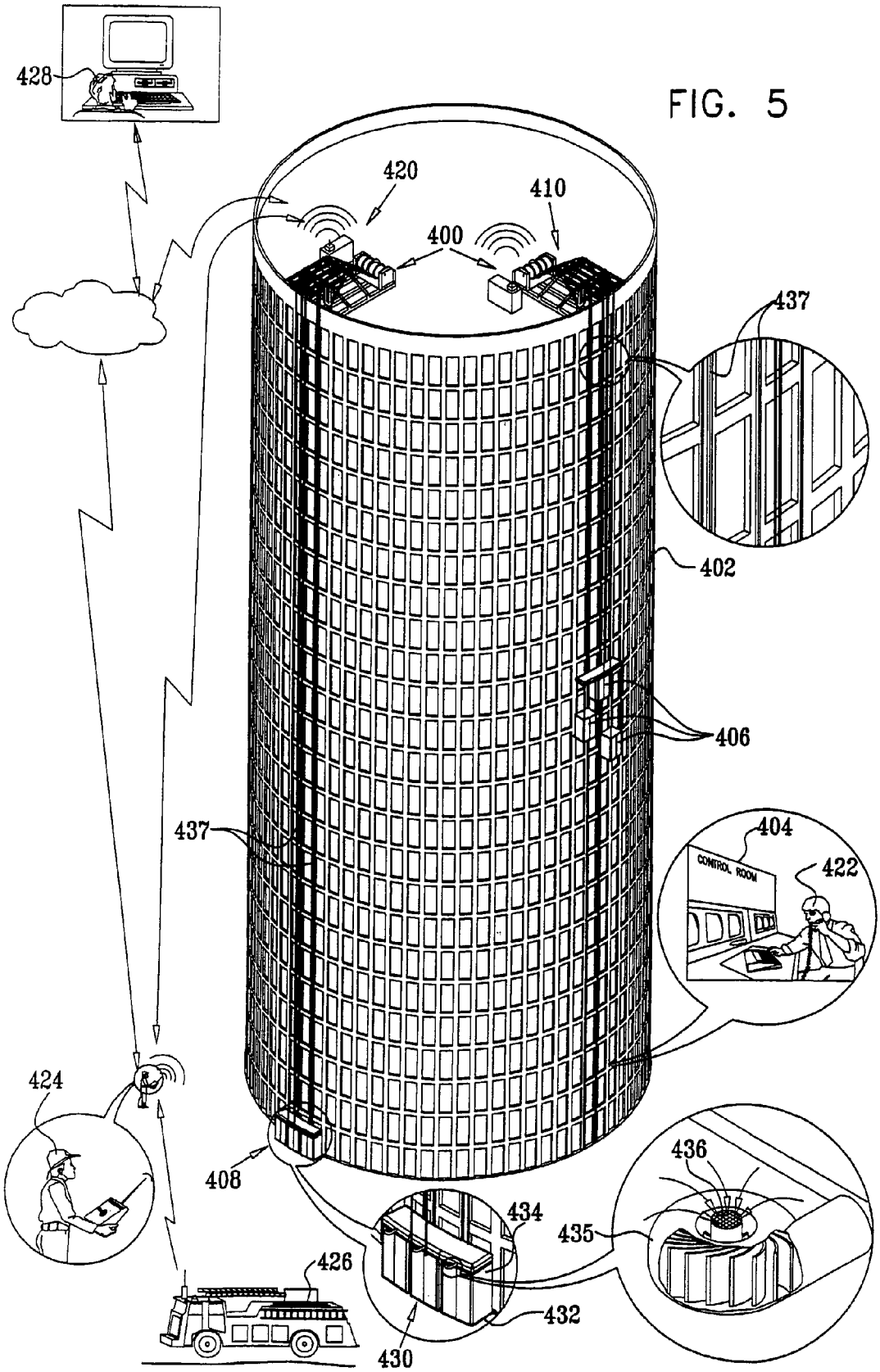
FIG. 5 is a simplified pictorial illustration of a building equipped with an escape system constructed and operative in accordance with another preferred embodiment of the present invention.

Reference is now made to FIG. 5, which is a simplified pictorial illustration of a building equipped with an escape system constructed and operative in accordance with another preferred embodiment of the present invention. As seen in FIG. 5, there is provided an evacuation system for a building preferably comprising a plurality of selectably lowerable, multiple-platform, generally vertical transporters 400, each arranged for selectable communication with multiple floors of a building 402.

Control outputs preferably provided by a central controller 404 or alternatively by multiple controllers, each assignable to a given transporter 400, selectably lower multiple platforms 406 of the transporters 400 from multiple floors to at least one egress level 408 at which egress of persons may safely occur.

It is appreciated that a given building, such as building 402, may include one or more transporters 400. In the illustrated embodiment of FIG. 5, multiple transporters 400 are shown in various operative orientations. For example, a transporter designated by reference numeral 410 is shown in a deployment orientation and a transporter designated by reference numeral 420 is shown in an egress orientation.

Human control inputs to controller 404 or directly to transporters 400 may be provided, for example, by one or more of an operator 422 at the controller 404, an operator 424 on the ground, an operator in a fire engine 426 and a remote operator 428, communicating via a data network, such as the Internet or an emergency network.

As seen in FIG. 5, each of the transporters 400 preferably comprises a plurality of platforms 406, arranged to be supported on a generally vertical support, the plurality of platforms 406 being arranged generally in a side-by-side relationship, as illustrated for transporter 420. During deployment of the plurality of platforms 406, the platforms may be raised or lowered independently of one another, such that each platform 406 is in communication with a different floor of building 402, which need not necessarily be consecutive, for evacuation loading, as illustrated in FIG. 5 for transporter 410.

When all the platforms 406 are located at the egress level, the platforms 406 are arranged in a side by side relationship, as indicated by reference numeral 430. In the illustrated embodiment of FIG. 5, each of the plurality of platforms 406 preferably comprises a bottom support surface 432 and a peripheral enclosing element 434, such as a wall element formed of fabric or rigid sheets or a combination thereof, preferably a heat resistant, fire resistant and/or smoke impermeable material. Preferably, the interior of peripheral enclosing element 434 is pressurized so as to reduce, insofar as possible, the ingress of smoke and noxious gases thereto. Pressurization is preferably provided by an electrically operated fan, such as a centrifugal blower, 435, which is preferably associated with an air filter 436, such an activated carbon filter.

Enclosing element 434 may constitute a protective railing or restraining band rather than a complete wall. Enclosing element 434 is preferably designed to provide low aerodynamic drag to reduce wind forces on the platform 406. Preferably at least one building mounted stabilizing element cooperates with each transporter for stabilizing the transporter against lateral forces, such as wind forces. In the illustrated embodiment, vertical guides 437 are provided at suitable locations along building 402.

In the embodiment of FIG. 5, where a plurality of transporters 400 are provided, the controller 404 is preferably operative to individually control individual transporters 400 such that multiple platforms 406 of different transporters may be simultaneously positioned in communication with different groups of multiple floors of the building for simultaneous evacuation loading. The multiple floors may or may not be contiguous.

The transporters may also be employed for lifting persons, such as firefighters or other rescue personnel, and/or equipment, from the egress level or other building levels to multiple levels of the building.

Figure 6A:
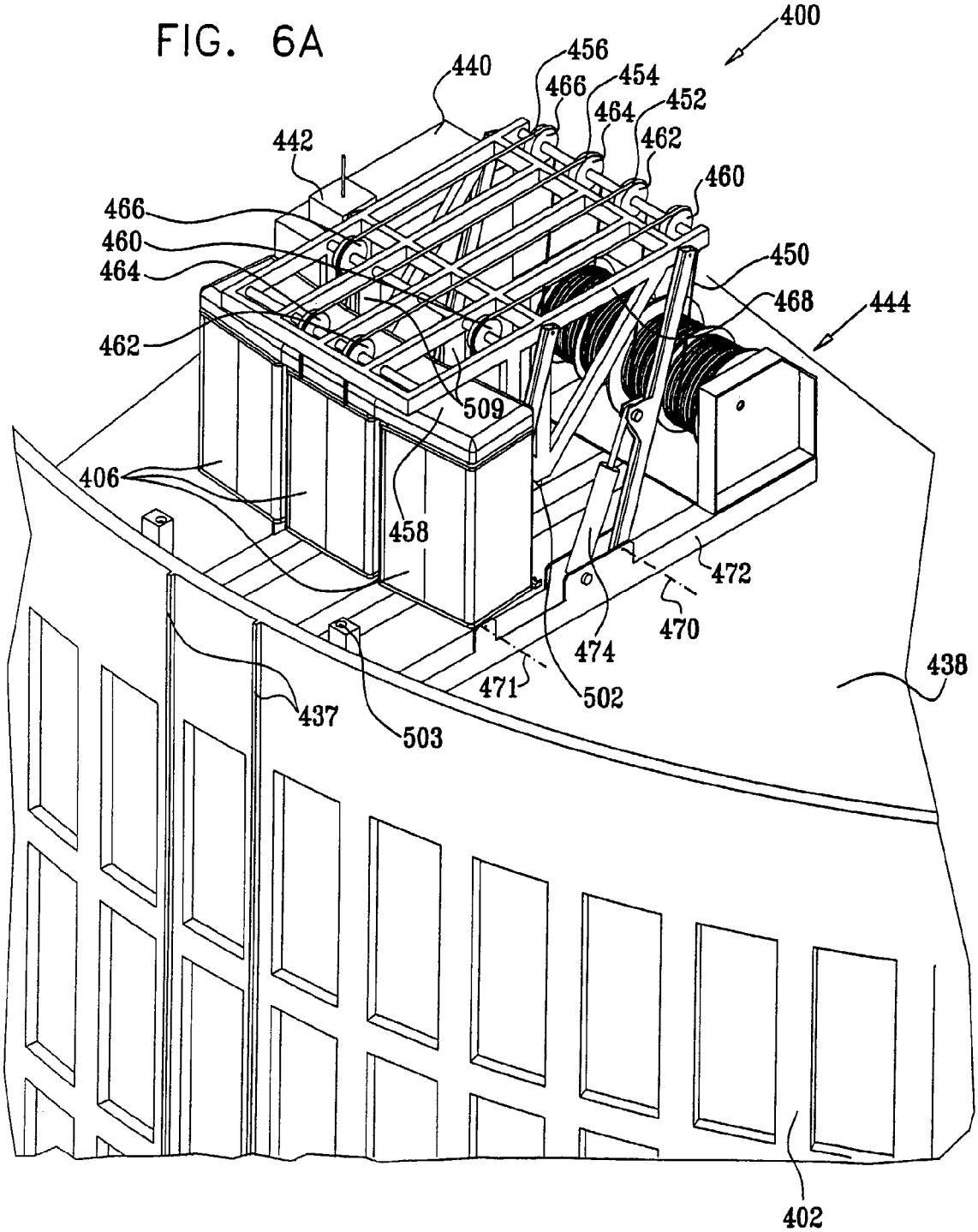

Reference is now made to FIGS. 6A, 6B, 6C, 6D, 6E, 6F, 6G, 6H, 6I, 6J, 6K, 6L, 6M, 6N, 6O and 6P, which illustrate typical operation of the evacuation system of FIG. 5. Turning to FIG. 6A, it is seen that a typical transporter 400 includes a fixed installation, preferably mounted onto the roof 438 of building 402. The fixed installation preferably includes a transporter control subsystem 440 having a wired and/or wireless communication interface 442 and being arranged for interactive data communication with controller 404 (FIG. 5) and/or one or more communicators (not shown) employed by one or more operators, such as operators 422, 424 and 428 (FIG. 5).

Transporter control subsystem 440 operates, using mains power, emergency back-up power and/or a generator, a winch/brake assembly 444, which is preferably hydraulic, and a stacked platform deployment assembly. Preferably, winch/brake assembly 444 includes a conventional hydraulic fluid pump and reservoir assembly, a conventional hydraulic cooling assembly, a conventional hydraulic gear motor assembly and a conventional hydraulic control valve (not shown), which provide power and braking for conventional hydraulic winches associated therewith as well as an emergency hydraulic braking system. Preferably, winch/brake assembly 444 provides braking while transporters 400 are descending and provides lifting power when transporters 400 are ascending.

It is appreciated that in the absence of electrical power, winch/brake assembly 444 is operative to lower platforms 406 of transporter 400 to egress level 408 (FIG. 5) using gravitational force.

Preferably four cables 450, 452, 454 and 456 are wound on winch/brake assembly 444 and extend to four mutually spaced locations on a transporter top frame 458. Each of cables 450, 452, 454 and 456 preferably engages a pair of pulleys, here respectively designated by reference numerals 460, 462, 464 and 466, supported onto a pivotably mounted deployment frame 468. Deployment frame 468 is pivotably mounted for rotation about axes 470 and 471 defined by a static support frame 472. Selectable pivotal orientation of deployment frame 468 preferably is provided by a pair of hydraulic pistons 474.

Turning to the platform deployment assembly, mounted onto transporter top frame 458 is a plurality of platforms 406. For each of the plurality of platforms 406 there is provided within the transporter top frame 458 a platform selectable release assembly (not shown), which preferably comprises a wireless control communicator (which is similar to wireless control communicator 192 of PCT application PCT/IL2003/00080986 incorporated herein by reference) which, inter alia, governs the operation of a platform selectable release motor/brake assembly (similar to motor/brake assembly 194 PCT application PCT/IL2003/00080986) which operates at least one rotatable shaft (similar to rotatable shaft 196 of PCT application PCT/IL2003/00080986), onto the ends of which are mounted pulleys (not shown). Preferably each platform 406 is connected at its top surface to four cables (not shown in FIG. 2A) which are wound onto the pulleys. These pulleys are operative to lower each of the platforms separately.

FIG. 6A shows a plurality of platforms 406 held in a side-by-side arrangement below transporter top frame 458 by cables. Transporter top frame 458 preferably includes a pair of building mounted guide riding roller assemblies (shown in FIG. 6B), which are adapted for vertically slidable operative engagement with building mounted vertical rails or guides, such as building mounted vertical guides 437 such as rails or cables. As will be described hereinbelow in greater detail, each of the platforms 406 includes a selectably positionable evacuation bridge (not shown in FIG. 6A).

Figure 6B:
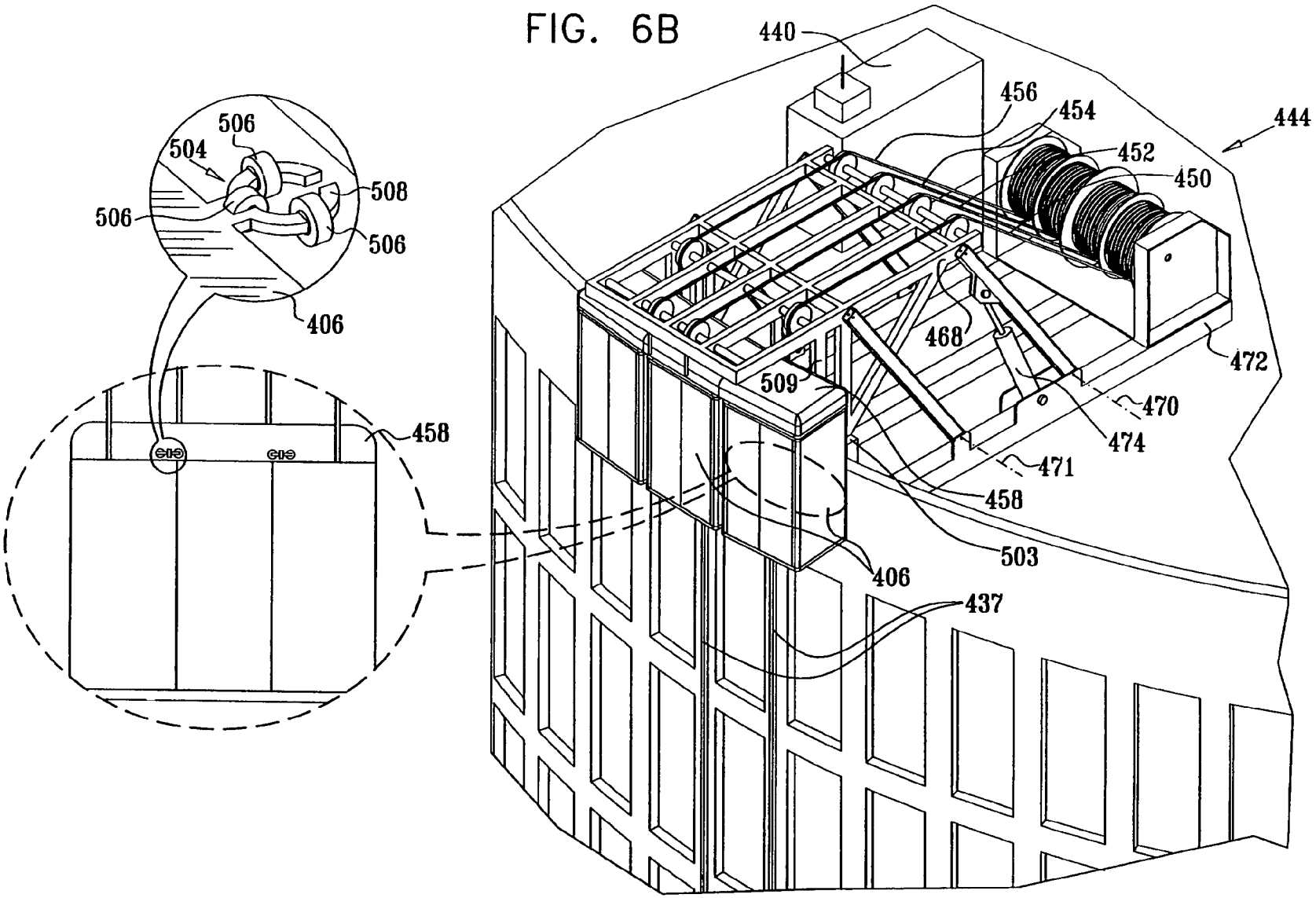

Reference is now made to FIG. 6B, which illustrates the mechanism of FIG. 6A following lateral and downwardly vertical displacement of transporter top frame 458 and platforms 406 provided by rotation of deployment frame 468 about axes 470 and 471 produced by maximum retraction of pistons 474 to an orientation, shown in FIG. 6B, wherein locating pins 502 (FIG. 6A) on deployment frame 468 are seated in sockets 503 on static frame 472.

FIG. 6B additionally illustrates initial engagement of building mounted guide riding roller assemblies 504 with vertical guides 437, resulting inter alia from lowering of transporter top frame 458 produced by playing out of cables 450, 452, 454 and 456 by winch/brake assembly 444. It is seen that assemblies 504 preferably include at least three rollers 506 mounted on a generally peripheral support 508. Preferably directing rods 509 mounted on deployment frame 468 direct transporter top frame 458 to ensure correct engagement between assemblies 504 and vertical guides 437.

Figure 6C:
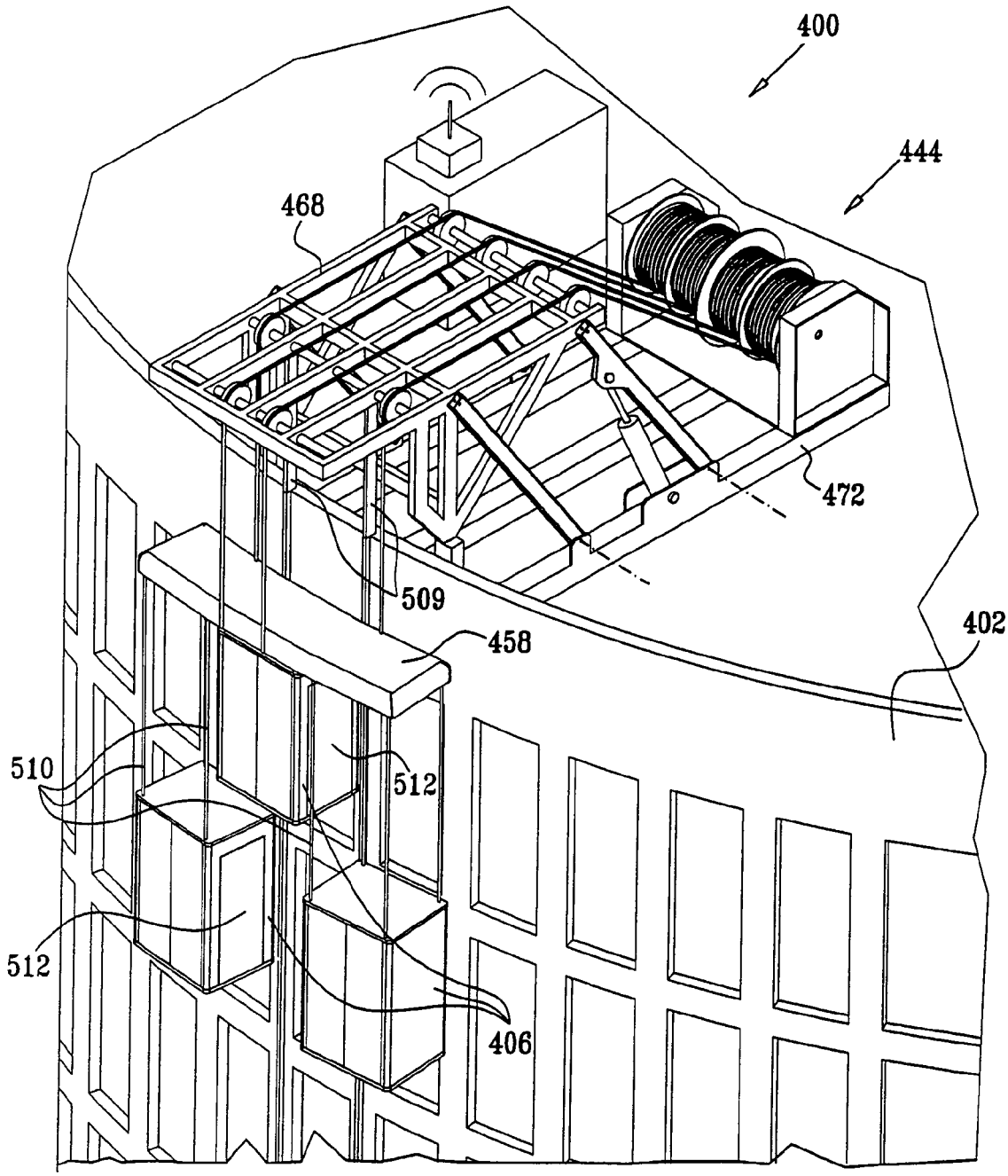

Reference is now made to FIG. 6C, which illustrates the mechanism of FIG. 6B following lowering of platforms 406 relative to transporter top frame 458 produced by unwinding of sets of four cables 510 which attach each of platforms 406 to transporter top frame 458.

As seen in FIG. 6C, platforms 406 are preferably selectably lowered to different heights along the building 402, thus enabling entrance of evacuees into the platforms from a plurality of floors. The selectable lowering of platforms 406 is achieved by selectable unwinding of cables 510, for each of the different platforms 406. Typically, at least one platform 406, remains directly below transporter top frame 458, and does not extend therefrom by cables 510.

It is appreciated that the platforms 406 and top frame 458 may all be lowered to the same evacuation level, thus enabling the plurality of platforms 406 to function as a single high capacity rescue unit, having a plurality of entrances. When the plurality of platforms are lowered in a side-by-side arrangement to function as a single unit, side doors 512 may be opened, thus enabling movement of evacuees between different platforms. It is appreciated that the distribution of platforms 406 along the different levels of building 402 is situation dependent and can be optimized according to the evacuation needs, and the different platforms 406 need not necessarily be lowered to adjacent floors.

Figure 6D:
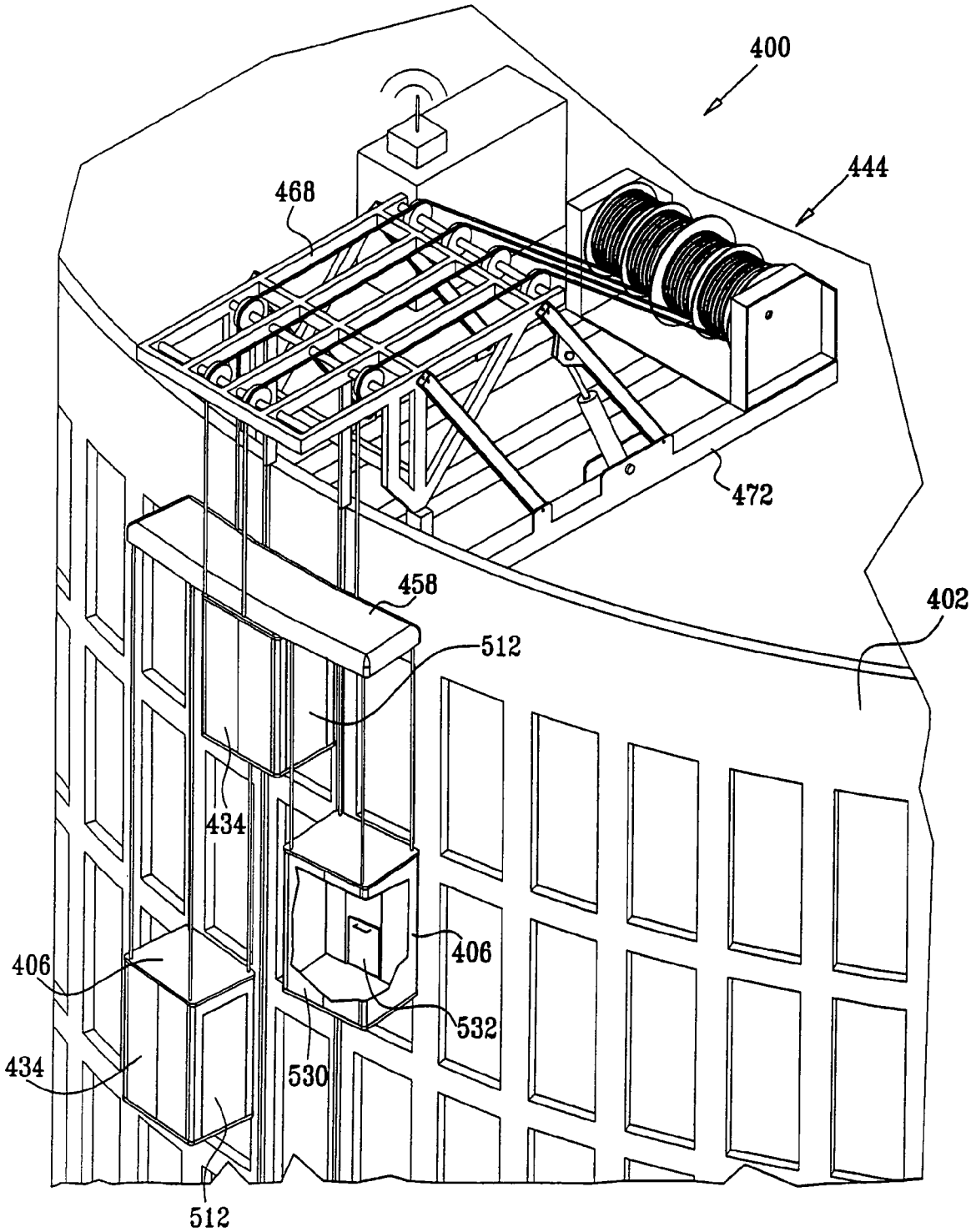

Reference is now made to FIG. 6D, which illustrates the initial lowering of platforms 406 of transporter 400. The enclosing element 434 of each platform 406 includes an egress opening 530 and has associated therewith a selectably positionable evacuation bridge 532, preferably in an upright orientation.

Figure 6E:
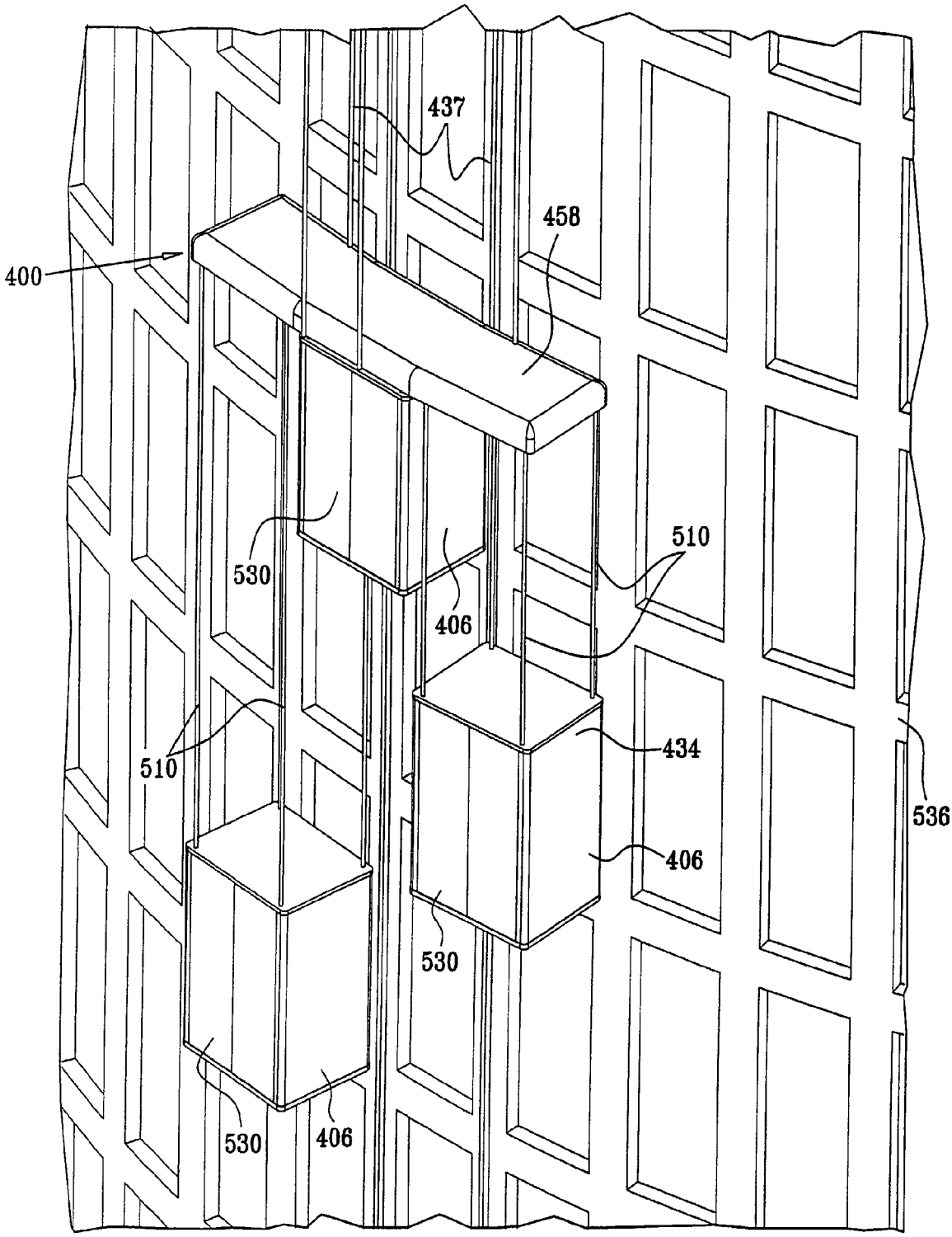

FIG. 6E illustrates transporter 400 when all of the platforms 406 have been fully deployed and have reached their destination levels. As shown in FIG. 6D, each peripheral enclosing element 434 includes an egress opening 530 and has associated therewith a selectably positionable the evacuation bridge, preferably in an upright orientation.

Figure 6F:
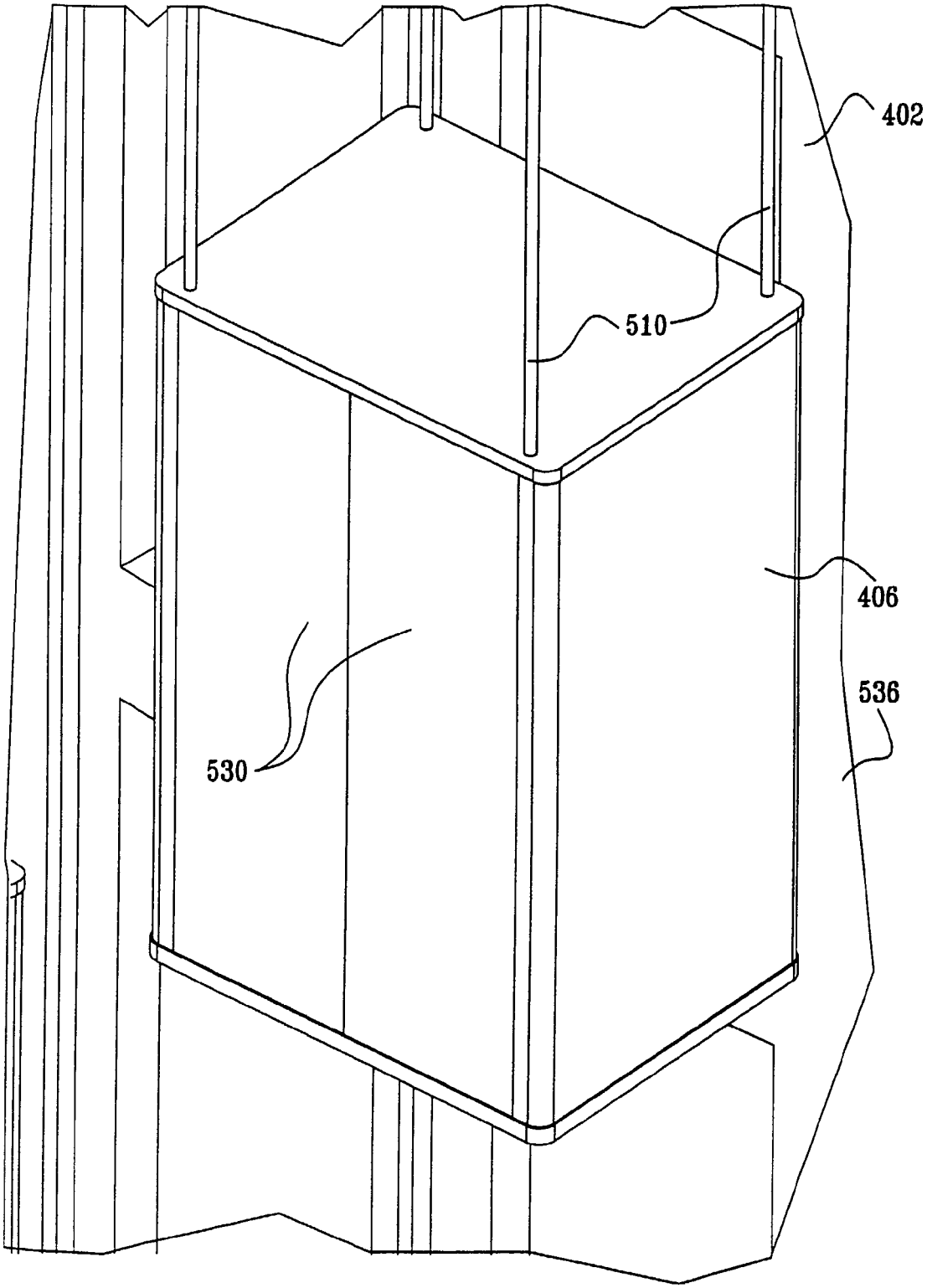

FIG. 6F shows a fully deployed platform 406 being lowered, preferably by action of winch/brake assembly 444 (FIG. 6E) into a desired vertical position relative to building 402, such that the platform 406 is properly aligned with a building floor, here designated by reference numeral 536.

Figure 6G:
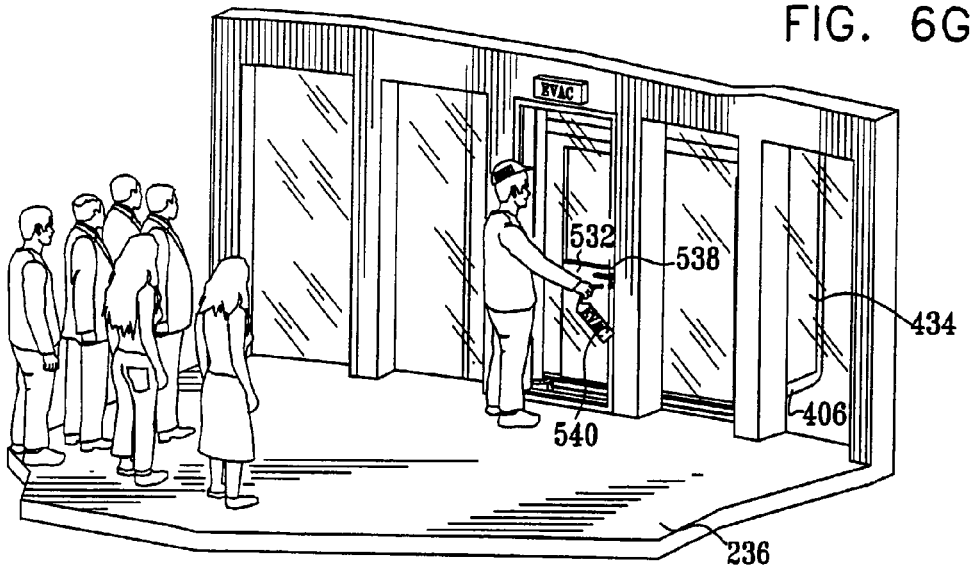
Figure 6H:
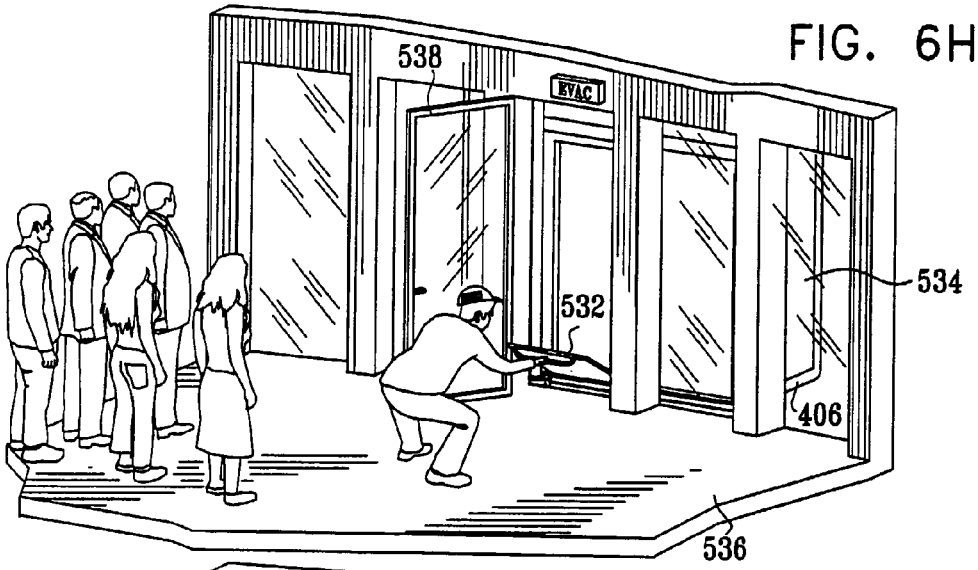
Figure 6I:
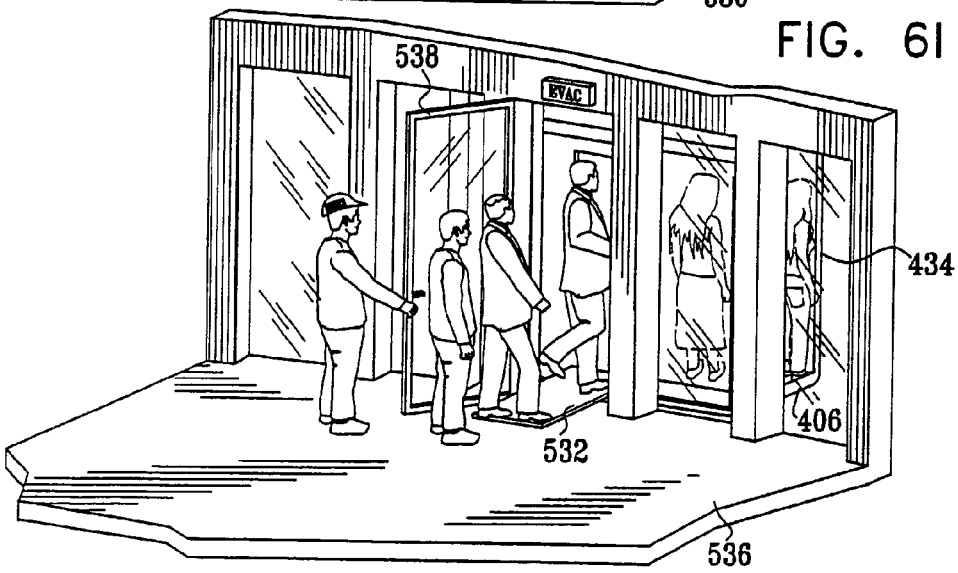

Reference is now made to FIG. 6G, which illustrates a platform 406 deployed in proper vertical alignment with a building floor 536, such that evacuation bridge 532 is positioned opposite an emergency evacuation door 538. An authorized individual, such as an evacuation team leader, typically employs an evacuation emergency key 540 to open emergency evacuation door 538. FIG. 6H shows the evacuation team leader positioning evacuation bridge 532, while FIG. 6I shows evacuation of persons from building floor 536 onto platform 406 within peripheral enclosing element 434. It is appreciated that evacuation of multiple building floors onto multiple platforms 406 of one or more transporters 400 may take place simultaneously.

Figure 6J:
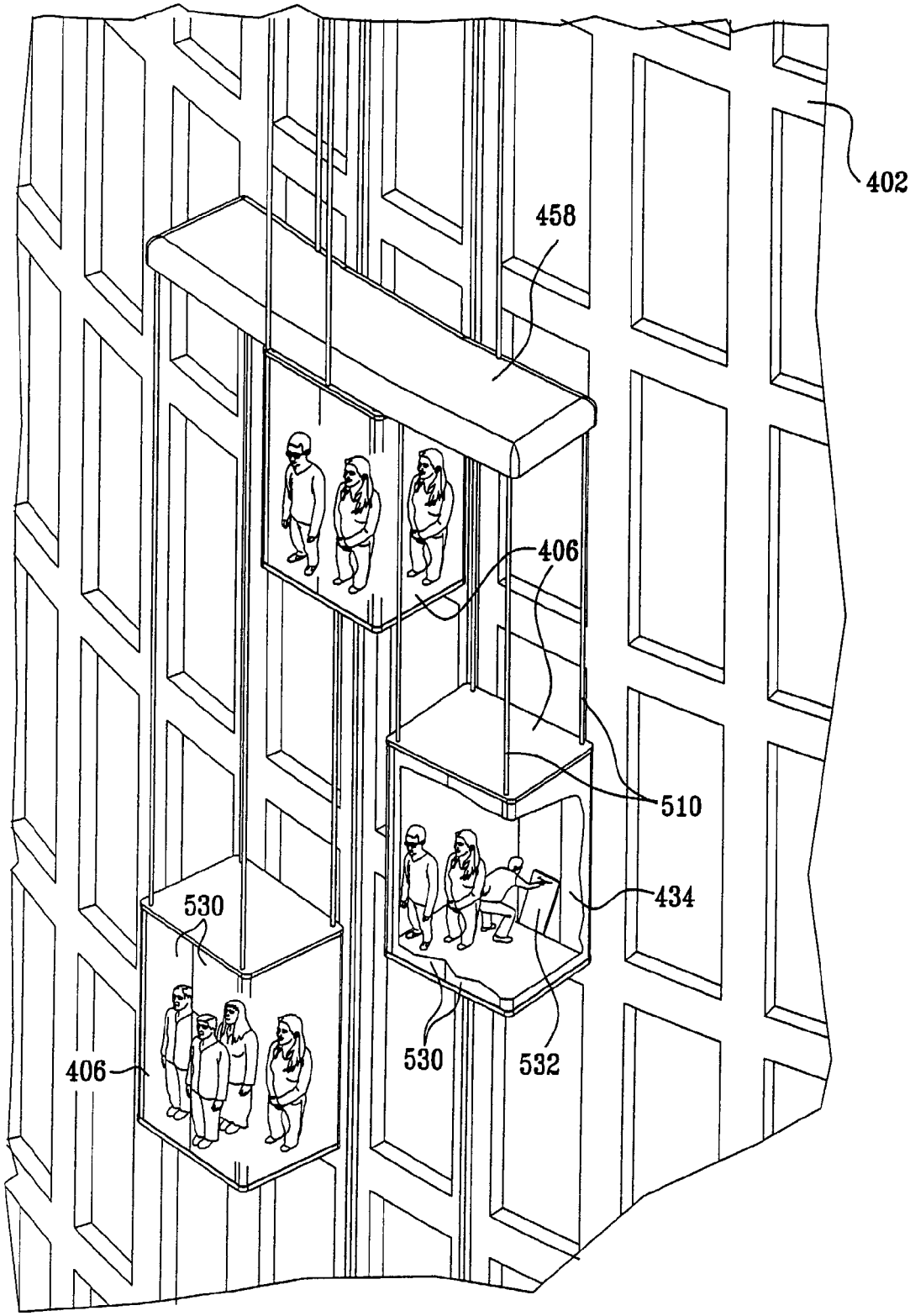

Reference is now made to FIG. 6J, which shows the evacuation team leader folding up the evacuation bridge 532. It is appreciated that the evacuation team leader may then secure the evacuation bridge 532 to the peripheral enclosing element 534 to serve as a security gate.

Figure 6K:
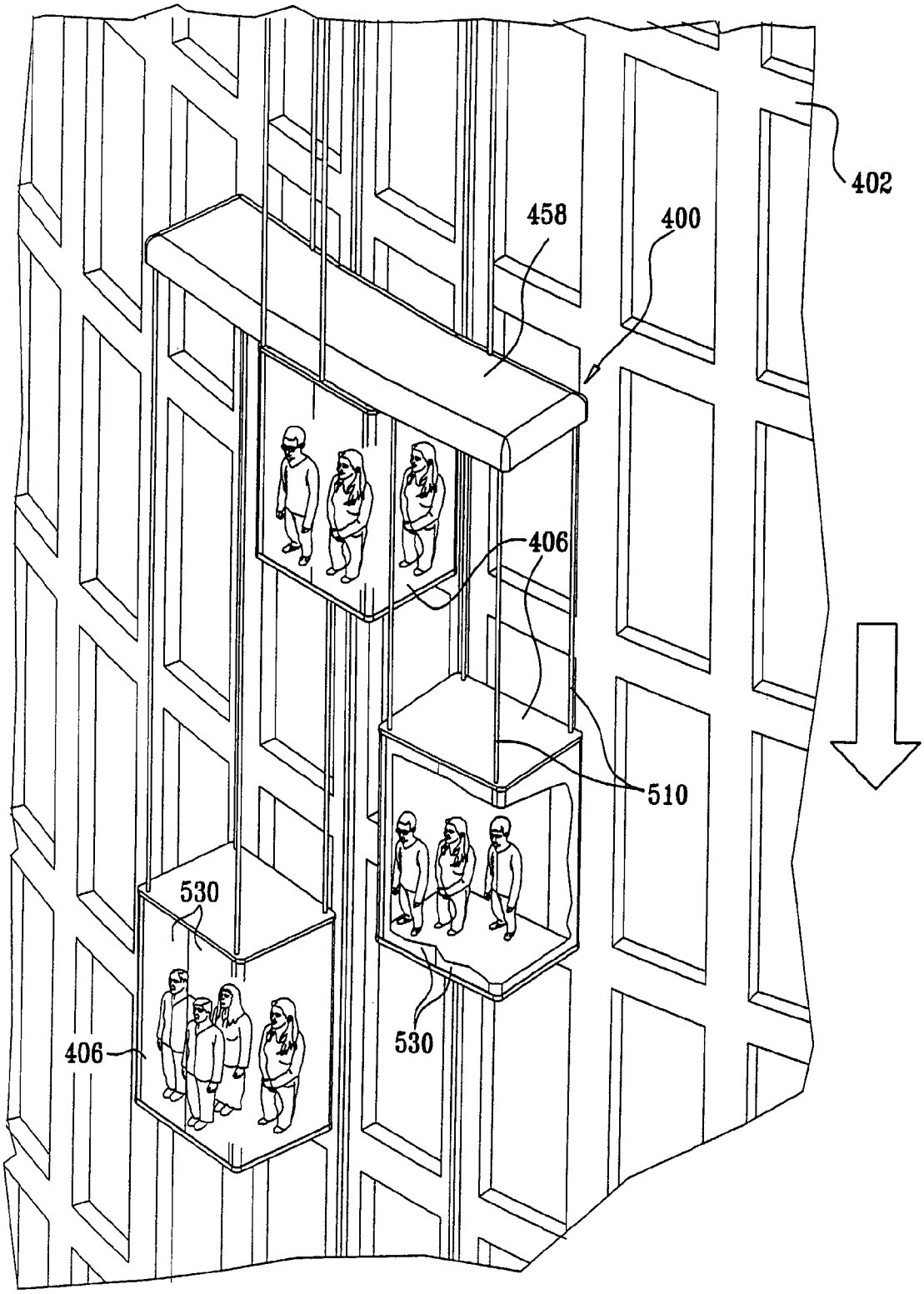

FIG. 6K illustrates lowering of a loaded transporter 400 from its loading position toward an egress location.

Figure 6L:
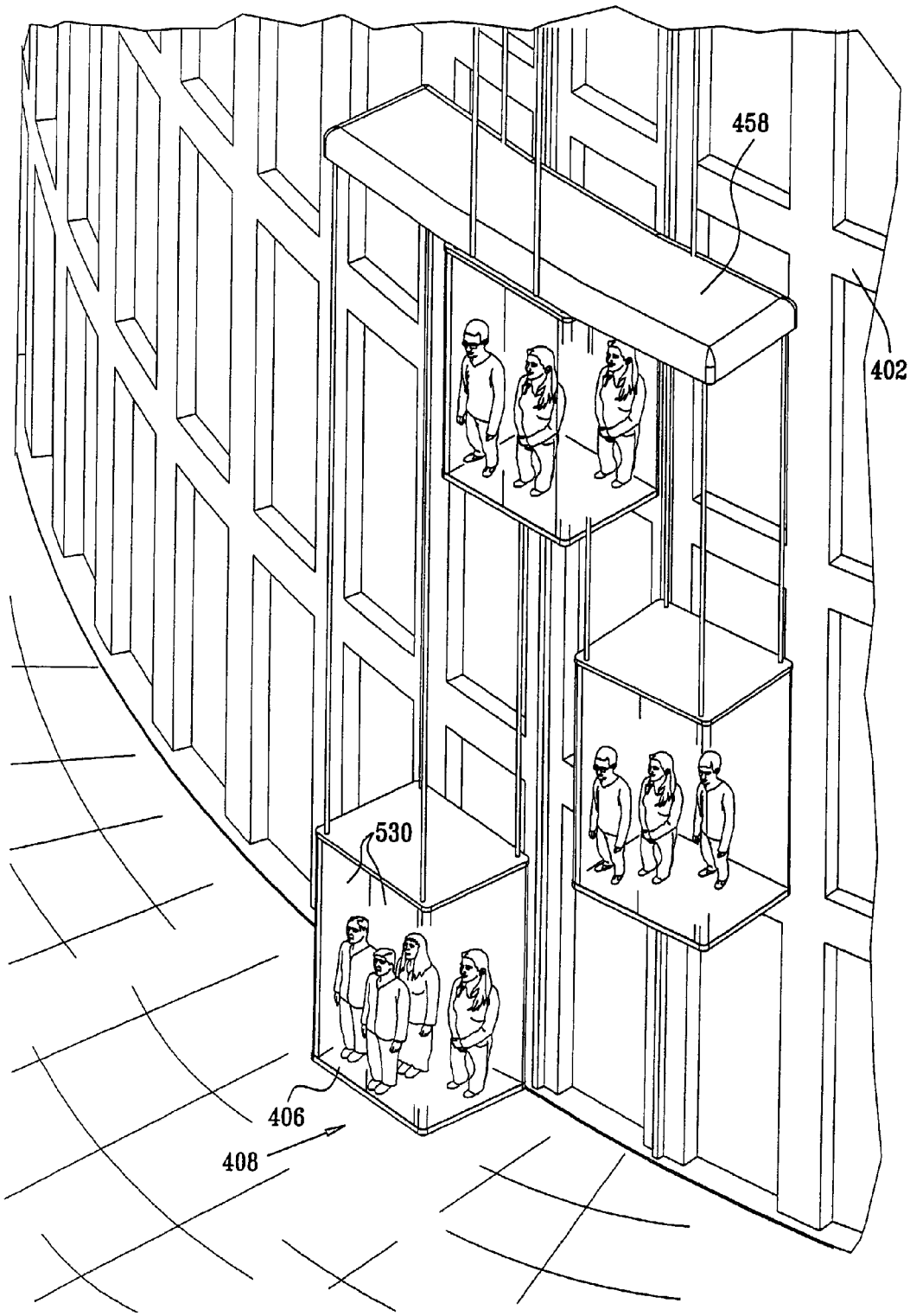
Figure 6M:
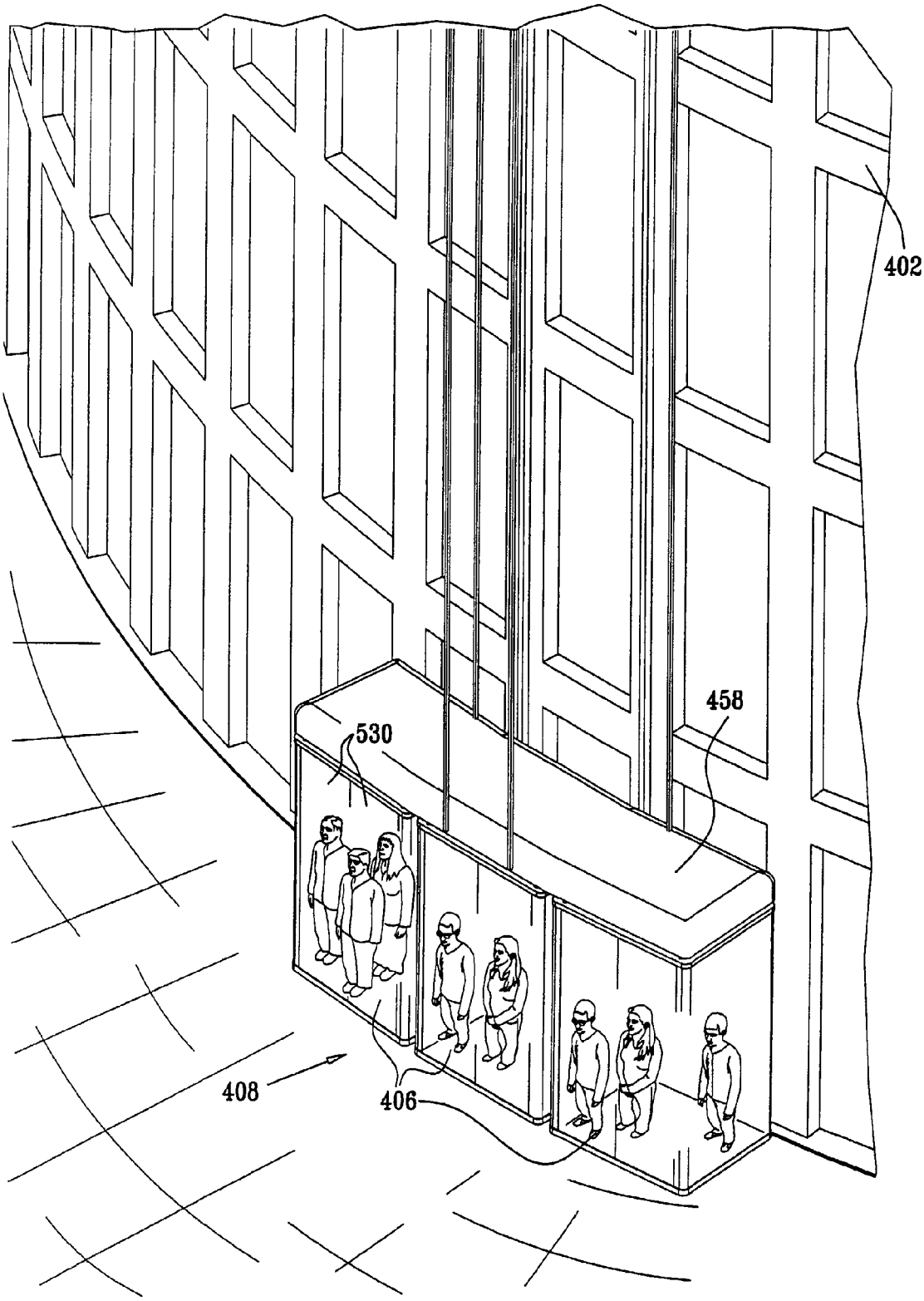
Figure 6N:
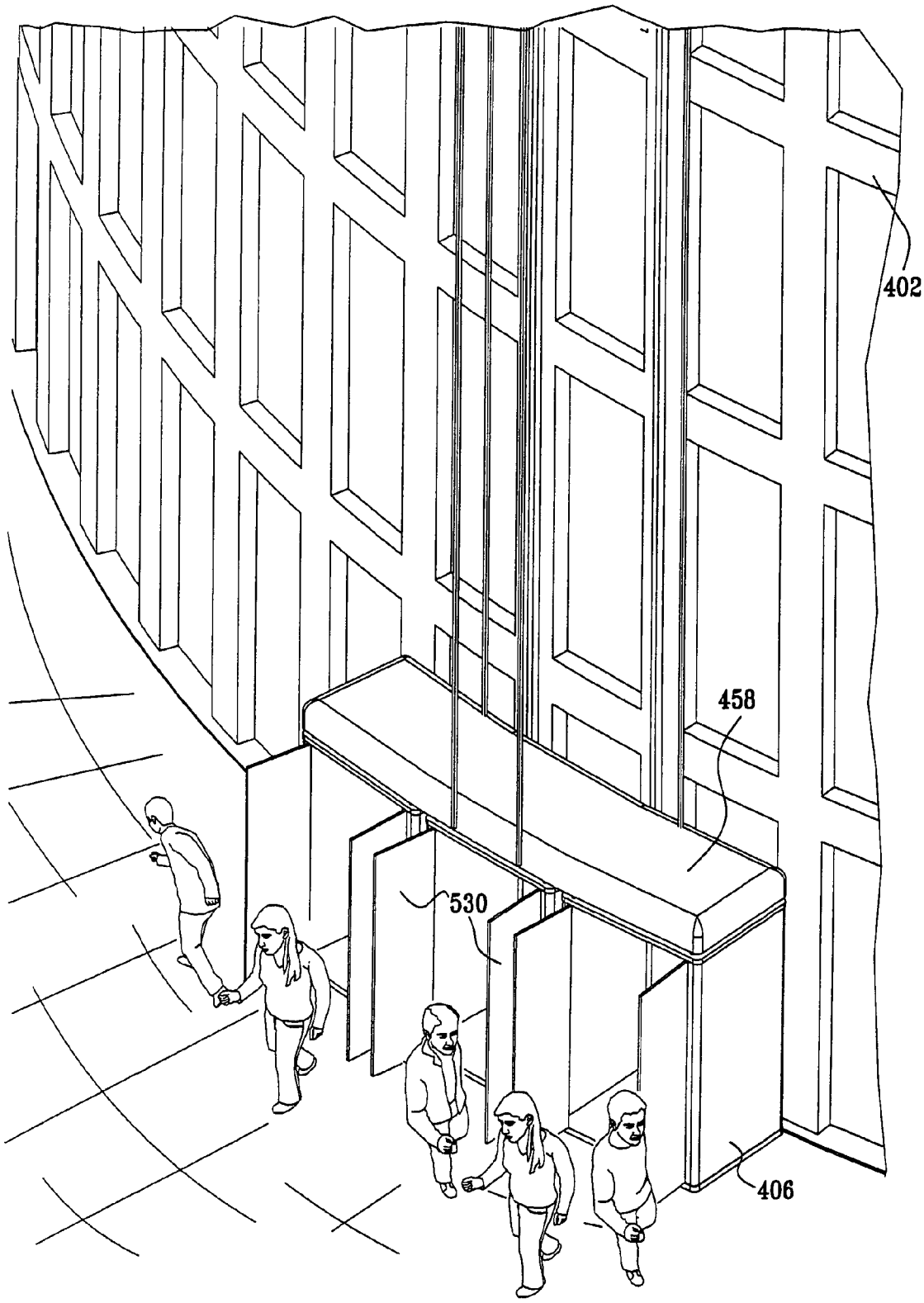
Figure 60:
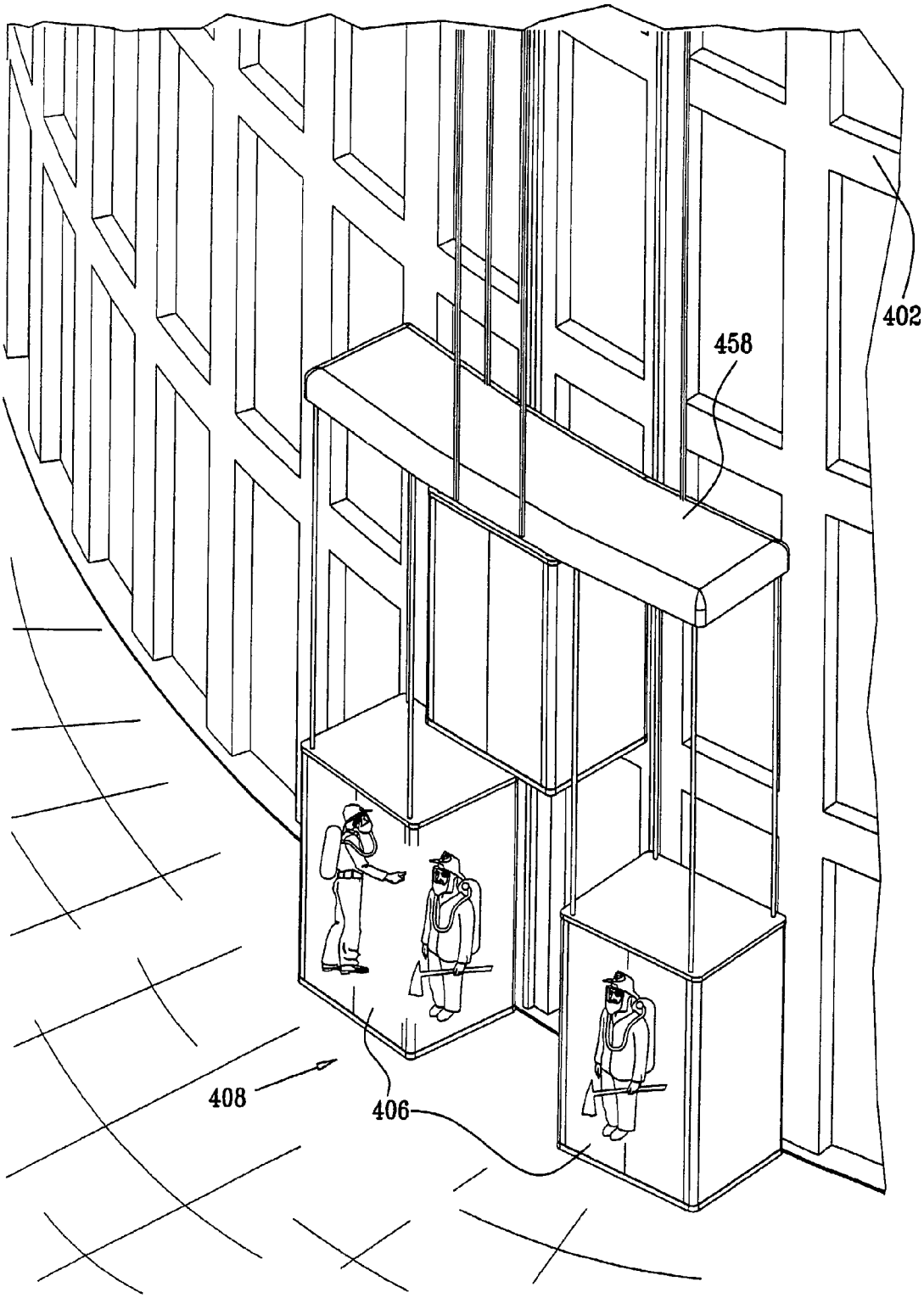

Reference is now made to FIG. 6L, which illustrates one or more platforms 406 being lowered to the egress level 408, and to FIG. 6M, which illustrates the other platforms 406 being lowered to the egress level 408, such that preferably all of the platforms 406 are at the egress level 408, prior to egress of persons therefrom. Preferably, all of the platforms reach the egress level 408 within a time duration of less than one minute between the operative orientations shown in FIGS. 6L and 6M. Preferably thereafter egress of persons from all of the platforms 406 via egress openings 530 takes place generally simultaneously, as shown in FIG. 6N.

Figure 6P:
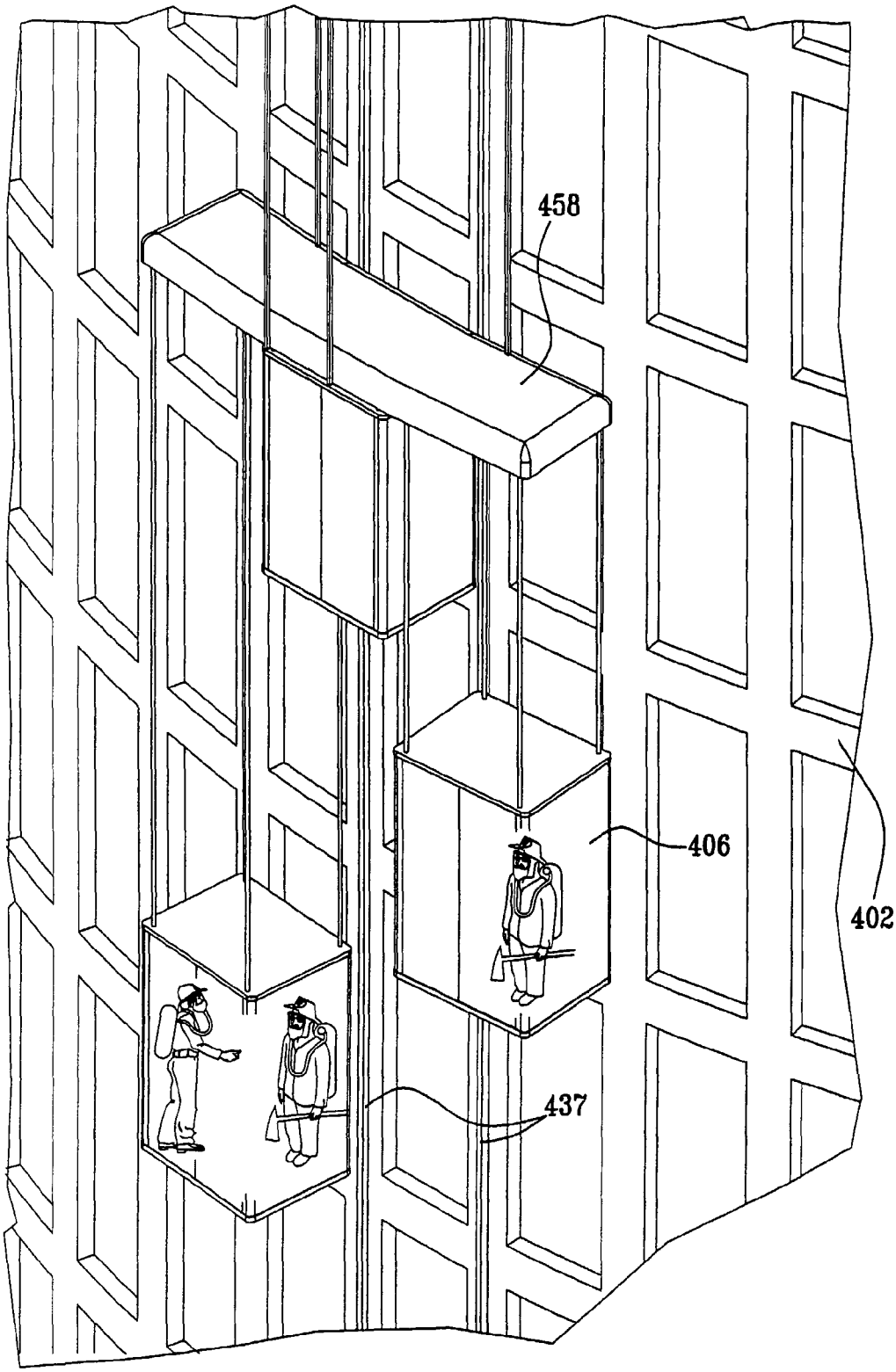

It is appreciated that the transporter 400 may be employed for raising rescue personnel or firefighters to selected floors of building 402, as shown in FIGS. 6O and 6P.

It is additionally appreciated that shock absorbing elements may be added on a building-facing surface of each of platforms 406, thus reducing the impact of engagement between the platforms 406 and the building 402 due to wind forces or other external forces.

Figure 7:
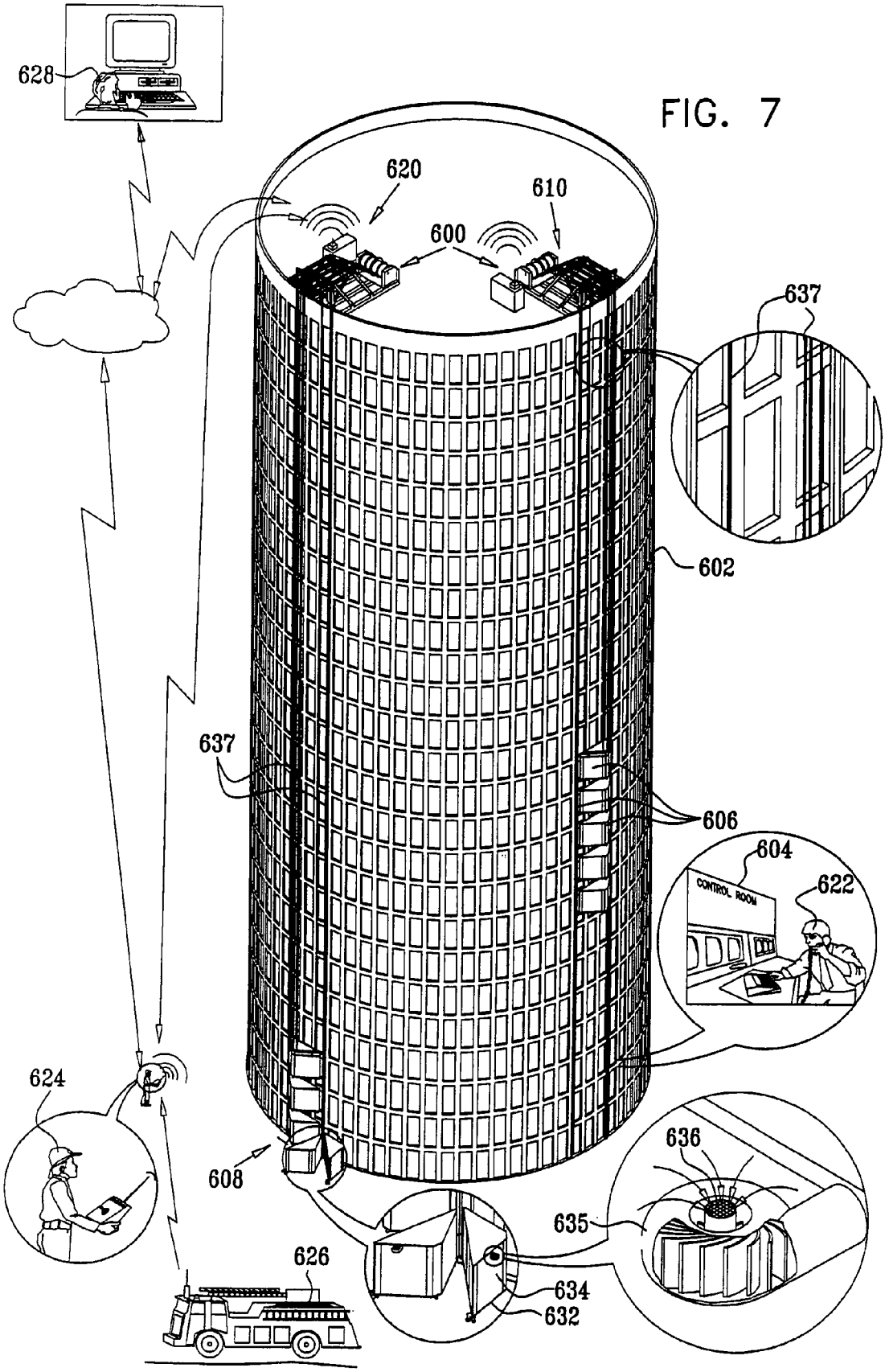
FIG. 7 is a simplified pictorial illustration of a building equipped with an escape system constructed and operative in accordance with a preferred embodiment of the present invention.

Reference is now made to FIG. 7, which is a simplified pictorial illustration of a building equipped with an escape system constructed and operative in accordance with another preferred embodiment of the present invention. As seen in FIG. 7, there is provided an evacuation system for a building preferably comprising a plurality of selectably lowerable, multiple-platform, generally vertical transporters 600, each arranged for selectable communication with multiple floors of a building 602. Control outputs preferably provided by a central controller 604 or alternatively by multiple controllers, each assignable to a given transporter 600, selectably lower multiple platforms 606 of the transporters 600 from multiple floors to at least one egress level 608 at which egress of persons may safely occur.

It is appreciated that a given building, such as building 602, may include one or more transporters 600. In the illustrated embodiment of FIG. 7, multiple transporters 600 are shown in various operative orientations. For example, a transporter designated by reference numeral 610 is shown in a deployment orientation and a transporter designated by reference numeral 620 is shown in a pre-evacuation egress orientation.

Human control inputs to controller 604 or directly to transporters 600 may be provided, for example, by one or more of an operator 622 at the controller 604, an operator 624 on the ground, an operator in a fire engine 626 and a remote operator 628, communicating via a data network, such as the Internet or an emergency network.

As seen in FIG. 7, each of the transporters 600 preferably comprises a plurality of stackable platforms 606, arranged to be supported on multiple generally vertical supports, the plurality of platforms 606 being arranged in mutually spaced relationship, as illustrated in FIG. 7 for transporter 610, each in communication with a different floor of building 602 for evacuation loading. The plurality of platforms 606 are preferably arranged in a mutually collapsed relationship when not in use, as shown with particular clarity in FIG. 8A.

Figure 8A:
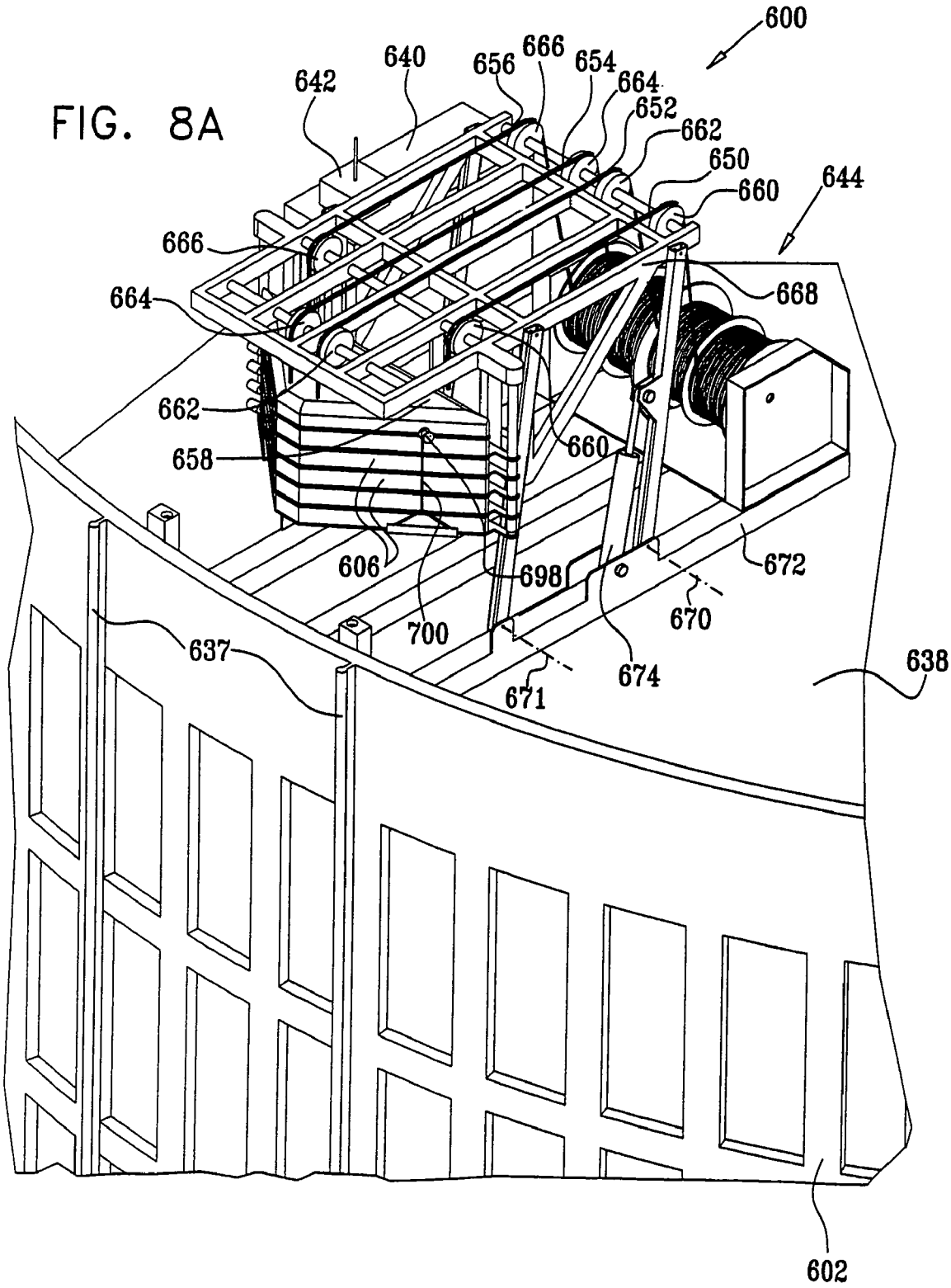
Figure 8B:
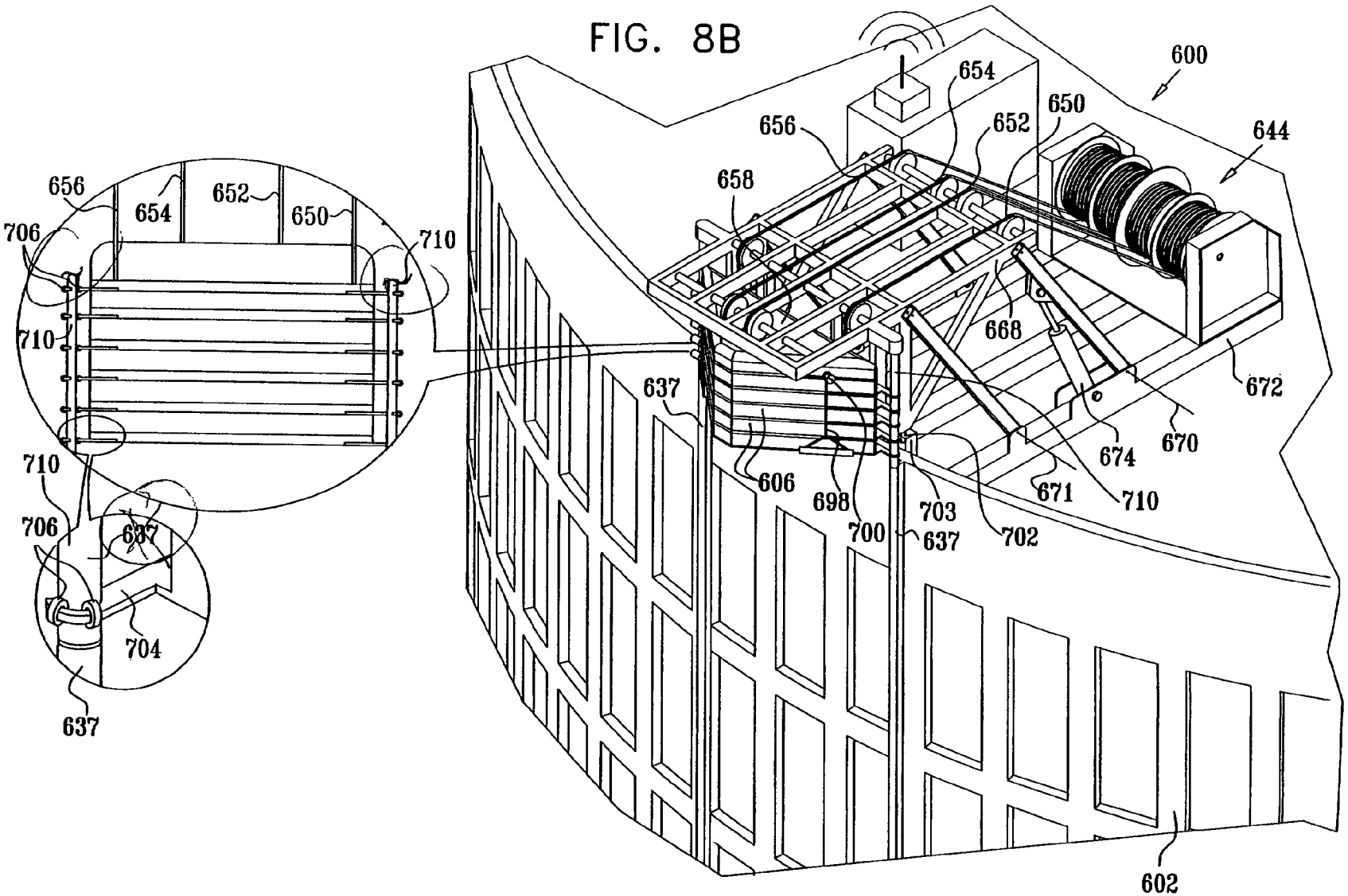
Figure 8C:
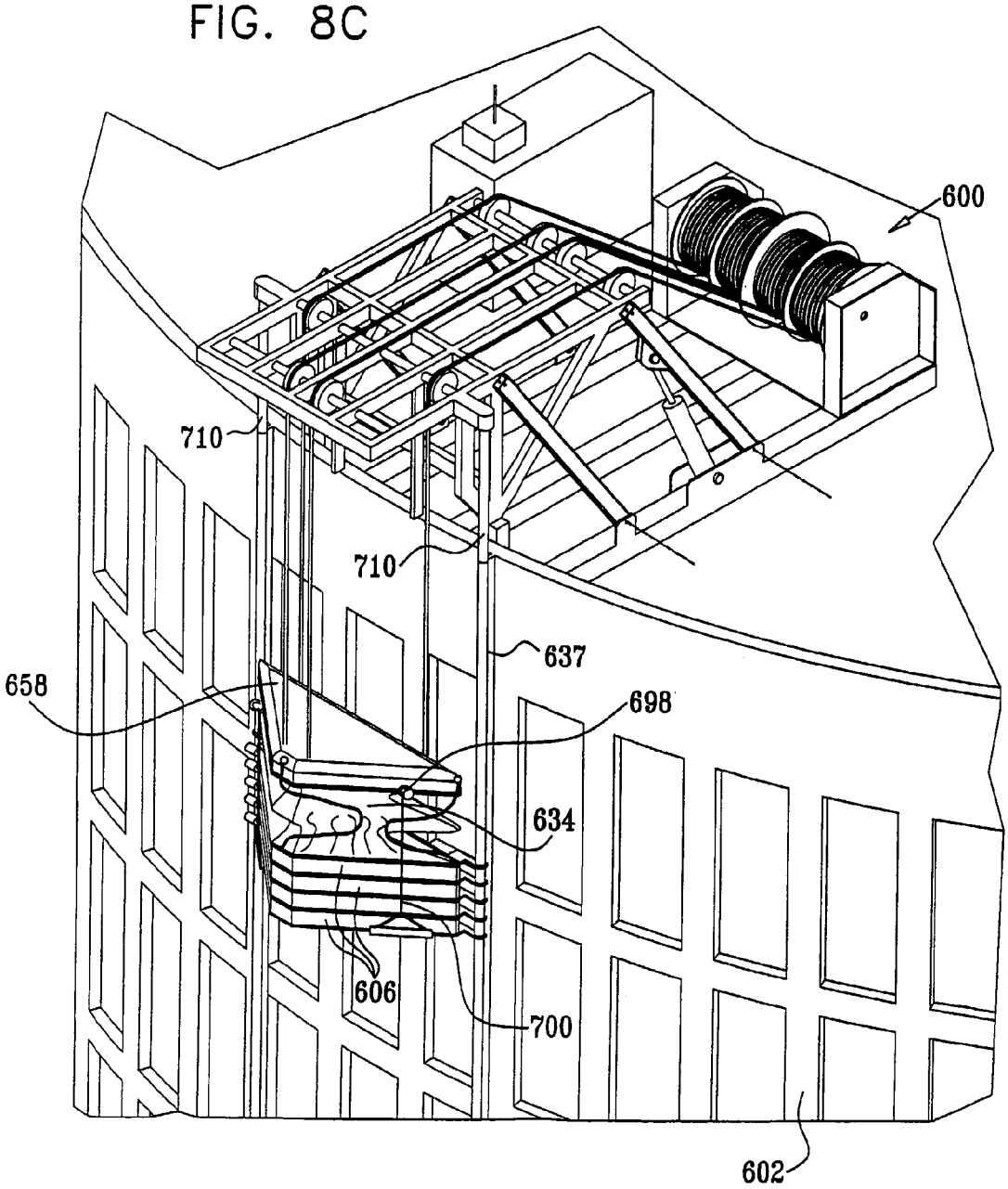
Figure 8D:
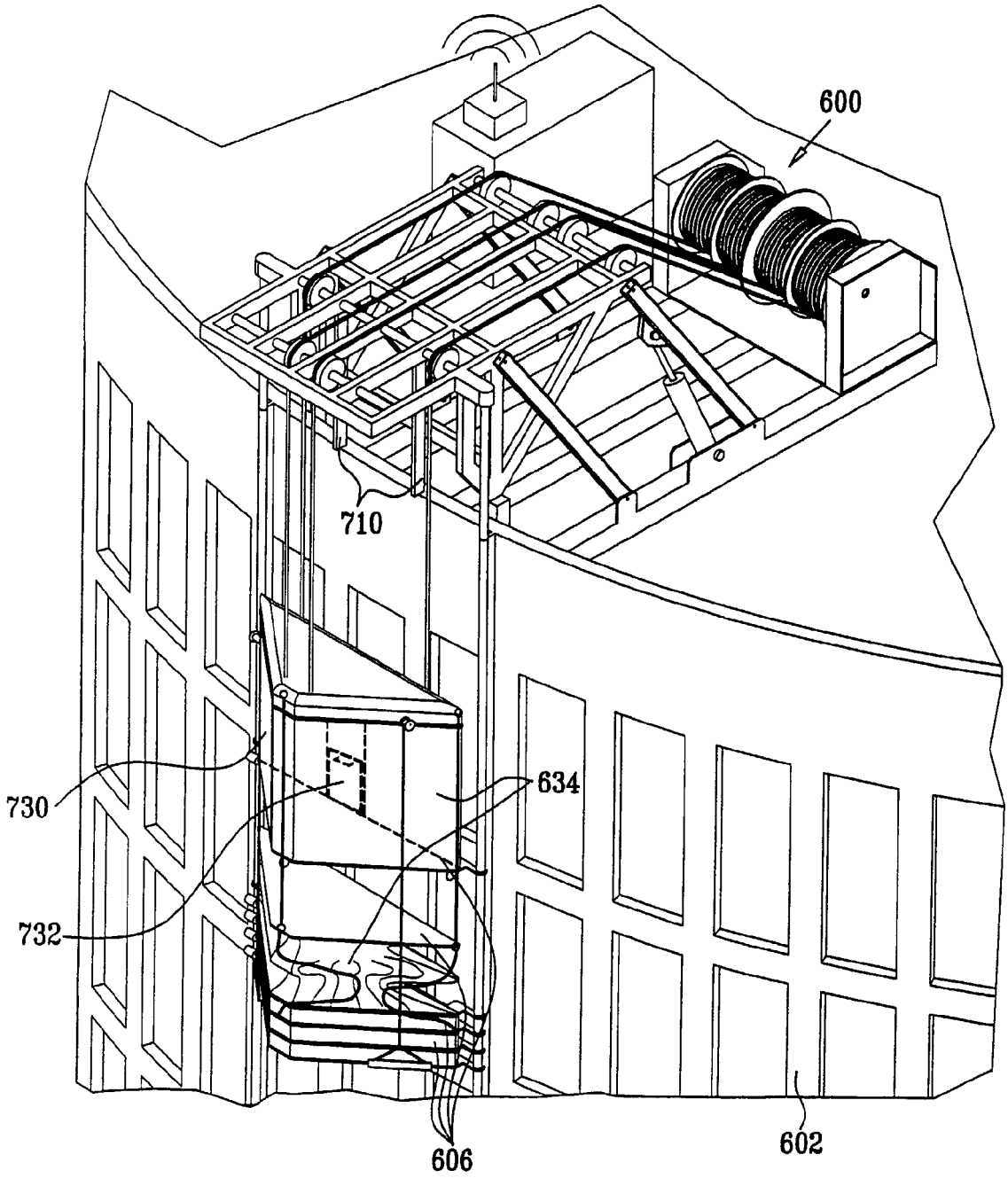
Figure 8E:
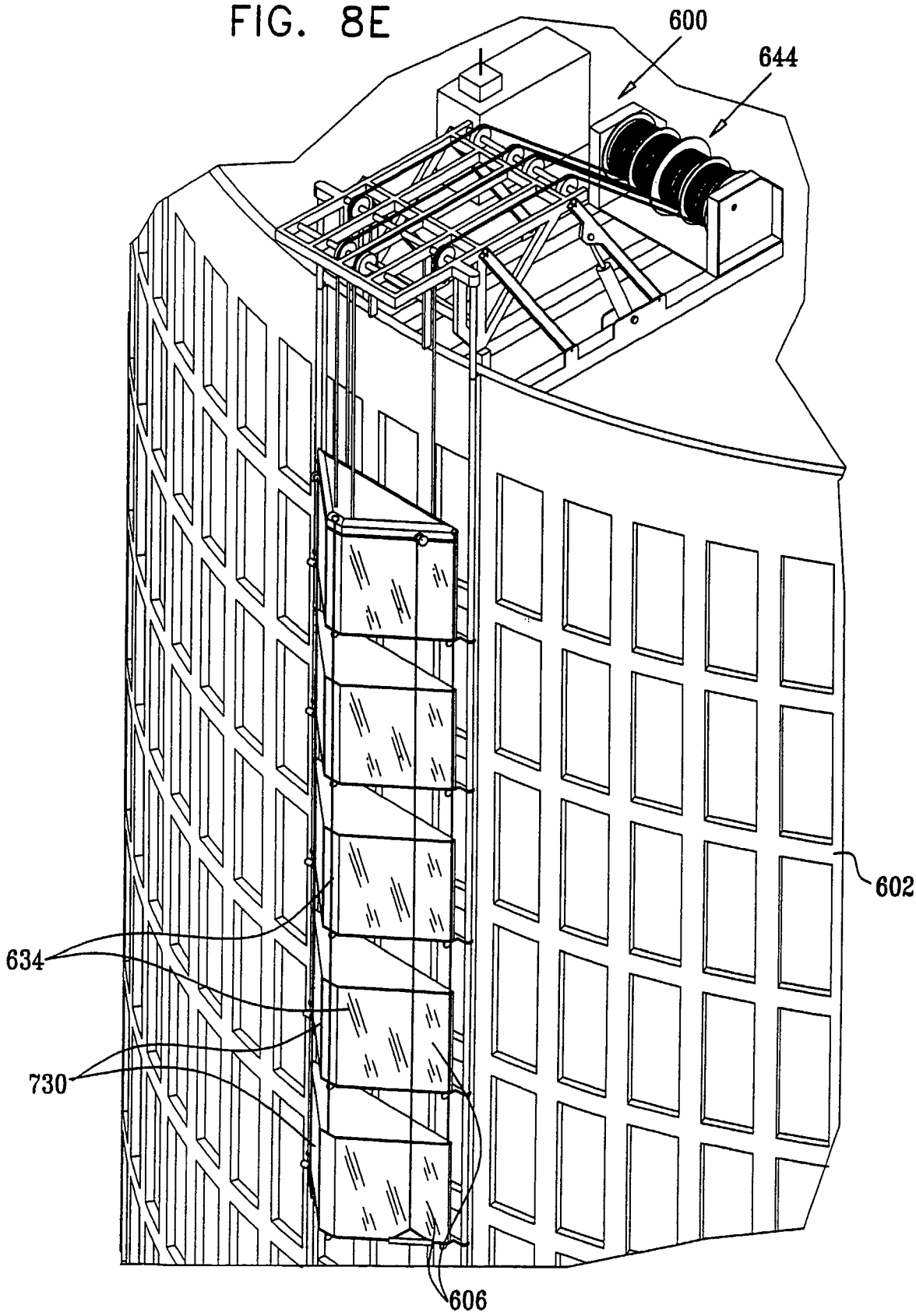
Figure 8F:
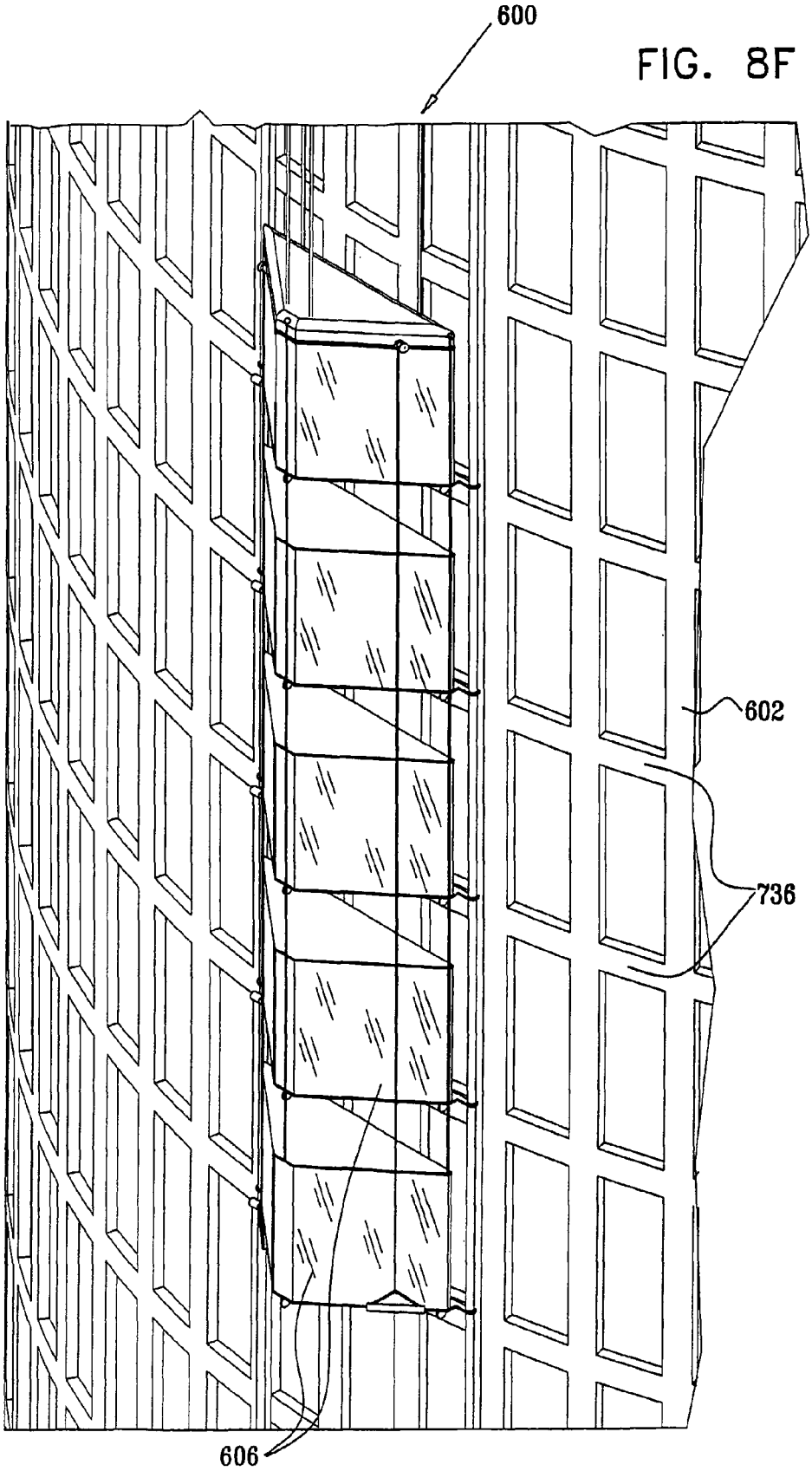
Figure 8G:
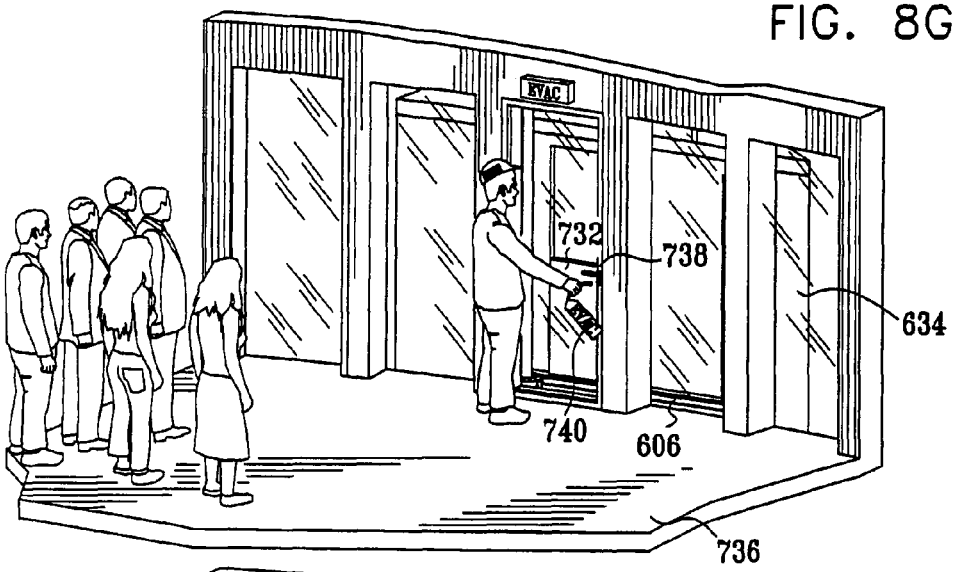
Figure 8H:
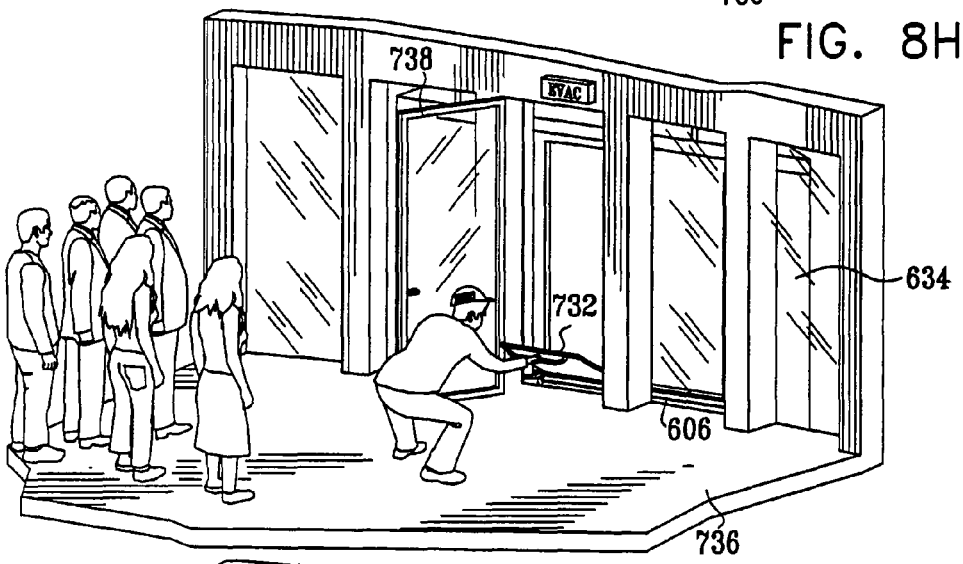
Figure 8I:
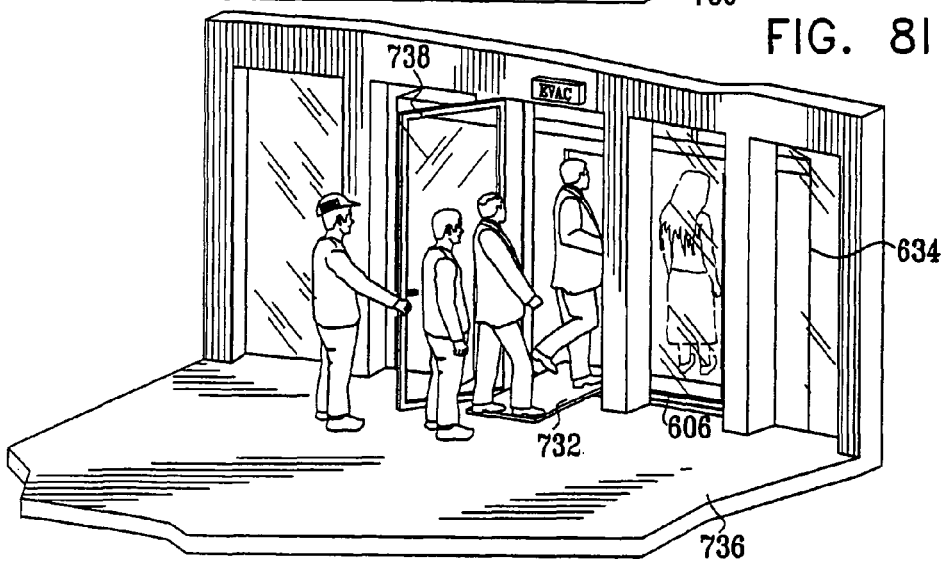
Figure 8J:
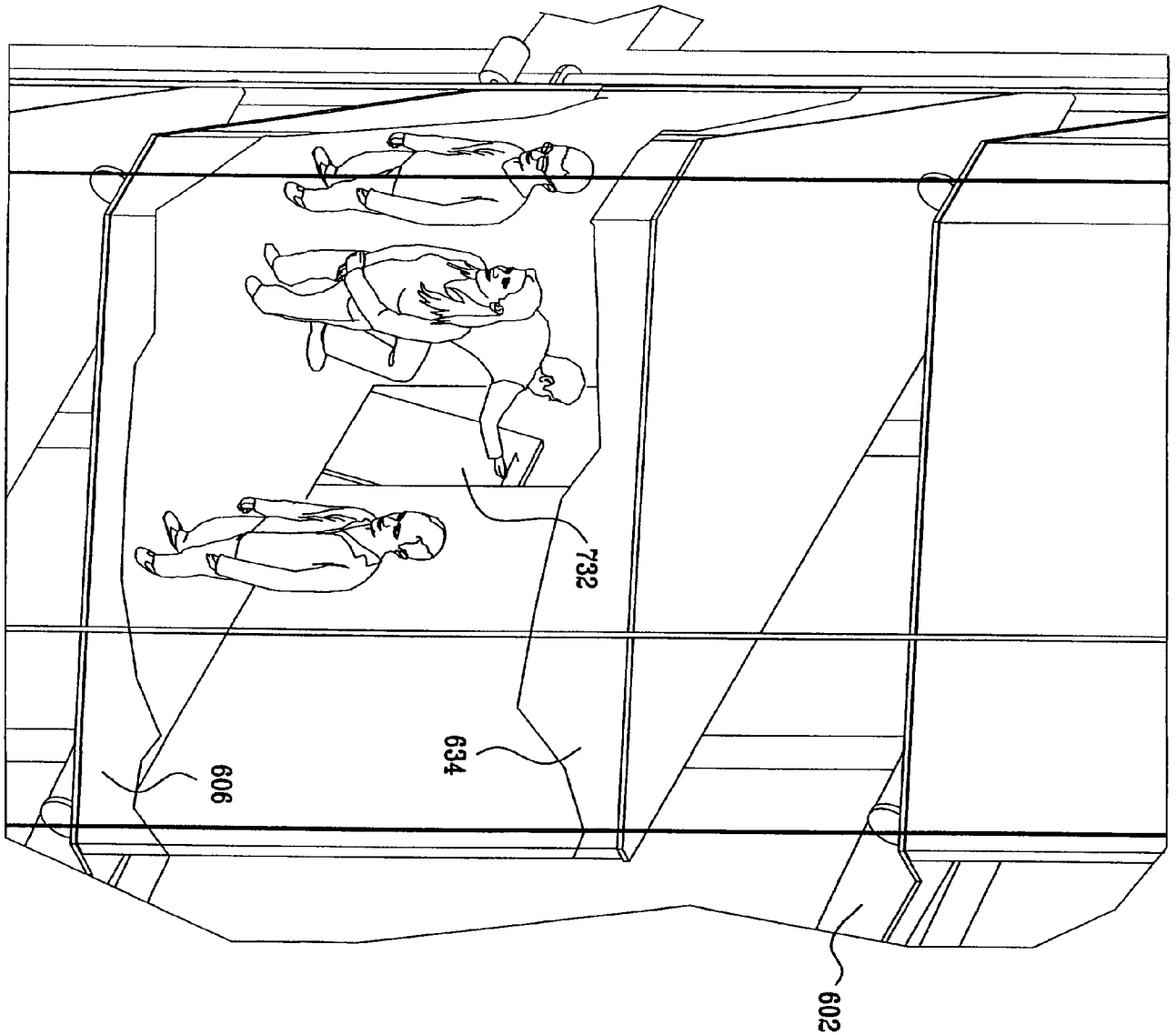
Figure 8K:
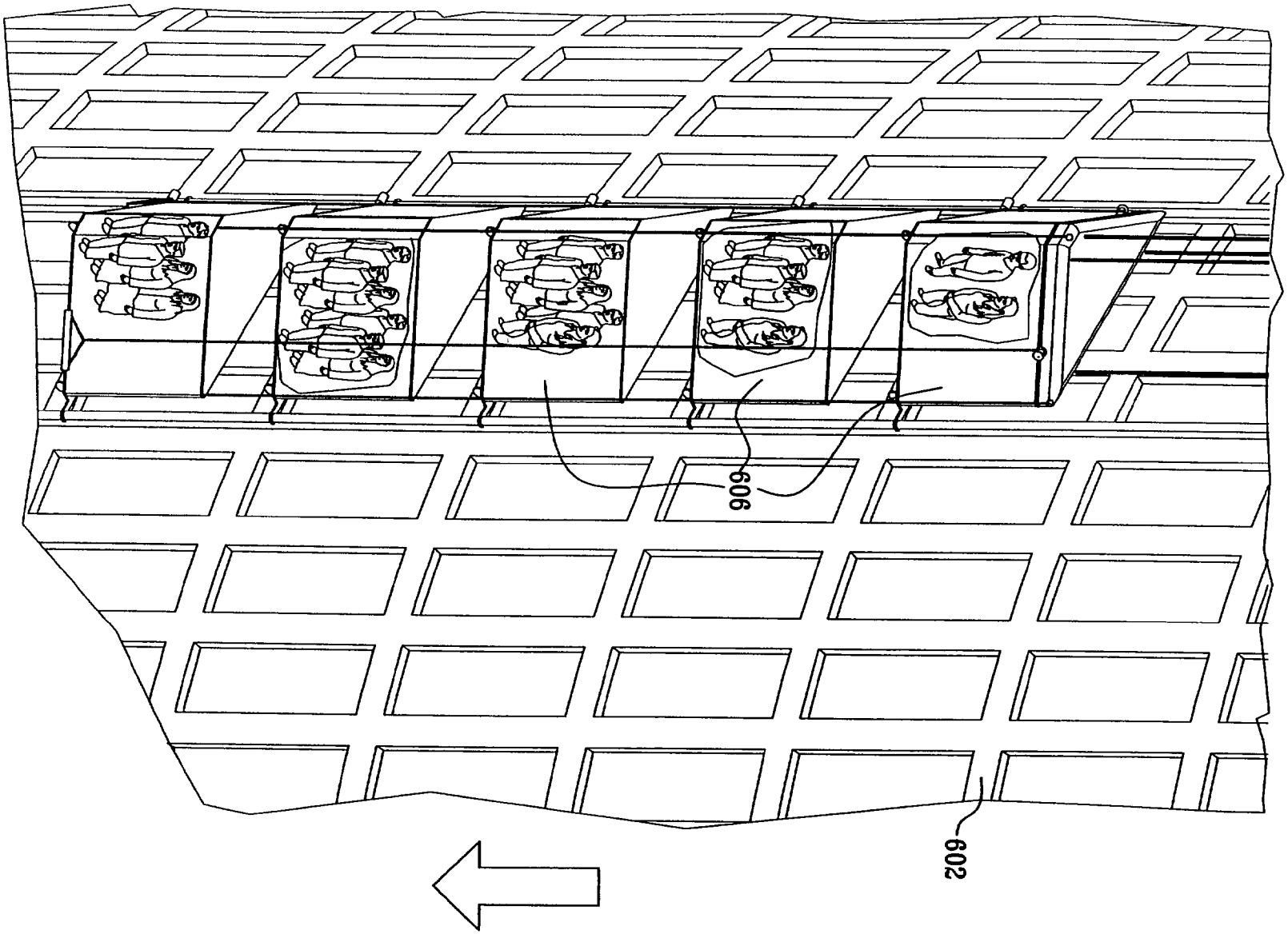
Figure 8L:
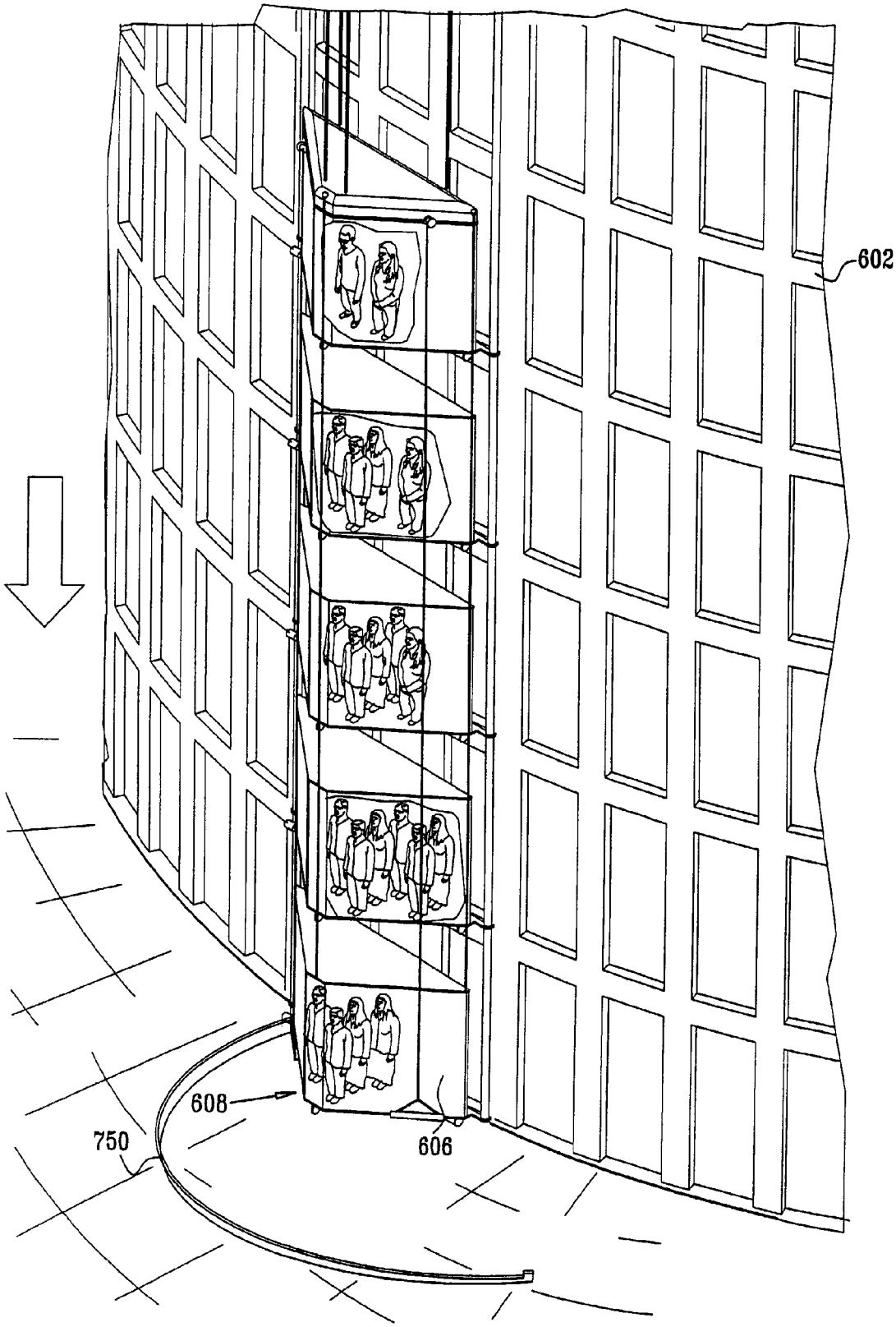
Figure 8M:
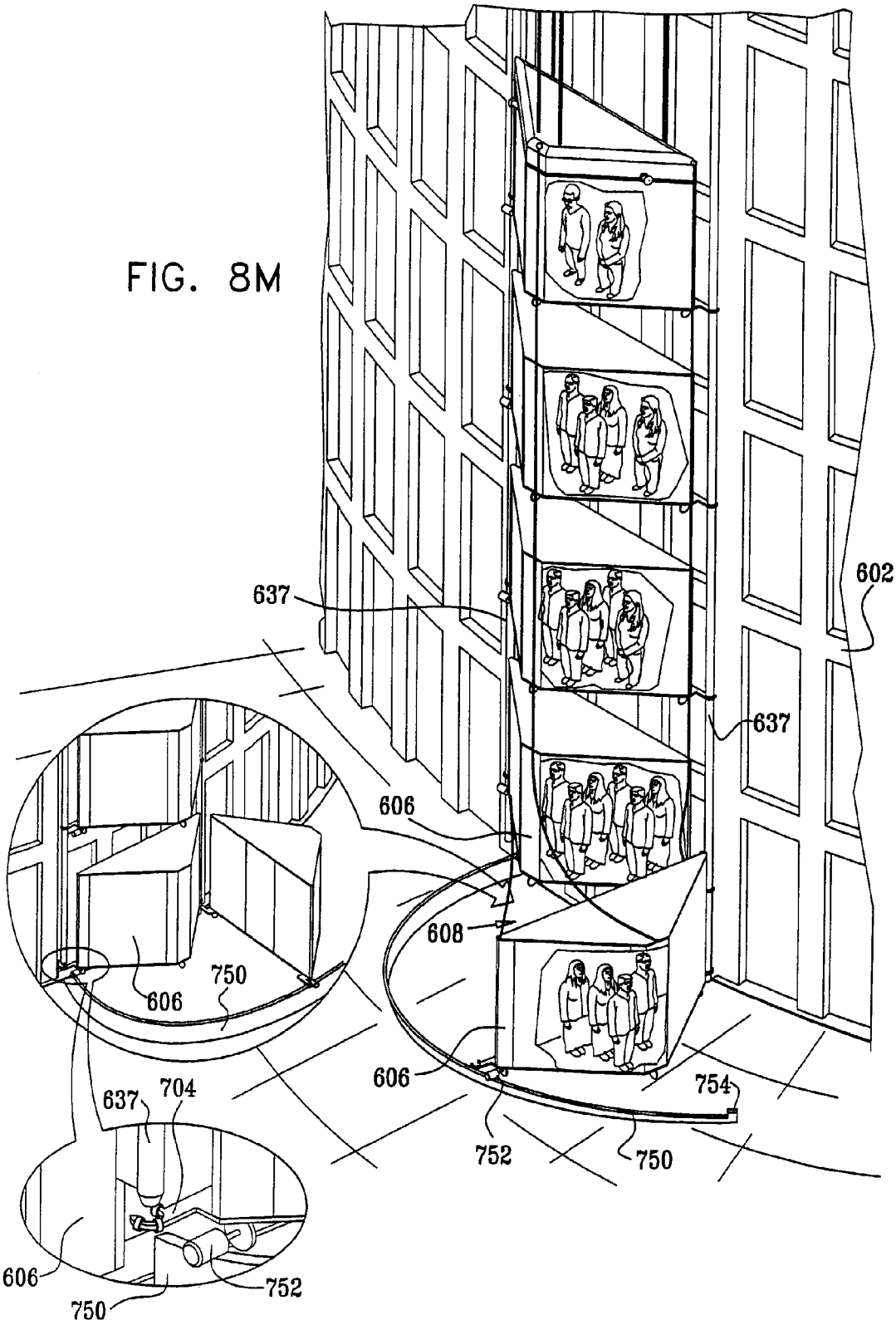
Figure 8N:
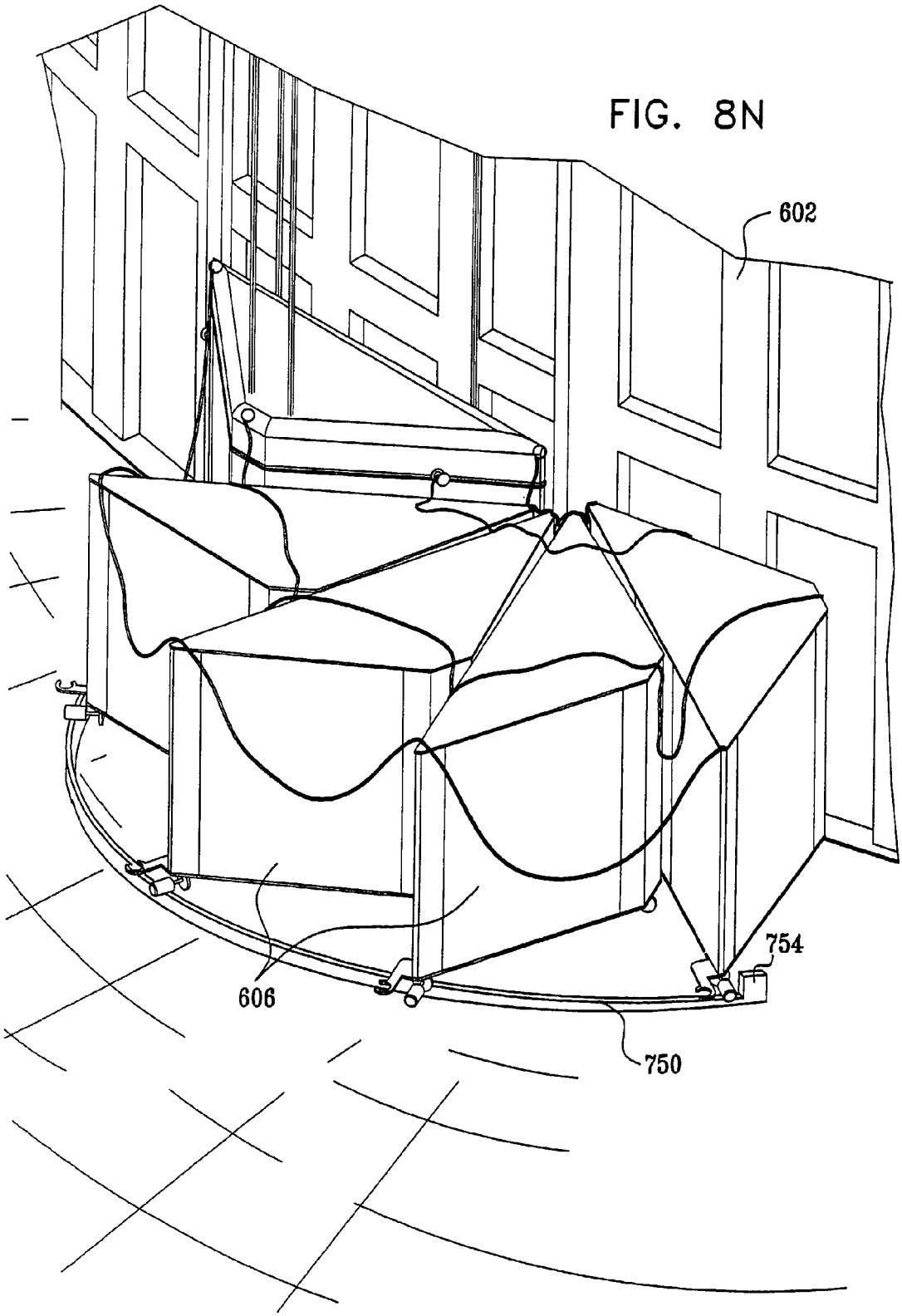
Figure 80:
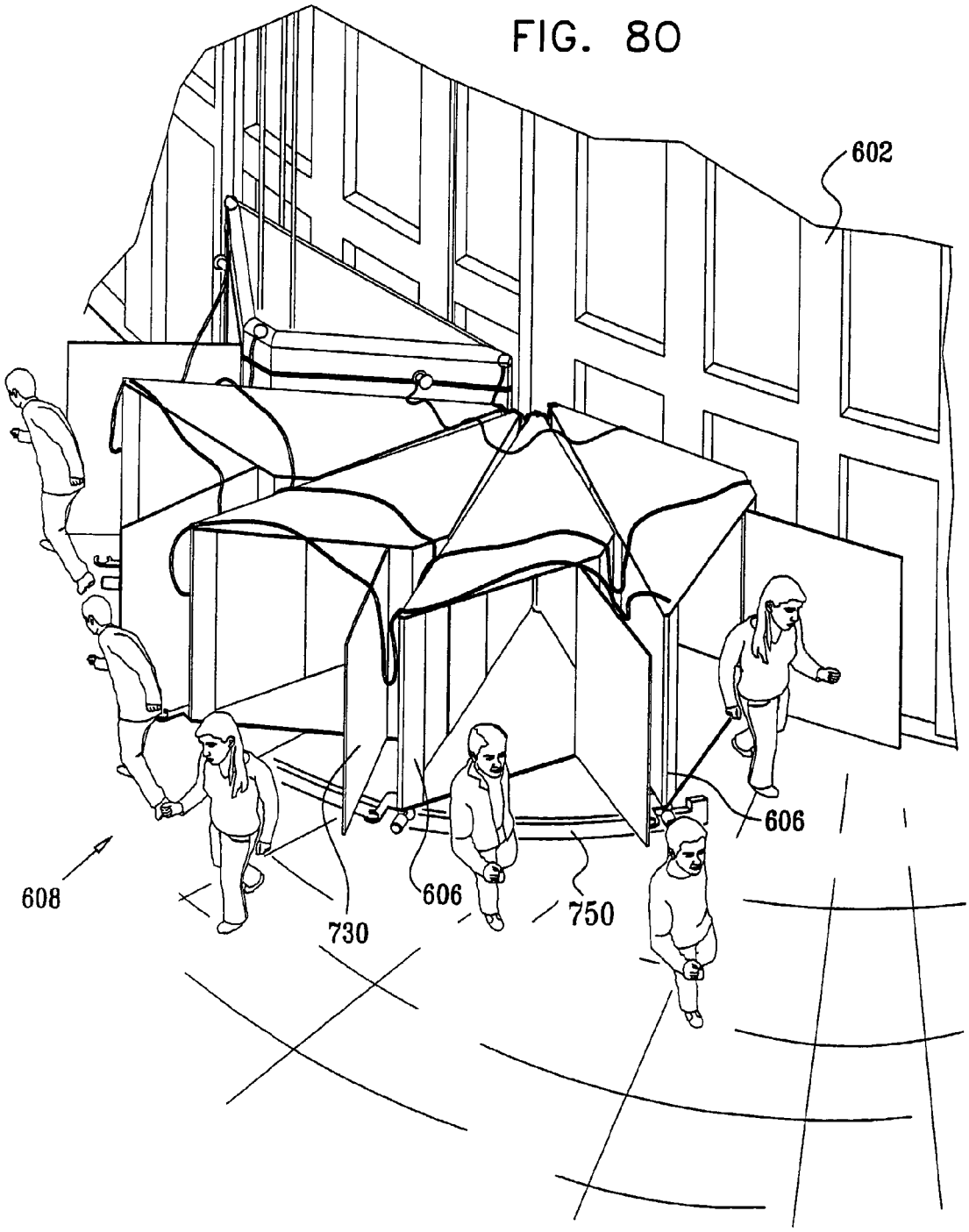

Following egress of evacuated persons from platforms 606, the platforms 606 are arranged in a generally circular side-by-side relationship, as shown with particular clarity in FIG. 8N.

In the illustrated embodiment of FIG. 7, each of the plurality of platforms 606 comprises a generally triangular bottom support surface 632 and a peripheral enclosing element 634, such as a wall element formed of fabric or rigid sheets or a combination thereof, preferably a heat resistant, fire resistant and/or smoke impermeable material. It is appreciated that the platforms 606 need not necessarily be triangular, and that any suitably angled shape of platforms may alternatively be used. Preferably, the interior of peripheral enclosing element 634 is pressurized so as to reduce, insofar as possible, the ingress of smoke and noxious gases thereto. Pressurization is preferably provided by an electrically operated fan, such as a centrifugal blower 635, which is preferably associated with an air filter 636, such an activated carbon filter.

Enclosing element 634 may constitute a protective railing or restraining band rather than a complete wall. Enclosing element 634 is preferably designed to provide low aerodynamic drag to reduce wind forces on the platform 606. Preferably at least one building mounted stabilizing element cooperates with each transporter for stabilizing the transporter against lateral forces, such as wind forces. In the illustrated embodiment, vertical guides 637 which may be rigid or may alternatively be cables, are provided at suitable locations along building 602.

In the embodiment of FIG. 7, where a plurality of transporters 600 are provided, the controller 604 is preferably operative to individually control individual transporters 600 such that multiple platforms 606 of different transporters may be simultaneously positioned in communication with multiple floors of the building, which may or may not be contiguous, for simultaneous evacuation loading.

The transporters may also be employed for lifting persons, such as firefighters or other rescue personnel, and/or equipment, from the egress level or other building levels to multiple levels of the building.

Reference is now made to FIGS. 8A, 8B, 8C, 8D, 8E, 8F, 8G, 8H, 8I, 8J, 8K, 8L, 8M, 8N, 8O, 8P, and 8Q, which illustrate typical operation of the evacuation system of FIG. 7. Turning to FIG. 8A, it is seen that a typical transporter 600 includes a fixed installation, preferably mounted onto the roof 638 of building 602. The fixed installation preferably includes a transporter control subsystem 640 having a wired and/or wireless communication interface 642 and being arranged for interactive data communication with controller 604 (FIG. 7) and/or one or more communicators (not shown) employed by one or more operators, such as operators 622, 624 and 628 (FIG. 7).

Transporter control subsystem 640 operates, using mains power, emergency back-up power and/or a generator, a winch/brake assembly 644, which is preferably hydraulic, electric or of any other suitable type, and a stacked platform deployment assembly (not shown). Preferably, winch/brake assembly 644 includes a conventional hydraulic fluid pump and reservoir assembly, a conventional hydraulic cooling assembly, a conventional hydraulic gear motor assembly and a conventional hydraulic control valve (not shown), which provide power and braking for conventional hydraulic winches associated therewith as well as an emergency hydraulic braking system. Preferably, winch/brake assembly 644 provides braking while transporters 600 are descending and provides lifting power when transporters 600 are ascending.

It is appreciated that in the absence of electrical power, winch/brake assembly 644 is operative to lower platforms 606 of transporter 600 to egress level 608 (FIG. 7) using gravitational force.

Preferably four cables 650, 652, 654 and 656 are wound on winch/brake assembly 644 and extend to four mutually spaced locations on a transporter top frame 658. Each of cables 650, 652, 654 and 656 preferably engages a pair of pulleys, here respectively designated by reference numerals 660, 662, 664 and 666, supported onto a pivotably mounted deployment frame 668. Deployment frame 668 is pivotably mounted for rotation about axes 670 and 671 defined by a static support frame 672. Selectable pivotal orientation of deployment frame 668 preferably is provided by a pair of hydraulic pistons 674.

Turning to the platform deployment assembly, mounted onto transporter top frame 658 is a stacked platform selectable release assembly (not shown), which preferably comprises a wireless control communicator (which is similar to wireless control communicator 192 of PCT application PCT/IL2003/00080986 incorporated herein by reference) which, inter alia, governs the operation of a stacked platform selectable release motor/brake assembly (similar to motor/brake assembly 194 PCT application PCT/IL2003/00080986) which operates a rotatable shaft (similar to rotatable shaft 196 of PCT application PCT/IL2003/00080986), onto ends of which are mounted pulleys 698. Preferably cables 700 are wound onto pulleys 698. These cables are coupled to the lowest platform 606 such that deployment of platforms 606 is governed by the motor/brake assembly.

FIG. 8A shows a plurality of stacked platforms 606 held tightly below transporter top frame 658 by cables 700. Each of the stacked platforms 606 preferably include a pair of building mounted guide riding assemblies (not shown in FIG. 8A), which are adapted for vertically slidable operative engagement with building mounted vertical rails or guides, such as building mounted vertical guides 637. As will be described hereinbelow in greater detail, each of the stacked platforms 606 includes a selectably positionable evacuation bridge (not shown in FIG. 8A).

Reference is now made to FIG. 8B, which illustrates the mechanism of FIG. 8A following lateral and downwardly vertical displacement of transporter top frame 658 and stacked platforms 606 provided by rotation of deployment frame 668 about axes 670 and 671 produced by maximum retraction of pistons 674 to an orientation, shown in FIG. 8B, wherein locating pins 702 on deployment frame 668 are seated in sockets 703 on static frame 672. FIG. 8B additionally illustrates initial engagement of building mounted guide riding assemblies 704 with vertical guides 637, resulting inter alia from lowering of platforms 606 together with transporter top frame 658 produced by playing out of cables 650, 652, 654 and 656 by winch/brake assembly 644. It is seen that assemblies 704 preferably include at least three rollers 706 mounted on a generally peripheral support. Preferably directing rods 710 mounted on deployment frame 668 direct platforms 606 to ensure correct engagement between assemblies 704 and vertical guides 637.

Reference is now made to FIG. 8C, which illustrates the mechanism of FIG. 8B following lowering of platforms 606 relative to transporter top frame 658 produced by unwinding of cables 700 from pulleys 698. It is seen that peripheral enclosing element 634 is beginning to be unfolded in an accordion-like manner.

As seen in FIG. 8C, It is also seen that support cables 722 interconnect the transporter top frame 658 and the platform 606 lying therebelow with the top of the next individual stacked platform and similar support cables interconnect the individual stacked platforms 606 with each other and support their weight and the weight of loads applied thereto. When the platforms 606 are in a stacked orientation as shown in FIGS. 8A & 8B, the support cables 722 are not visible, however, when the platforms 606 are fully deployed at their intended spaced mutual orientations, the support cables are tensioned and define the spacing between vertically adjacent platforms 606.

Reference is now made to FIG. 8D, which illustrates a topmost platform 606 of a transporter 600 being fully deployed and its peripheral enclosing element 634 being fully tensioned, with the remaining platforms 606 and peripheral enclosing elements 634 being in a stacked not-yet fully deployed orientation. It is seen that peripheral enclosing element 634 includes an egress opening 730 and has associated therewith a selectably positionable evacuation bridge 732, preferably in an upright orientation. It is appreciated that the peripheral enclosing element 634 is maintained in its open orientation by structural locking thereof.

FIG. 8E illustrates transporter 600 when all of the platforms 606 have been fully deployed and peripheral enclosing elements 634 of each platform 606 are fully tensioned. Normally deployment of each platform 606 and tensioning of its peripheral enclosing element takes place sequentially from the top to the bottom of the transporter. It is seen that each peripheral enclosing element 634 includes an egress opening 730 and has associated therewith the selectably positionable evacuation bridge, preferably in an upright orientation. It is appreciated that the peripheral enclosing element 634 of each platform 606 is maintained in its open orientation by structural locking thereof.

FIG. 8F shows the fully deployed platforms 600 being lowered, preferably by action of winch/brake assembly 644 (FIG. 8E) into a desired vertical position relative to building 602, such that each of platforms 606 is properly aligned with a separate building floor, here designated by reference numeral 736.

Reference is now made to FIG. 8G, which illustrates a platform 606 deployed in proper vertical alignment with a building floor 736, such that evacuation bridge 732 is positioned opposite an emergency evacuation door 738. An authorized individual, such as an evacuation team leader, typically employs an evacuation emergency key 740 to open emergency evacuation door 738. FIG. 8H shows the evacuation team leader positioning evacuation bridge 732, while FIG. 8I shows evacuation of persons from building floor 736 onto platform 606 within peripheral enclosing element 634. It is appreciated that evacuation of multiple building floors onto multiple platforms 606 of one or more transporters 600 may take place simultaneously.

Reference is now made to FIG. 8J, which shows the evacuation team leader folding up the evacuation bridge 732. It is appreciated that the evacuation team leader may then secure the evacuation bridge 732 to the peripheral enclosing element 734 to serve as a security gate.

FIG. 8K illustrates lowering of a loaded transporter from its loading position toward an egress location.

Reference is now made to FIG. 8L, which illustrates the lowest platform 606 being lowered to the egress level 608 into engagement with a semi-circular inclined and thus gravitationally operative displacement track 750.

FIG. 8M illustrates the next lowest platform 606 being lowered to the egress level 608 as the lowest platform slides along displacement track 750 on rollers 752, such that one side of lowest platform 606 is out of engagement with the left vertical guide 637 and extends outwardly from building 602, resulting in pivotal movement of lowest platform 606 with respect to the right sided vertical guide 637. It is appreciated that the motion of the lowest platform 606 along track 750 is fast enough to provide clearance for the following platforms to reach the track.

It is appreciated that the displacement track 750 may not be inclined, and motion of the lowest platform 606 along the displacement track may then be achieved by mounting a motor on platform 606, by having an operator use a pulley to pull the platform along the track, or in any other suitable way.

It is additionally appreciated that rollers 752 are formed with a slight groove, such that the remain on the track 750 and are not inadvertently displaced sideways on the track.

FIG. 8N shows the sequential lowering and concomitant pivotal displacement of the platforms 606, with the lowest platform 606 coming to rest at the end of inclined track 750, at a location defined by stoppers 754. As seen in FIG. 8N, the platforms 606 are arranged in a semi-circle near the base of building 602. FIG. 8O shows all of the platforms 606 at the egress level 608. Egress of persons from all of the platforms 606 via egress openings 730 takes place generally simultaneously, as shown in FIG. 8O.

Figure 8P:
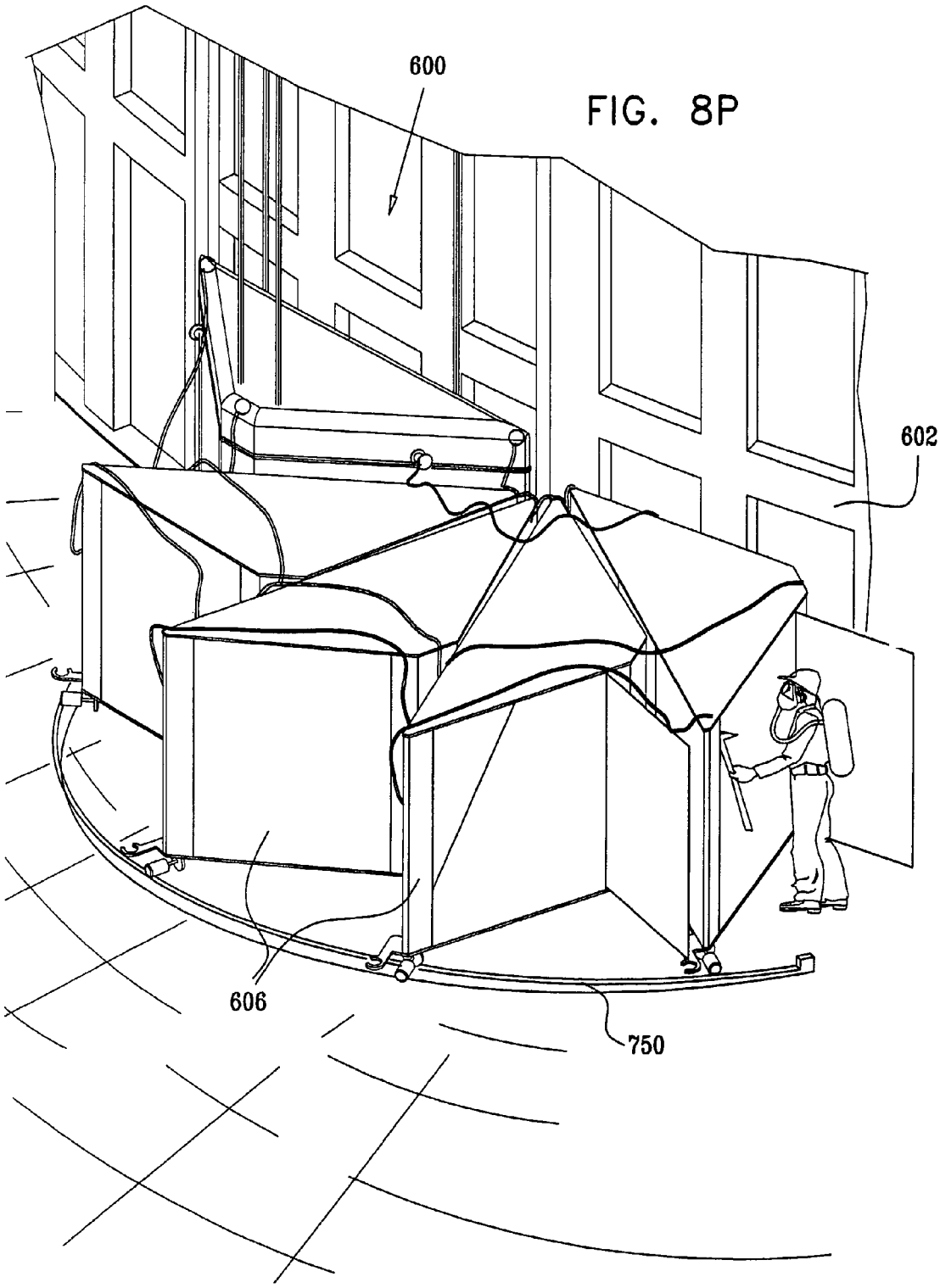
Figure 8Q:
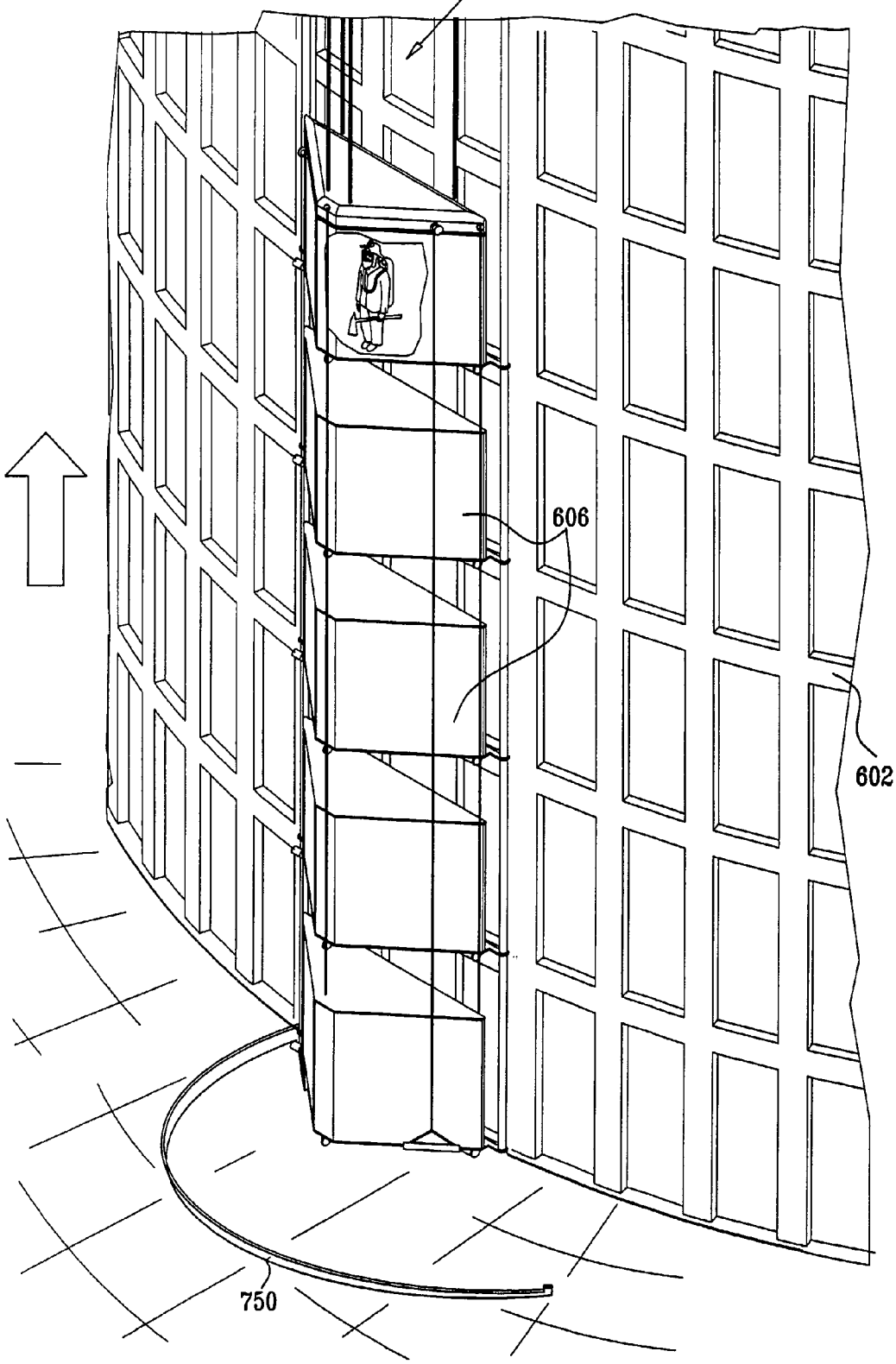

It is appreciated that the transporter 600 may be employed for raising rescue personnel or firefighters to selected floors of building 602, as shown in FIGS. 8P and 8Q.

Figure 9:
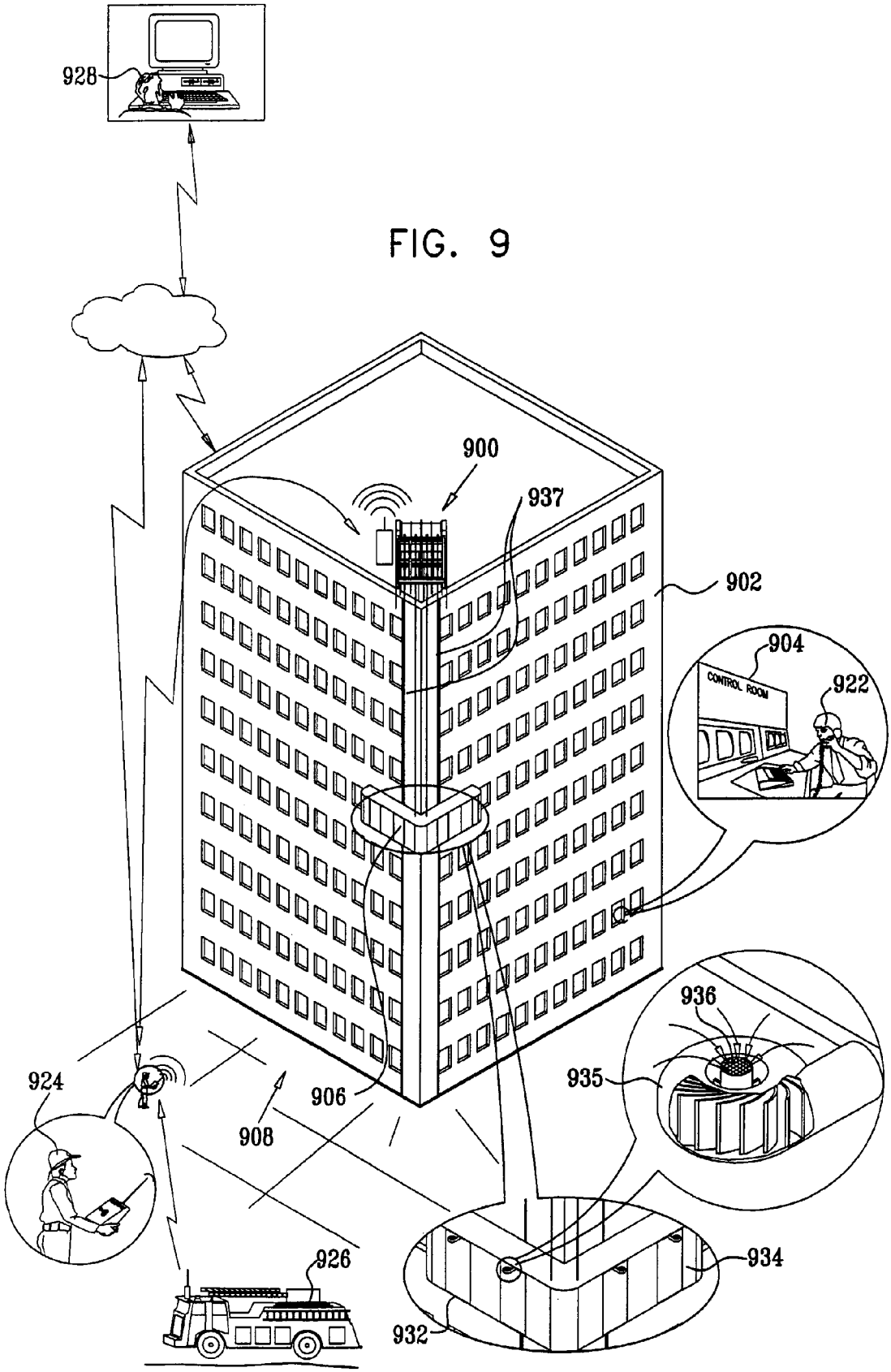
FIG. 9 is a simplified pictorial illustration of a building equipped with an escape system constructed and operative in accordance with yet another preferred embodiment of the present invention.

Reference is now made to FIG. 9, which is a simplified pictorial illustration of a building equipped with an escape system constructed and operative in accordance with yet another preferred embodiment of the present invention. As seen in FIG. 9, there is provided an evacuation system for a building preferably comprising a selectably lowerable generally vertical transporter 900, arranged for selectable communication with multiple floors of a building 902. Control outputs preferably provided by a central controller 904 or alternatively by multiple controllers, each assignable to a given transporter 900, selectably lower a platform 906 of the transporter 900 to at least one egress level 908 at which egress of persons may safely occur. It is appreciated that a given building, such as building 902, may include one or more transporters 900.

Human control inputs to controller 904 or directly to transporter 900 may be provided, for example, by one or more of an operator 922 at the controller 904, an operator 924 on the ground, an operator in a fire engine 926 and a remote operator 928, communicating via a data network, such as the Internet or an emergency network.

As seen in FIG. 9, platform 906 is arranged to be supported on multiple generally vertical supports. Platform 906 is preferably a relatively large platform, as compared with the platforms in the above-described embodiments and preferably has multiple ingress and egress openings, as will be described hereinbelow. In the illustrated embodiment, platform 906 conforms generally to the shape of the building 902, such as the corner of a building having a generally rectangular cross section, but this need not necessarily be the case.

In the illustrated embodiment of FIG. 9, the platform 906 preferably comprises a bottom support surface 932 and a peripheral enclosing element 934, such as a wall element formed of fabric or rigid sheets or a combination thereof, preferably a heat resistant, fire resistant and/or smoke impermeable material. Enclosing element 934 may constitute a protective railing or restraining band rather than a complete wall. Preferably, the interior of peripheral enclosing element 934 is pressurized so as to reduce, insofar as possible, the ingress of smoke and noxious gases thereto. Pressurization is preferably provided by an electrically operated fan, such as a centrifugal blower 935, which is preferably associated with an air filter 936, such an activated carbon filter.

Enclosing element 934 is preferably designed to provide low aerodynamic drag to reduce wind force on the platform 906. Preferably at least one building mounted stabilizing element cooperates with each transporter for stabilizing the transporter against lateral forces, such as wind forces. In the illustrated embodiment, vertical guides 937 are provided at suitable locations along building 902.

Where a plurality of transporters 900 are provided, the controller 904 is preferably operative to individually control individual transporters 900 such that multiple platforms 906 of different transporters may be simultaneously positioned in communication with one or more floors of the building for simultaneous evacuation loading. The floors may or may not be contiguous.

The transporters may also be employed for lifting persons, such as firefighters or other rescue personnel, and/or equipment, from the egress level or other building levels to one or more levels of the building.

Figure 10A:
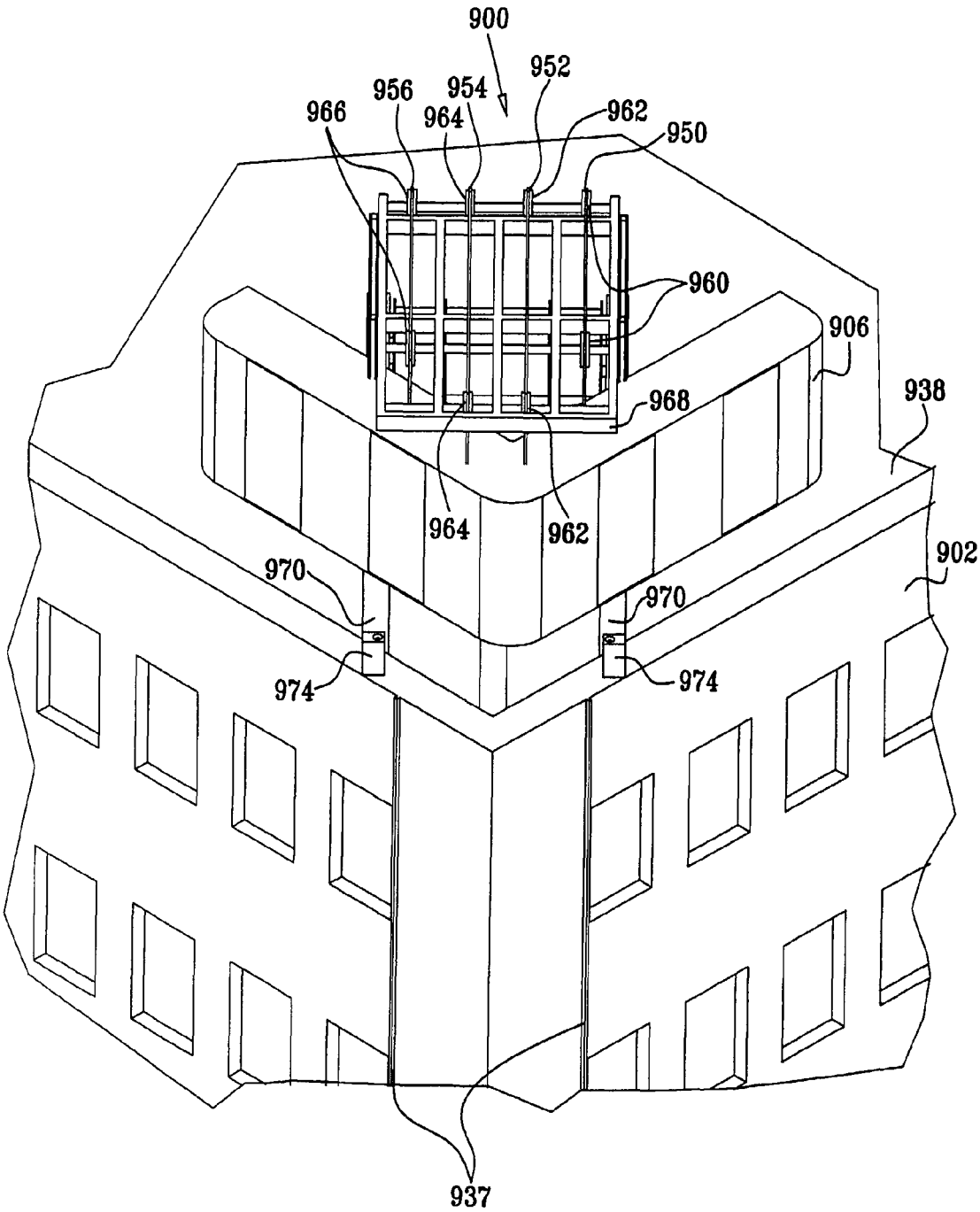

Reference is now made to FIGS. 10A, 10B, 10C, 10D, 10E, 10F, 10G, 10H, 10I, 10J and 10K, which illustrate typical operation of the evacuation system of FIG. 9. Turning to FIG. 10A, it is seen that a typical transporter 900 includes a fixed installation, preferably mounted onto the roof 938 of building 902. The fixed installation preferably includes a transporter control subsystem (not shown) which is similar to transporter control subsystem 140 (FIGS. 2A-2E) having a wired and/or wireless communication interface (not shown) and being arranged for interactive data communication with controller 904 (FIG. 9) and/or one or more communicators (not shown) employed by one or more operators, such as operators 922, 924 and 928 (FIG. 9).

The transporter control subsystem operates, using mains power, emergency back-up power and/or a generator and a winch/brake assembly (not shown) which is similar to winch/brake assembly 144 (FIGS. 2A-2E) and is preferably hydraulic, electric or of any other suitable type. Preferably, the winch/brake assembly includes a conventional hydraulic fluid pump and reservoir assembly, a conventional hydraulic cooling assembly, a conventional hydraulic gear motor assembly and a conventional hydraulic control valve (not shown), which provide power and braking for conventional hydraulic winches associated therewith as well as an emergency hydraulic braking system. Preferably, the winch/brake assembly provides braking while transporter 900 is descending and provides lifting power when transporter 900 is ascending.

It is appreciated that in the absence of electrical power, the winch/brake assembly is operative to lower platform 906 of transporter 900 to egress level 908 (FIG. 9) using gravitational force.

Preferably four cables 950, 952, 954 and 956 are wound on the winch/brake assembly and extend to four mutually spaced locations on platform 906. Each of cables 950, 952, 954 and 956 preferably engages a pair of pulleys, here respectively designated by reference numerals 960, 962, 964 and 966, supported onto a pivotably mounted deployment frame 968. Deployment frame 968 is pivotably mounted for rotation about axes defined by a static support frame 970, which is similar to static support frame 172 (FIGS. 2A-2E). Selectable pivotal orientation of deployment frame 968 preferably is provided by a pair of hydraulic pistons (not shown). Mounted on deployment frame 968 are locating pins (not shown) which are arranged to be seated in corresponding sockets 974.

FIG. 10A shows platform 906, which preferably includes one or more pairs of building mounted guide riding roller assemblies (not shown in FIG. 10A), which are adapted for vertically slidable operative engagement with building mounted vertical rails or guides, such as building mounted vertical guides 937. As will be described hereinbelow in greater detail, platform 906 preferably includes a plurality selectably positionable evacuation bridge (not shown in FIG. 10A).

Figure 10B:
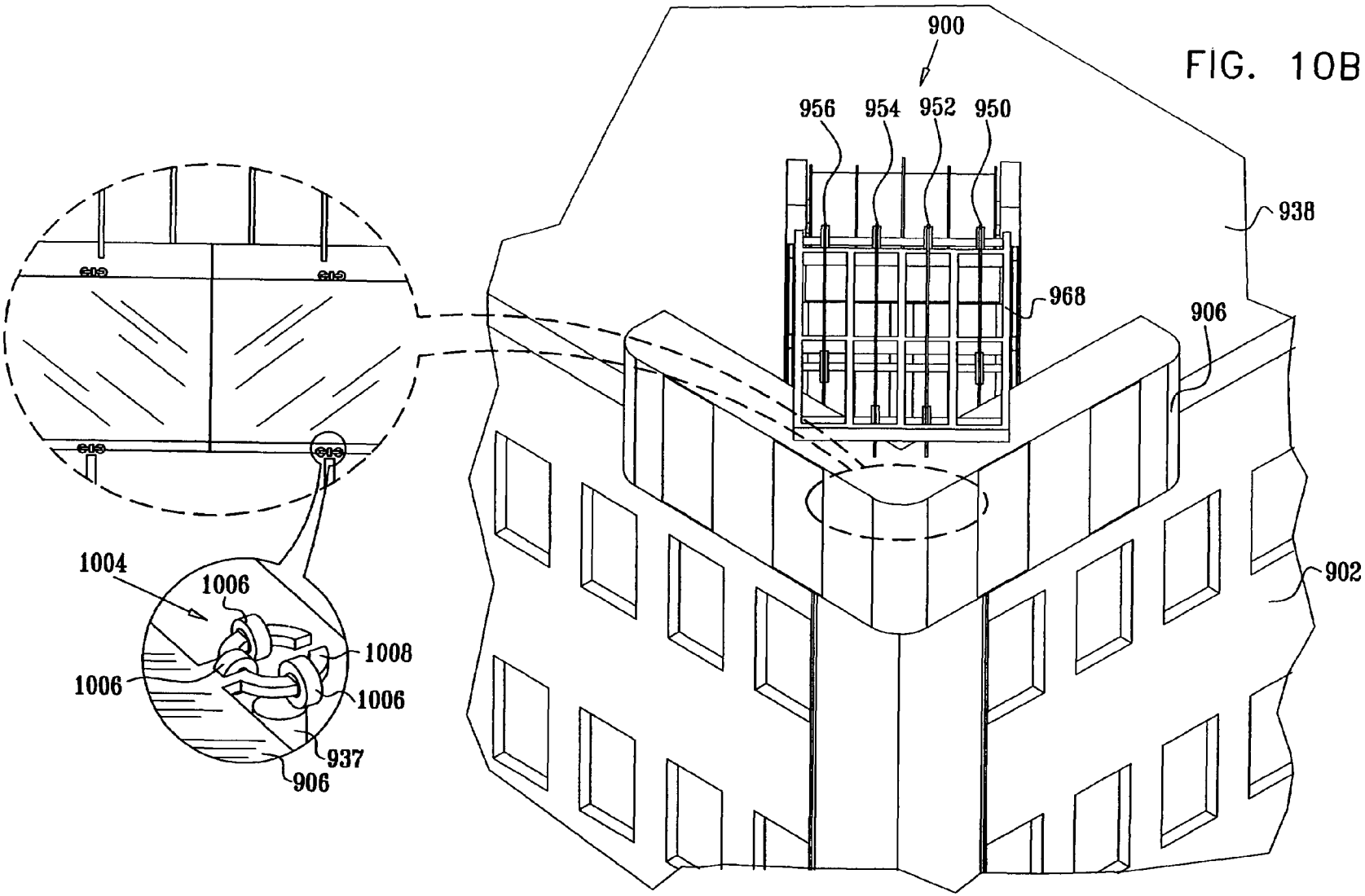

Reference is now made to FIG. 10B, which illustrates the mechanism of FIG. 10A following lateral and downwardly vertical displacement of platform 906 provided by rotation of deployment frame 968 to an orientation, shown in FIG. 10B, wherein the locating pins on deployment frame 968 are seated in sockets 974 (FIG. 10A). FIG. 10B additionally illustrates initial engagement of building mounted guide riding roller assemblies 1004 with vertical guides 937, resulting inter alia from lowering of platform 906 produced by playing out of cables 950, 952, 954 and 956 by the winch/brake assembly. It is seen that assemblies 1004 preferably include at least three rollers 1006 mounted on a generally peripheral support 1008. Preferably directing rods (not shown) mounted on deployment frame 968 direct platforms 906 to ensure correct engagement between assemblies 1004 and vertical guides 937.

Figure 10C:
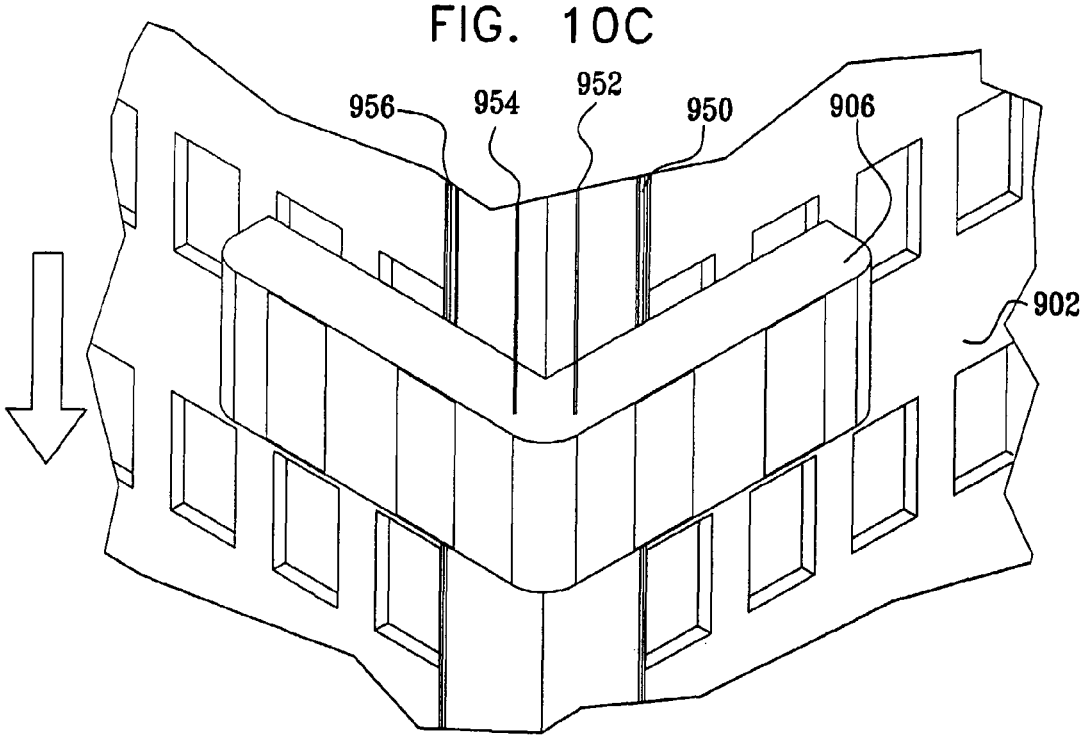

Reference is now made to FIG. 10C, which illustrates the mechanism of FIG. 10B following lowering of platform 906 produced by further unwinding of cables 950, 952, 954 and 956 by the winch/brake assembly.

Figure 10D:
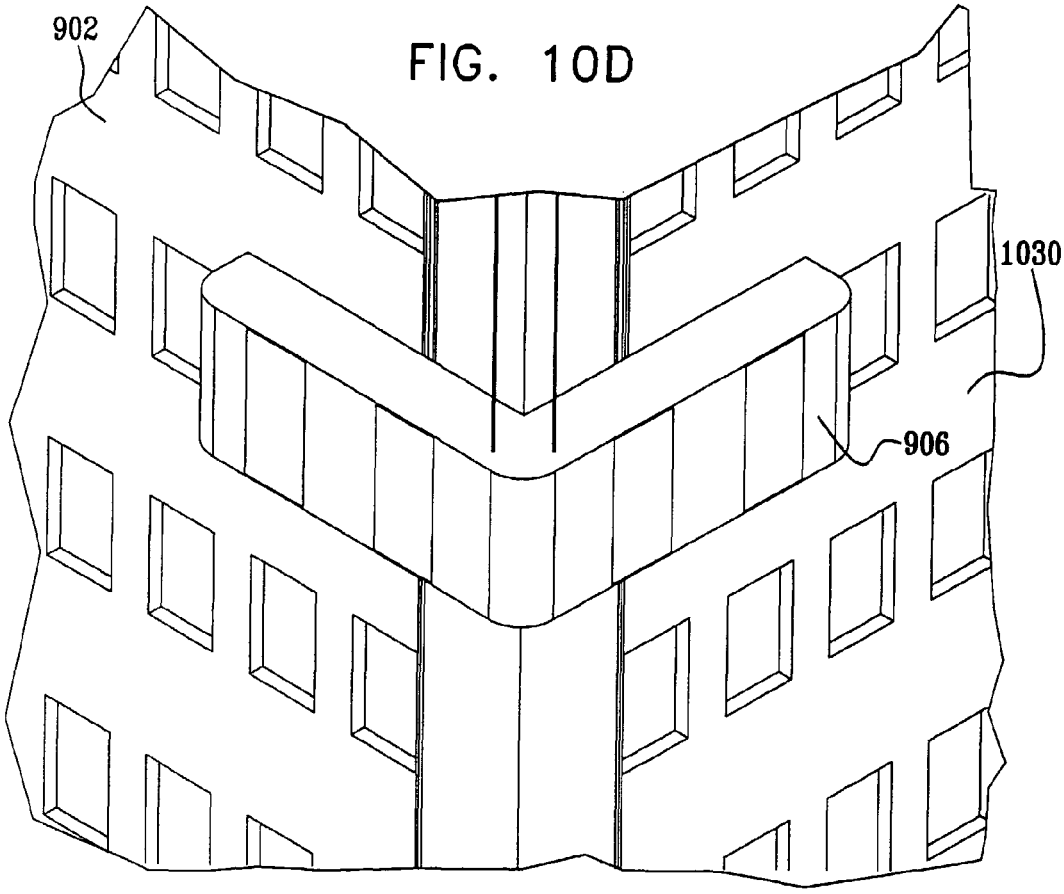

Reference is now made to FIG. 10D, which shows the platform 906 being lowered into a desired vertical position relative to building 902 and properly aligned with a building floor, here designated by reference numeral 1030.

Figure 10E:
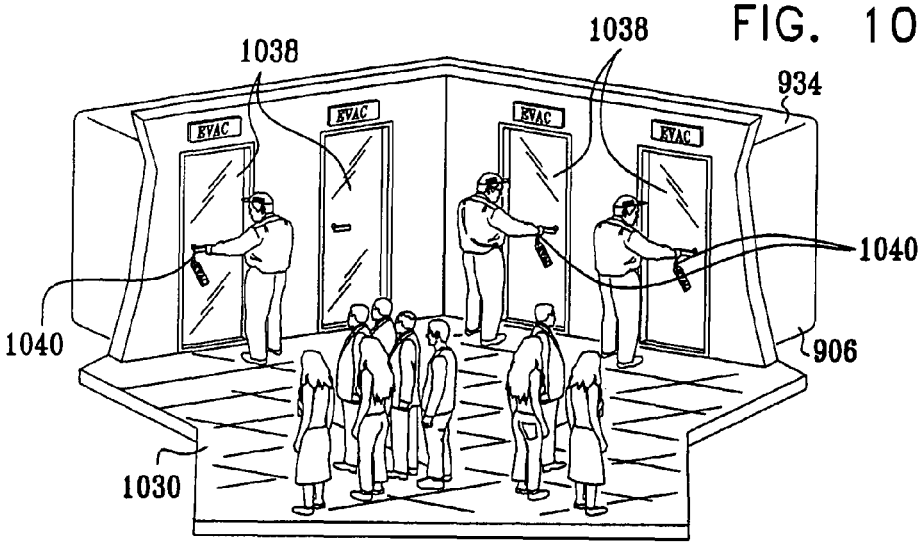

Reference is now made to FIG. 10E, which illustrates platform 906 deployed in proper vertical alignment with building floor 1030, and in alignment with multiple emergency exits pre-defined on building floor 1030. Authorized individuals, such as evacuation team leaders, typically employ evacuation emergency keys 1040 to open emergency evacuation doors 1038.

Figure 10F:
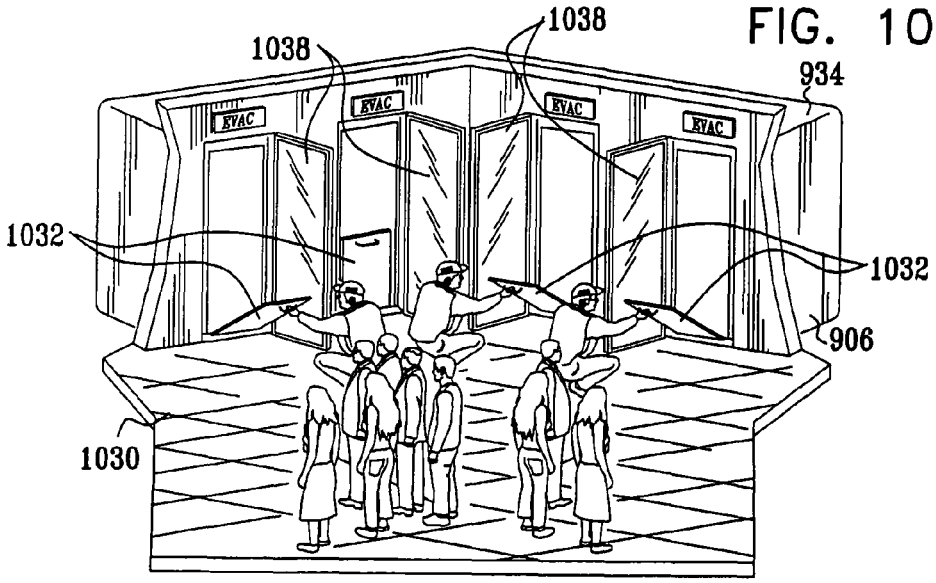
Figure 10G:
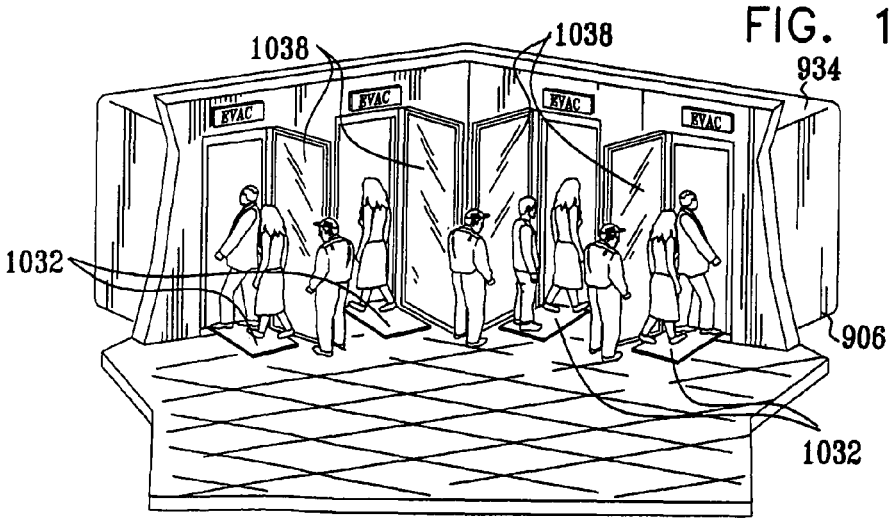

FIG. 10F shows evacuation team leaders positioning evacuation bridges 1032, while FIG. 10G shows evacuation of persons from building floor 1030 onto platform 906 within peripheral enclosing element 934 via multiple emergency evacuation doors 1038 and evacuation bridges 1032. It is appreciated that evacuation of multiple building floors onto platforms 906 of multiple transporters 900 may take place simultaneously.

Figure 10H:
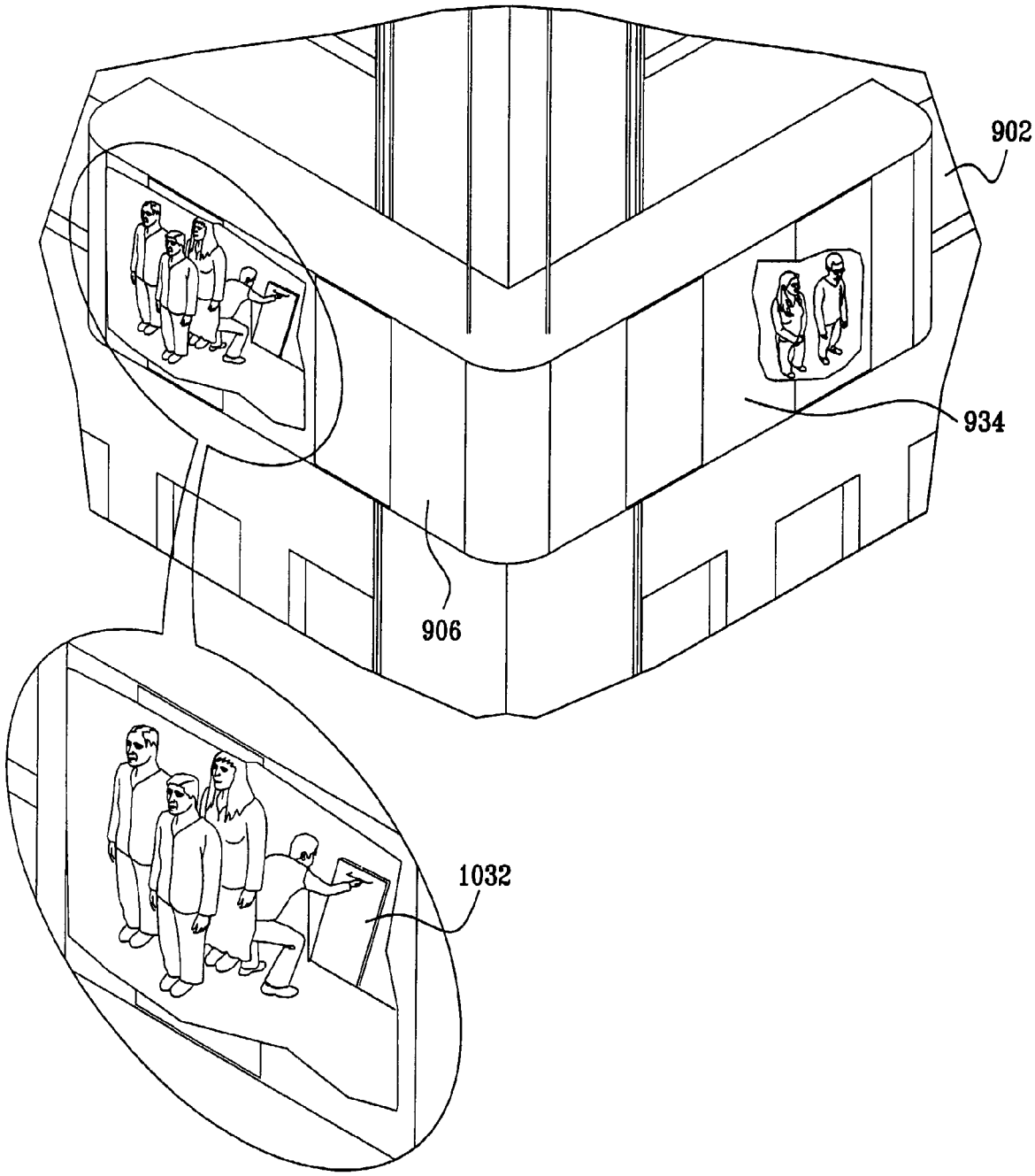
Figure 101:
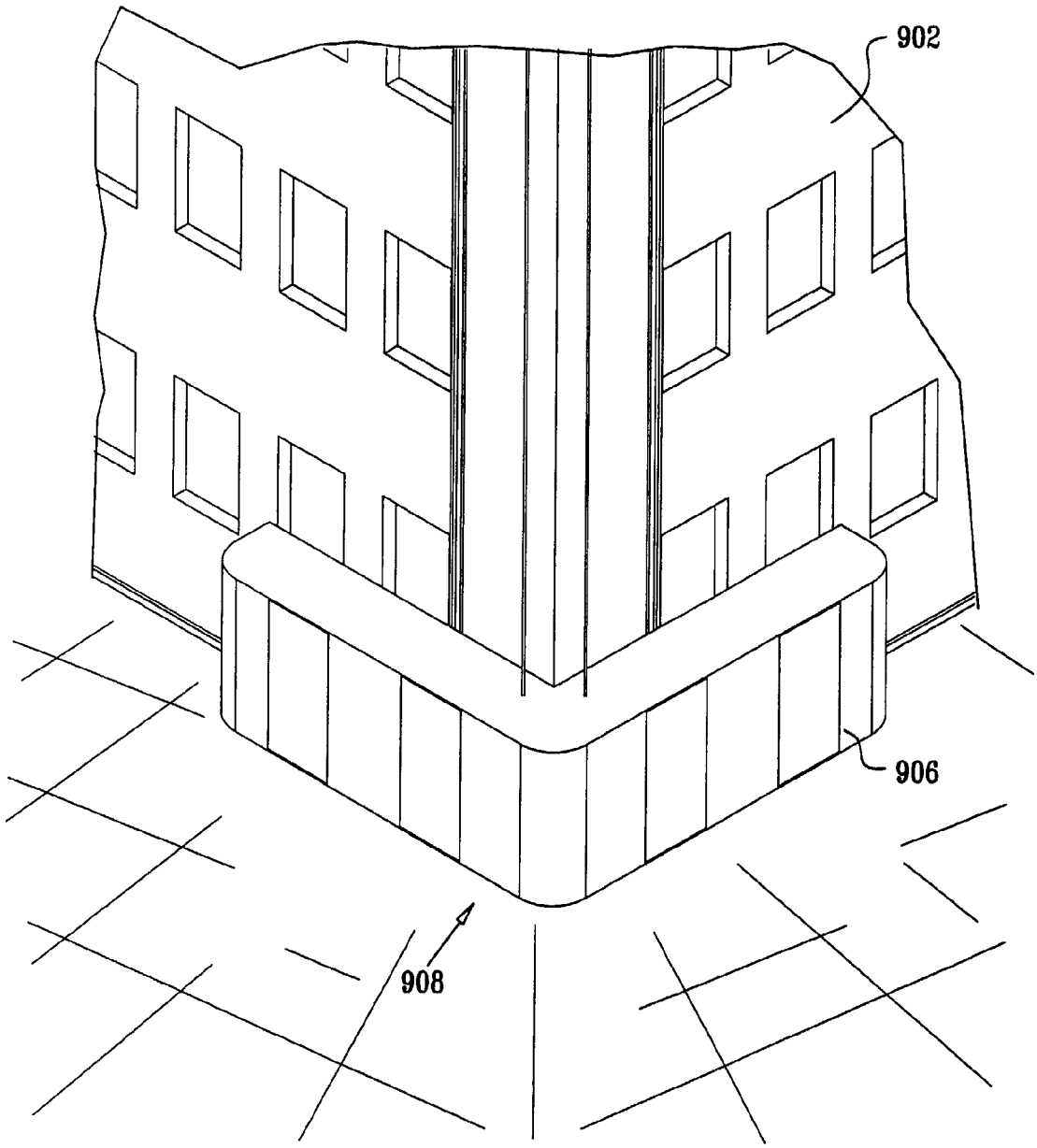

Reference is now made to FIG. 10H, which shows the evacuation team leaders folding up the evacuation bridges 1032. It is appreciated that the evacuation team leader may then secure the evacuation bridge 1032 to the peripheral enclosing element 934 to serve as a security gate.

Figure 10J:
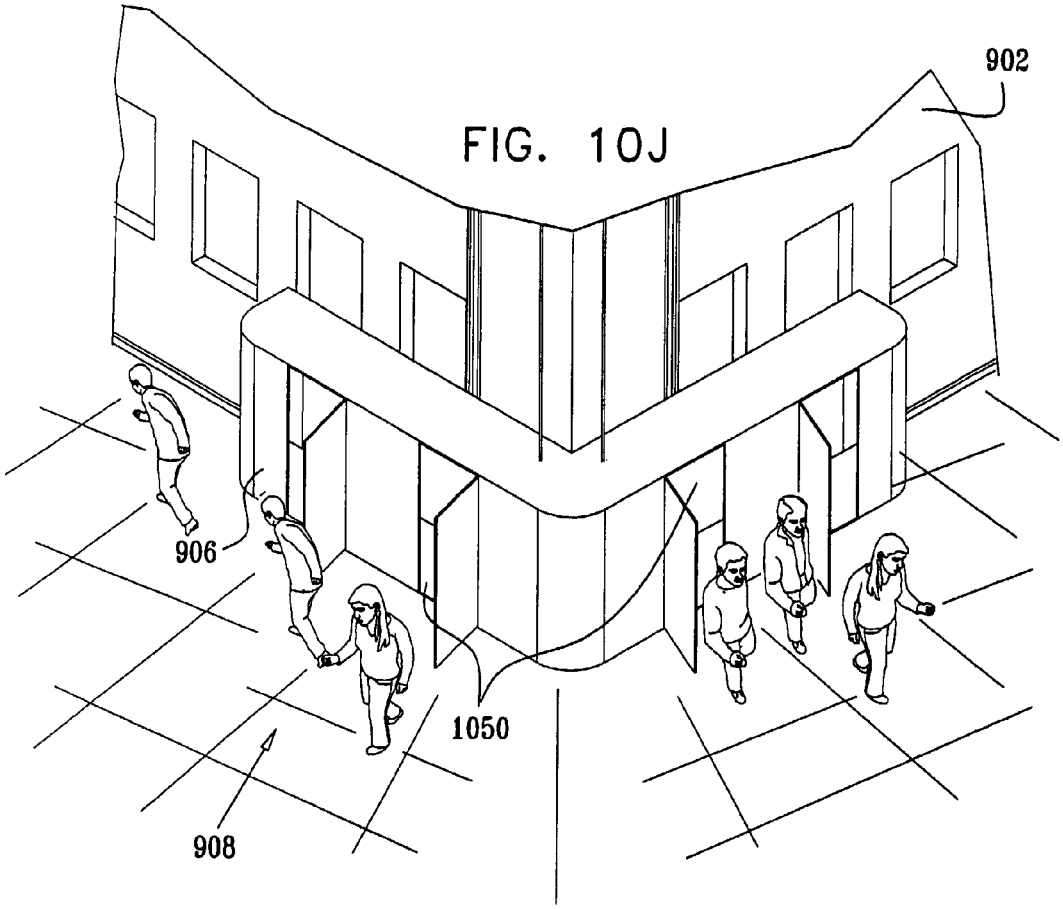

FIG. 10I illustrates platform 906 located at the egress level 908, preferably prior to egress of persons therefrom. Preferably thereafter egress of persons from platform 906 via multiple egress openings 1050 takes place generally simultaneously, as shown in FIG. 10J.

Figure 10K:
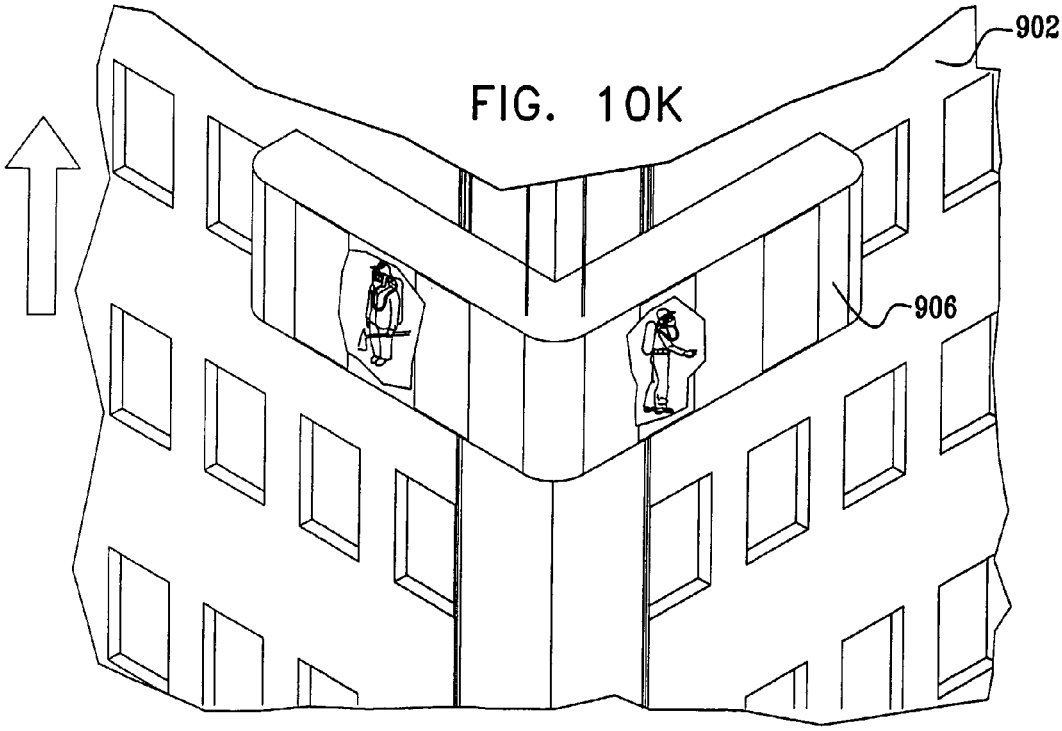

It is appreciated that the transporter 900 may be employed for raising rescue personnel or firefighters to selected floors of building 902, as shown in FIG. 10K.

It will be appreciated by persons skilled in the art that the present invention is not limited to what has been particularly shown and described hereinabove. Rather the scope of the present invention includes both combinations and subcombinations of features described hereinabove as well as variations and modifications thereof which would occur to a person skilled in the art upon reading the foregoing description, taken together with the drawings, and which are not in the prior art.

The invention claimed is:

1. An evacuation system for a building comprising:

a plurality of vertical transporters, at least one of said plurality of vertical transporters including multiple platforms arranged for selectable communication with multiple floors of said building, for at least partially simultaneous loading of persons onto said multiple platforms from said multiple floors;

at least one building mounted stabilizing element cooperating with said at least one of said plurality of vertical transporters for stabilizing said multiple platforms against lateral forces; and at least one controller operative in an ingress mode of operation to position said multiple platforms simultaneously at different ones of said multiple floors of said building said at least one of said plurality of vertical transporters being operative to at least partially simultaneously lower said multiple platforms, when loaded with said persons, along said at least one building mounted stabilizing element, to a level at which egress of persons may safely occur, said at least one controller being operative to individually control individual ones of said plurality of vertical transporters wherein multiple ones of said platforms of different transporters may be simultaneously positioned in communication with different groups of multiple floors of said building for simultaneous evacuation loading.

2. An evacuation method for emergency evacuation of persons from a building comprising:

providing a plurality of vertical transporters at least one of said vertical transporters including multiple platforms arranged for selectable communication with multiple floors of said building;

providing at least one building mounted stabilizing element for stabilizing said multiple platforms against lateral forces;

positioning said multiple platforms alongside said multiple floors;

individually controlling individual ones of said plurality of vertical transporters to simultaneously position multiple ones of said platforms of different transporters to be in communication with different groups of multiple floors of said building for simultaneous evacuation loading;

at least partially simultaneously loading said multiple platforms with persons; and operating said at least one of said plurality of transporters to at least partially simultaneously lower said multiple platforms, when loaded with said persons, along said at least one building mounted stabilizing element, to a level at which egress of persons may safely occur.

3. An evacuation system according to claim 1 and wherein said multiple platforms are arranged in a mutually collapsed relationship when not in use.

4. An evacuation system according to claim 1 and wherein said at least one of said plurality of vertical transporters comprises multiple vertical supports.

5. An evacuation system according to claim 4 and wherein said multiple vertical supports comprise cables.

6. An evacuation system according to claim 4 and wherein said multiple vertical supports comprise rigid support elements.

7. An evacuation system according to claim 1 and wherein at least one of said multiple platforms comprises a bottom support surface and a peripheral enclosing element.

8. An evacuation system according to claim 7 and wherein said peripheral enclosing element comprises at least one of a heat resistant material, a fire resistant material and a smoke impermeable material.

9. An evacuation system according to claim 1 and wherein said plurality of vertical transporters is also operative for lifting persons from an egress level to said multiple floors of said building.

10. An evacuation method according to claim 2 and also comprising simultaneously positioning said multiple platforms in communication with multiple egress locations for simultaneous evacuation.

11. An evacuation method according to claim 2 and also comprising operating said at least one of said plurality of transporters to lift persons from an egress level to said multiple floors of said building.

12. An evacuation method according to claim 2 and also comprising selectably lowering said at least one of said plurality of transporters to an egress level in the absence of electrical power.

* * * * *